US008497854B2

(12) United States Patent
Ogura

(10) Patent No.: US 8,497,854 B2
(45) Date of Patent: Jul. 30, 2013

(54) DISPLAY DRIVE APPARATUS, DISPLAY APPARATUS AND DRIVE METHOD THEREFOR

(75) Inventor: Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 1493 days.

(21) Appl. No.: 12/079,887

(22) Filed: Mar. 28, 2008

(65) Prior Publication Data

US 2008/0238953 A1 Oct. 2, 2008

(30) Foreign Application Priority Data

Mar. 30, 2007 (JP) ..... 2007-091367

(51) Int. Cl.
*G09G 5/00* (2006.01)

(52) U.S. Cl.
USPC ..... 345/204; 345/211; 345/212; 345/98; 345/99; 345/100

(58) Field of Classification Search
USPC ..... 345/697, 204, 76, 55, 212, 98, 100, 345/83
See application file for complete search history.

(56) References Cited

U.S. PATENT DOCUMENTS

| | | | | |
|---|---|---|---|---|
| 7,012,586 | B2 | 3/2006 | Kageyama et al. | |
| 2004/0017161 | A1 | 1/2004 | Choi | |
| 2005/0280613 | A1 * | 12/2005 | Takei et al. | 345/76 |
| 2006/0125740 | A1 * | 6/2006 | Shirasaki et al. | 345/77 |
| 2006/0221015 | A1 * | 10/2006 | Shirasaki et al. | 345/77 |
| 2007/0164959 | A1 | 7/2007 | Childs | |
| 2008/0074362 | A1 | 3/2008 | Ogura | |

FOREIGN PATENT DOCUMENTS

| | | | |
|---|---|---|---|
| JP | 08-330600 | A | 12/1996 |
| JP | 2005-134435 | A | 5/2005 |
| JP | 2006-301250 | A | 11/2006 |
| WO | WO 2005/069267 | A1 | 7/2005 |
| WO | WO 2008/038819 | A1 | 4/2008 |

OTHER PUBLICATIONS

Notification Concerning Transmittal of International Search Report (3 pages) and Written Opinion of the International Searching Authority (6 pages), dated Jul. 8, 2008, issued in a counterpart European Application.
Japanese Office Action dated Nov. 19, 2010 (and English translation thereof) in counterpart Japanese Application No. 2007-091367.

* cited by examiner

*Primary Examiner* — Grant Sitta
(74) *Attorney, Agent, or Firm* — Holtz, Holtz, Goodman & Chick, P.C.

(57) ABSTRACT

A display drive apparatus includes a detection voltage applying circuit that applies a predetermined detection voltage to the drive element of the pixel drive circuit, a voltage detecting circuit that detects a voltage value corresponding to a device characteristic unique to the drive element after a predetermined time elapses after the application of the detection voltage to the drive element by the pixel drive circuit, and a gradation designating signal generating circuit that generates a gradation designating signal based on an absolute value of a voltage component according to a gradation value of display data and a value, acquired by multiplying an absolute value of the voltage value detected by the voltage detecting circuit, by a constant greater than 1, and applies the gradation designating signal to the pixel drive circuit, whereby a change in device characteristic.

22 Claims, 36 Drawing Sheets

DISPLAY DRIVE APPARATUS, DISPLAY APPARATUS AND DRIVE METHOD THEREFOR

BACKGROUND OF THE INVENTION

1. Field of the Invention

The present invention relates to a display apparatus using the same, and a drive method therefor, and, particularly, to a display drive apparatus adaptable to a display panel (display pixel array) having an array of a plurality of current driven type (or current controlled type) emission devices each of which emits light at a predetermined luminance gradation as a current according to display data is supplied thereto, a display apparatus using the same, and a drive method for the display apparatus.

2. Description of the Related Art

Recently, there are active studies and developments on emission device type display apparatuses (emission device type displays) each having a display panel with a matrix array of current driven type emission devices, such as organic electroluminescence devices (organic EL devices), inorganic electroluminescence devices (inorganic EL devices) or light emitting diodes (LEDs), as the next generation display devices to the liquid crystal display apparatus.

Particularly, an emission device type display adopting an active matrix drive system has very superior features of having a faster display response speed and less dependency on the angle of visibility, and requiring no backlight nor light guide plate, as compared with the known liquid crystal display apparatuses. Therefore, there is an expectation of application of such an emission device type display to various electronic devices.

As such an emission device type displays employing the matrix drive system, there is known an organic EL display apparatus using organic EL devices as emission devices, which employs a drive system to control the luminance gradation by controlling the current flowing to the emission devices based on a voltage signal.

In this case, at each display pixel, there are provided a current control thin film transistor which has a gate applied with a voltage signal according to display data and lets a current having a current value according to the voltage value of the voltage signal flow to an emission device, and a switching thin film transistor which performs switching to supply a voltage signal according to the display data to the gate of the current controlling thin film transistor.

In such an organic EL display apparatus which controls the luminance gradation by setting the current value of the current flowing to the emission devices based on the voltage value of the voltage signal applied according to display data, however, the threshold value in the electric characteristic of the current controlling thin film transistor or the like may change with time. When such a change in threshold value occurs, the current value of the current flowing to the emission device varies even with the same voltage value of the voltage signal to be applied according to display data, so that the emission luminance of the emission device changes, which may impair the display characteristic.

SUMMARY OF THE INVENTION

Accordingly, it is an object of the present invention to provide a display drive apparatus which can compensate for a change in device characteristic of a drive element for display pixels to allow an emission device to emit light at an adequate luminance gradation according to display data, a display apparatus using the display drive apparatus, and a drive method therefor, so that the display apparatus and drive method have an advantage of providing an excellent display quality over a long period of time.

According to a first aspect of the invention, there is provided a display drive apparatus for driving display pixels each having an optical element and a pixel drive circuit having a drive element whose current path has one end connected to the optical element, the display drive apparatus comprising a detection voltage applying circuit that applies a predetermined detection voltage to the drive element of the pixel drive circuit; a voltage detecting circuit that detects a voltage value corresponding to a device characteristic unique to the drive element after a predetermined time elapses after the application of the detection voltage to the drive element by the pixel drive circuit; and a gradation designating signal generating circuit that generates a gradation designating signal based on an absolute value of a voltage component according to a gradation value of display data and a value, acquired by multiplying an absolute value of the voltage value detected by the voltage detecting circuit, by a constant greater than 1, and applies the gradation designating signal to the pixel drive circuit.

To achieve the object, according to a second aspect of the invention, there is provided a display apparatus for displaying image information, comprising display pixels each having an optical element and a pixel drive circuit having a drive element whose current path has one end connected to the optical element; a data line connected to the pixel drive circuit of the display pixel; a detection voltage applying circuit that applies a predetermined detection voltage to the drive element of the pixel drive circuit of the display pixel via the data line; a voltage detecting circuit that detects a voltage value corresponding to a device characteristic unique to the drive element via the data line after a predetermined time elapses after the application of the detection voltage to the drive element by the pixel drive circuit; and a gradation designating signal generating circuit that generates a gradation designating signal based on an absolute value of a voltage component according to a gradation value of display data and a value, acquired by multiplying an absolute value of the voltage value detected by the voltage detecting circuit, by a constant greater than 1, and applies the gradation designating signal to the pixel drive circuit via the data line.

To achieve the object, according to a third aspect of the invention, there is provided a drive method for a display apparatus for displaying image information, comprising applying a predetermined detection voltage, via a data line connected to the pixel drive circuit of the display pixel, to a drive element of a pixel drive circuit in a display pixel having an optical element and the pixel drive circuit having the drive element whose current path has one end connected to the optical element; detecting a voltage value corresponding to a device characteristic unique to the drive element via the data line after a predetermined time elapses after the application of the detection voltage to the drive element; generating a gradation designating signal based on an absolute value of a voltage component according to a gradation value of display data and a value, acquired by multiplying an absolute value of the voltage value detected by the voltage detecting circuit, by a constant greater than 1; and applying the gradation designating signal to the pixel drive circuit via the data line.

DETAILED DESCRIPTION OF THE PREFERRED EMBODIMENT

A display drive apparatus according to the present invention and a drive method therefor, and a display apparatus according to the invention and a drive method therefor will be described in detail by way of embodiment.

<Structure of Essential Portion of Display Pixel>

To begin with, the structure of the essential portion of a display pixel to be applied to a display apparatus according to the present invention and a control operation for the display pixel will be described with reference to the accompanying drawings.

Figure 1:
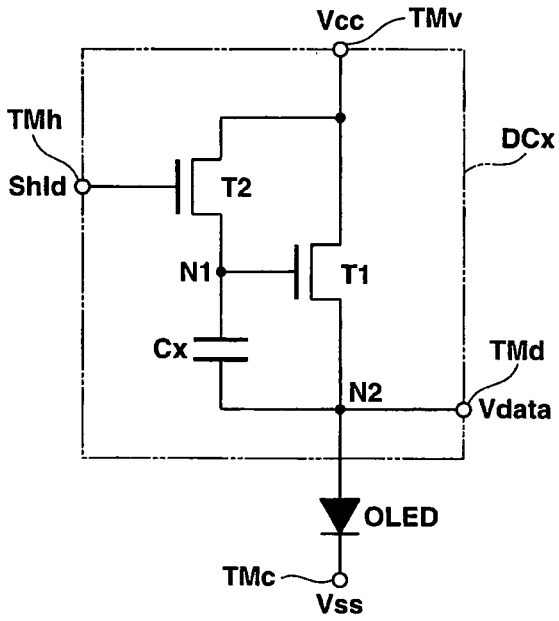
FIG. 1 is an equivalent circuit diagram showing the essential structure of a display pixel to be applied to a display apparatus according to the present invention.

FIG. 1 is an equivalent circuit diagram showing the essential structure of a display pixel to be applied to the display apparatus according to the present invention. The following description will be given of an example where an organic EL device is applied to a current drive type emission device provided at a display pixel for the sake of convenience.

The display pixel to be applied to the display apparatus according to the present invention, as shown in FIG. 1, has a circuit configuration having a pixel circuit section (equivalent to a pixel drive circuit DC) DCx and an organic EL device OLED which is a current drive type emission device. The pixel circuit section DCx includes a drive transistor T1 having, for example, a drain terminal and a source terminal respectively connected to a power supply terminal TMv, which is applied with a supply voltage Vcc, and a node N2, and a gate terminal connected to a node N1, a hold transistor T2 having a drain terminal and a source terminal respectively connected to the power supply terminal TMv (drain terminal of the drive transistor T1), and the node N1, and a gate terminal connected to a control terminal TMh, and a capacitor Cx connected between the gate and source terminals of the drive transistor T1 (between the node N1 and node N2). The organic EL device OLED has an anode terminal connected to the node N2, and a cathode terminal TMc applied with a voltage Vss.

As will be given in the description of the control operation to be described later, a supply voltage Vcc having a voltage value which differs according to an operational state is applied to the power supply terminal TMv according to the operational state of the display pixel (pixel circuit section DCx), a constant voltage (reference voltage) Vss is applied to the cathode terminal TMc of the organic EL device OLED, a hold control signal Shld is applied to the control terminal TMh, and a data voltage Vdata corresponding to a gradation value of display data is applied to a data terminal TMd connected to the node N2.

The capacitor Cx may be a parasitic capacitor formed between gate and source terminals of the drive transistor T1 or a capacitive element formed between the node N1 and the node N2 in addition to the parasitic capacitor. The device structures, characteristics and so forth of the drive transistor T1 and the hold transistor T2, which are not particularly limited, are those of an n-channel thin film transistor applied thereto herein.

<Control Operation of Display Pixel>

Next, the control operation (control method) for a display pixel (pixel circuit section DCx and organic EL device OLED) having the foregoing circuit structure will be described.

Figure 2:
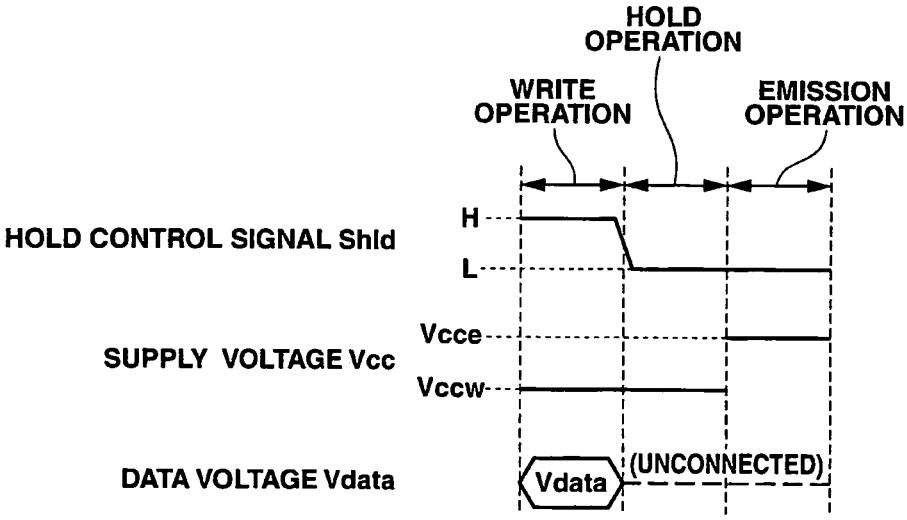
FIG. 2 is a signal waveform diagram showing the control operation of the display pixel to be applied to the display apparatus according to the invention.

FIG. 2 is a signal waveform diagram showing the control operation of the display pixel to be applied to the display apparatus according to the invention.

As shown in FIG. 2, the operational state of the display pixel (pixel circuit section DCx) having the circuit structure as shown in FIG. 1 can be roughly divided into a write operation of writing a voltage component according to the gradation value of display data in the capacitor Cx, a hold operation of holding the voltage component, written in the write operation, in the capacitor Cx, and an emission operation of letting an emission drive current according to the gradation value of display data flow to the organic EL device OLED based on the voltage component held in the hold operation and causing the organic EL device OLED to emit light at a luminance gradation according to the display data. The individual operational states will be specifically explained below referring to the timing chart shown in FIG. 2.

(Write Operation)

In the write operation, an operation of writing a voltage component according to the gradation value of display data in the capacitor Cx is performed in a light-OFF state where the organic EL device OLED does not emit light.

Figure 3A:
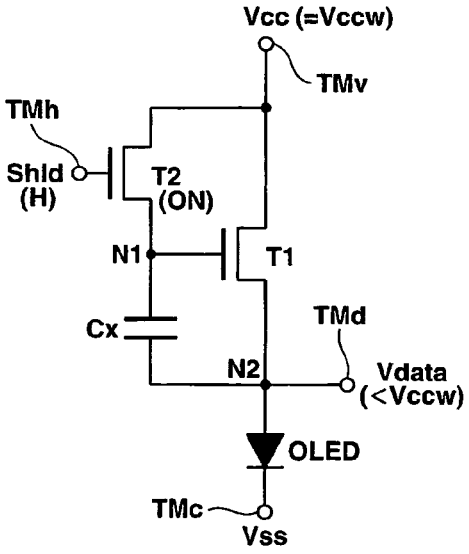
FIGS. 3A and 3B are schematic explanatory diagrams showing operational states when the display pixel is in write operation.
Figure 3B:
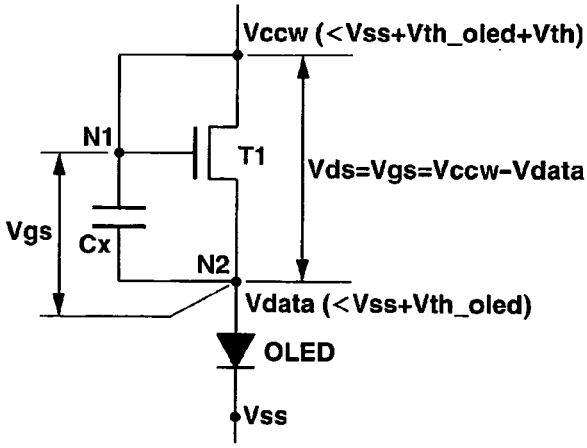

FIGS. 3A and 3B are schematic explanatory diagrams showing the operational states when the display pixel is in write operation.

Figure 4A:
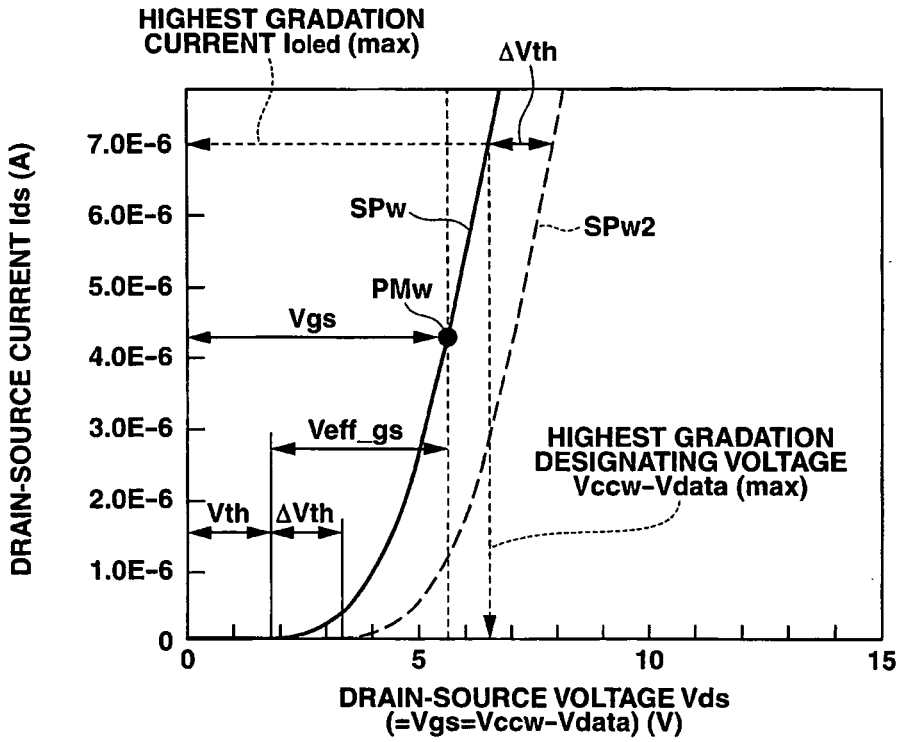
FIGS. 4A and 4B are respectively a characteristic diagram showing the operational characteristic of a drive transistor when the display pixel is in write operation, and a characteristic diagram showing the relationship between a drive current and a drive voltage of an organic EL device.
Figure 4B:
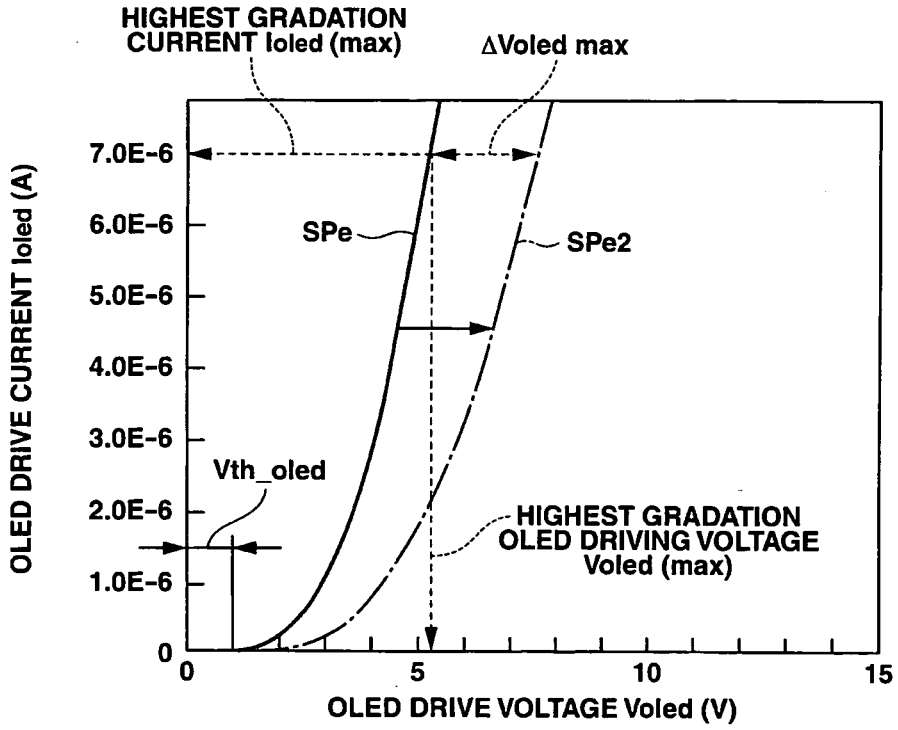

FIG. 4A is a characteristic diagram showing the operational characteristic of the drive transistor when the display pixel is in write operation, and FIG. 4B is a characteristic diagram showing the relationship between the drive current and drive voltage of the organic EL device.

A solid line SPw shown in FIG. 4A is a characteristic curve showing the relationship between a drain-source voltage Vds and a drain-source current Ids in an initial state when an n-channel type thin film transistor is adopted as the drive transistor T1 and is diode-connected. A broken line SPw2 shows one example of the characteristic curve of the drive transistor T1 when the characteristic thereof changes according to a drive history. The details will be given later. A point PMw on the characteristic curve SPw indicates an operational point of the drive transistor T1.

As shown in FIG. 4A, a threshold voltage Vth (gate-source threshold voltage=drain-source threshold voltage) of the drive transistor T1 lies on the characteristic curve SPw, and the drain-source current Ids increases non-linearly according to an increase in drain-source voltage Vds when the drain-source voltage Vds exceeds the threshold voltage Vth. That is, of the drain-source voltage Vds, a voltage denoted by Veff_gs in FIG. 4A is a voltage component which effectively forms the drain-source current Ids, and the drain-source voltage Vds becomes the sum of the threshold voltage Vth and the voltage component Veff_gs as given by an equation 1 below.

$$Vds = Vth + Veff_gs \quad (1)$$

A solid line SPe shown in FIG. 4B is a characteristic curve showing the relationship between a drive voltage Voled to be applied between the anode and cathode of the organic EL device OLED in an initial state, and a drive current Ioled which flows between the anode and cathode of the organic EL device OLED. A one-dot chain line SPe2 shows one example of the characteristic curve of the organic EL device OLED when the characteristic thereof changes according to a drive history. The details will be given later. A threshold voltage Vth_oled lies on the characteristic curve SPe, and the drive current Ioled increases non-linearly according to an increase in drive voltage Voled when the drive voltage Voled exceeds the threshold voltage Vth_oled.

In the write operation, first, an ON-level (high-level) hold control signal Shld is applied to the control terminal TMh of the hold transistor T2 to turn on the hold transistor T2 as shown in FIGS. 2 and 3A. Accordingly, the gate and drain terminals of the drive transistor T1 are connected together (short-circuited) to set the drive transistor T1 in a diode-connected state.

Subsequently, a first supply voltage Vccw for the write operation is applied to the power supply terminal TMv, and the data voltage Vdata corresponding to the gradation value of display data is applied to the data terminal TMd. At this time, the current Ids according to a potential difference (Vccw−Vdata) between the drain and source terminals of the drive transistor T1 flows between the drain and source terminals thereof. The data voltage Vdata is set to a voltage value for the organic EL device OLED to emit light at a luminance gradation according to the display data.

Because the drive transistor T1 is diode-connected at this time, as shown in FIG. 3B, the drain-source voltage Vds of the drive transistor T1 becomes equal to the gate-source voltage Vgs as given by an equation 2 below.

$$Vds=Vgs=Vccw-V\text{data} \quad (2)$$

Then, the gate-source voltage Vgs is written (charged) in the capacitor Cx.

Conditions necessary for the first supply voltage Vccw will be described. As the drive transistor T1 is of an n-channel type, for the drain-source current Ids to flow, the gate potential of the drive transistor T1 should be positive (high potential) to the source potential, and a relationship given by the following equation 3 should be fulfilled for the gate potential is equal to the drain potential or the first supply voltage Vccw, and the source potential is the data voltage Vdata.

$$V\text{data}<Vccw \quad (3)$$

With the node N2 connected to the data terminal TMd and the anode terminal of the organic EL device OLED, the potential difference between the potential at the node N2 (data voltage Vdata) and the voltage Vss at the cathode terminal TMc of the organic EL device OLED should be equal to or less than the emission threshold voltage Vth_oled of the organic EL device OLED to set the organic EL device OLED in a light-OFF state at the time of writing. Therefore, the potential at the node N2 (data voltage Vdata) should fulfill an equation 4 below.

$$V\text{data}-Vss\leqq Vth_oled \quad (4)$$

With Vss set to a ground potential of 0 V, the equation becomes an equation 5 below.

$$V\text{data}\leqq Vth_oled \quad (5)$$

Next, an equation 6 is derived from the equations 2 and 5.

$$Vccw-Vgs\leqq Vth_oled \quad (6)$$

For Vgs=Vds=Vth+Veff_gs from the equation 1, the following equation 7 is derived.

$$Vccw\leqq Vth_oled+Vth+Veff_gs \quad (7)$$

The equation 7 should be satisfied even for Veff_gs=0, so that Veff_gs=0 being set, an equation 8 below is derived.

$$V\text{data}<Vccw\leqq Vth_oled+Vth \quad (8)$$

That is, in the write operation, the value of the first supply voltage Vccw in a diode-connected state should be set to a value which satisfies the relationship of the equation 8. Next, the influence of changes in the characteristics of the drive transistor T1, and the organic EL device OLED according to the drive history will be described. It is known that the threshold voltage Vth of the drive transistor T1 increases according to the drive history. The characteristic curve SPw2 shown in FIG. 4A shows one example of the characteristic curve when the drive-history originated change has occurred, and ΔVth shows the amount of a change in threshold voltage Vth. As illustrated, the characteristic change according to the drive history of the drive transistor T1 changes substantially in the form of the parallel shift of the initial characteristic curve. Therefore, the value of the data voltage Vdata needed to acquire the emission drive current (drain-source current Ids) according to the gradation value of the display data should be increased by the change ΔVth of the threshold voltage Vth.

It is also known that the resistance of the organic EL device OLED is increased according to the drive history. A one-dot chain line SPe2 shown in FIG. 4B shows one example of a characteristic curve when the characteristic changes according to the drive history. A change in the characteristic caused by an increase in the resistance of the organic EL device OLED according to the drive history changes approximately in a direction of reducing the increasing ratio of the drive current Ioled to the drive voltage Voled with respect to the initial characteristic curve. That is, the drive voltage Voled for allowing the drive current Ioled needed for the organic EL device OLED to emit light at a luminance gradation according to display data increases by the characteristic curve SPe2 minus the characteristic curve SPe. The amount of the change becomes maximum at the highest luminance where the drive current Ioled becomes a maximum value Ioled(max) as indicated by ΔVoledmax in FIG. 4B.

(Hold Operation)

Figure 5A:
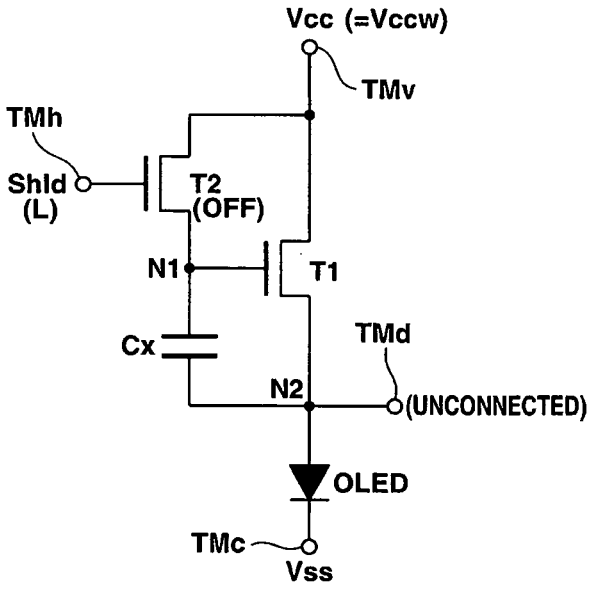
FIGS. 5A and 5B are schematic explanatory diagrams showing operational states when the display pixel is in hold operation.
Figure 5B:
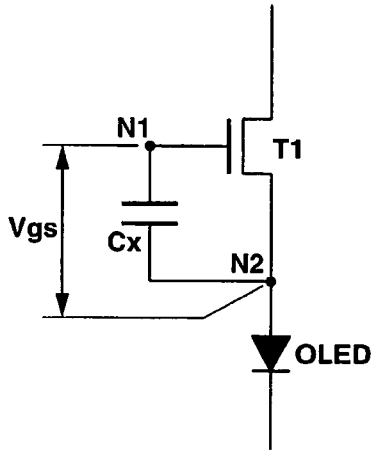

FIGS. 5A and 5B are schematic explanatory diagrams showing operational states when the display pixel is in hold operation.

Figure 6:
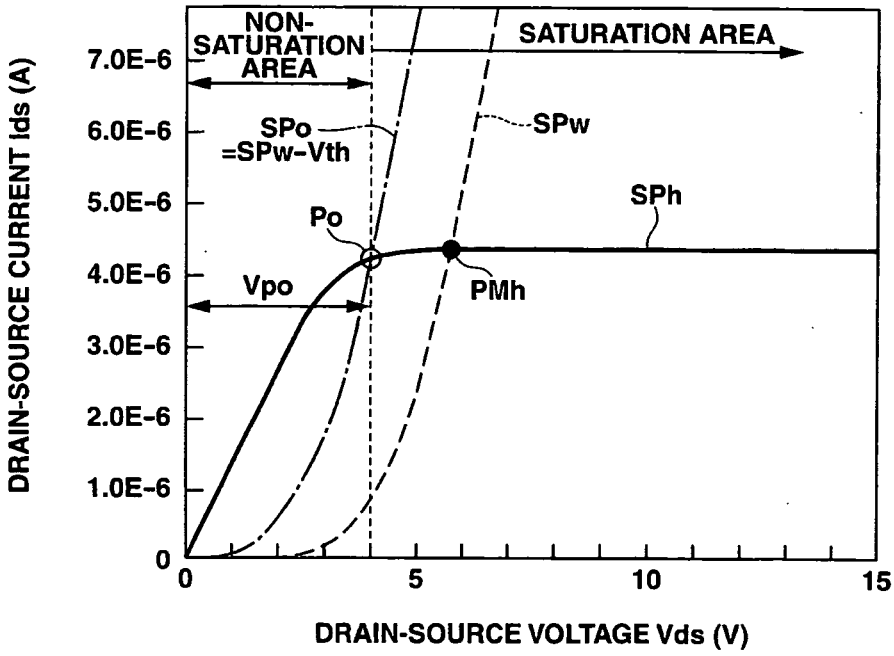
FIG. 6 is a characteristic diagram showing the operational characteristic of the drive transistor when the display pixel is in hold operation.

FIG. 6 is a characteristic diagram showing the operational characteristic of the drive transistor when the display pixel is in hold operation.

In the hold operation, as shown in FIGS. 2 and 5A, the OFF-level (low-level) hold control signal Shld is applied to the control terminal TMh to turn off the hold transistor T2, thereby blocking off (setting in a disconnected state) the gate and drain terminals of the drive transistor T1 to release the diode connection. As a result, as shown in FIG. 5B, the drain-source voltage Vds (=gate-source voltage Vgs) of the drive transistor T1 which is charged in the capacitor Cx in the write operation is held.

A solid line SPh shown in FIG. 6 is a characteristic curve when the diode connection of the drive transistor T1 is released to set the gate-source voltage Vgs to a constant voltage (e.g., voltage held in the capacitor Cx in the hold operation period). A broken line SPw shown in FIG. 6 is a characteristic curve when the drive transistor T1 is diode-connected. An operational point PMh in hold operation mode is the intersection between the characteristic curve SPw when diode connection is established and the characteristic curve SPh when diode connection is released.

A one-dot chain line SPo shown in FIG. 6 is derived as a characteristic curve SPw-Vth, and an intersection Po between the one-dot chain line SPo and the characteristic curve SPh indicates a pinch-off voltage Vpo. As shown in FIG. 6, an area in the characteristic curve SPh from a point where the drain-source voltage Vds is 0 V to a point where it is the pinch-off voltage Vpo becomes an non-saturation area, and an area where the drain-source voltage Vds exceeds the pinch-off voltage Vpo becomes a saturation area.

(Emission Operation)

Figure 7A:
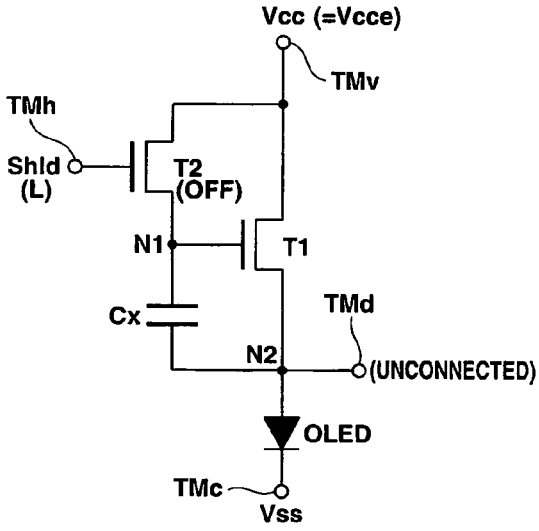
FIGS. 7A and 7B are schematic explanatory diagrams showing operational states when the display pixel is in emission operation.
Figure 7B:
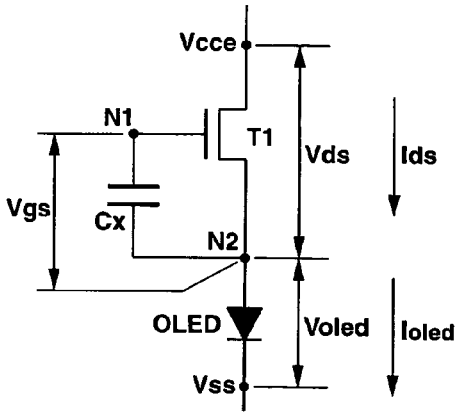

FIGS. 7A and 7B are schematic explanatory diagrams showing operational states when the display pixel is in emission operation.

Figure 8A:
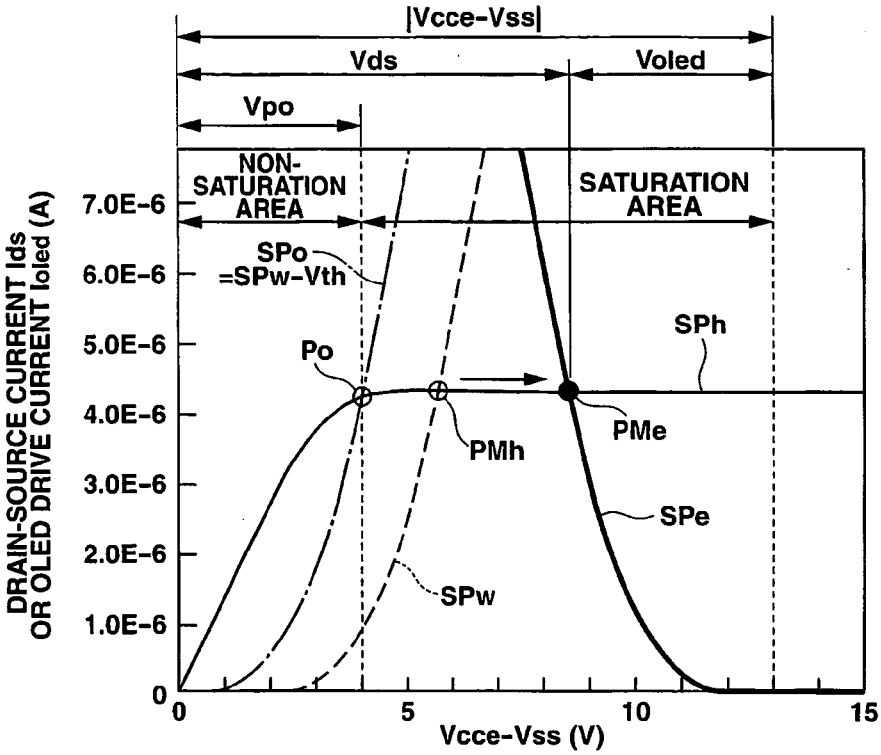
FIGS. 8A and 8B are respectively a characteristic diagram showing the operational characteristic of the drive transistor when the display pixel is in emission operation, and a characteristic diagram showing the load characteristic of the organic EL device.
Figure 8B:
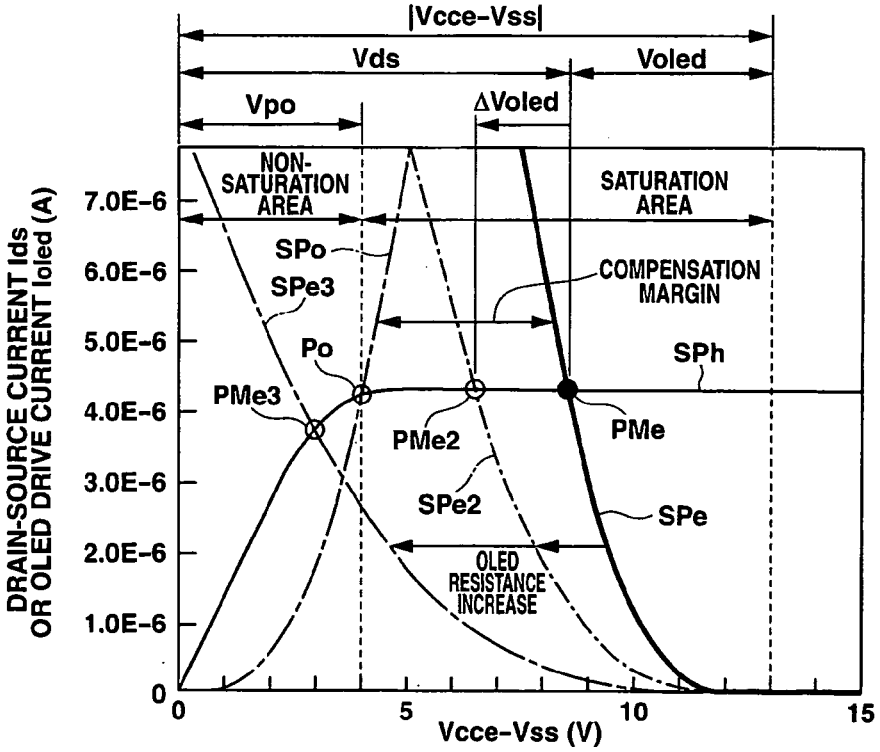

FIGS. 8A and 8B are respectively a characteristic diagram showing the operational characteristic of the drive transistor when the display pixel is in emission operation, and a characteristic diagram showing the load characteristic of the organic EL device.

As shown in FIGS. 2 and 7A, the state where the OFF-level hold control signal Shld is applied to the control terminal TMh (state where the diode connection is released) is maintained, and the first supply voltage Vccw for writing the supply voltage Vcc at the power supply terminal TMv is switched to the second supply voltage Vcce. Consequently, the current Ids according to the gate-source voltage Vgs held in the capacitor Cx flows between the drain and source terminals of the drive transistor T1 to be supplied to the organic EL device OLED, so that the organic EL device OLED emits light at a luminance according to the value of the supplied current.

A solid line SPh shown in FIG. 8A is the characteristic curve of the drive transistor T1 when the gate-source voltage Vgs is set to a constant voltage (e.g., voltage held in the capacitor Cx from the hold operation period to the emission operation period). A solid line SPe indicates the load curve of the organic EL device OLED, which is a plot of the inverse drive voltage Voled v.s. drive current Ioled characteristic of the organic EL device OLED with the potential difference between the power supply terminal TMv and the cathode terminal TMc of the organic EL device OLED, i.e., the value of Vcce−Vss taken as a reference.

The operational point of the drive transistor T1 in the emission operation moves to PMe which is the characteristic curve SPh of the drive transistor T1 and the load curve SPe of the organic EL device OLED. As shown in FIG. 8A, the operational point PMe represents a point where the voltage Vcce-Vss, applied between the power supply terminal TMv and the cathode terminal TMc of the organic EL device OLED, is distributed between the drain and source terminals of the drive transistor T1 and the anode and cathode terminals of the organic EL device OLED. That is, at the operational point PMe, the voltage Vds is applied between the drain and source terminals of the drive transistor T1, and the drive voltage Voled is applied between the anode and cathode of the organic EL device OLED.

The operational point PMe should be kept within a saturation area on the characteristic curve in order not to change the current Ids which is let to flow between the drain and source terminals of the drive transistor T1 in the write operation mode and the drive current Ioled to be supplied to the organic EL device OLED in the emission operation mode. Voled becomes a maximum Voled(max) at the highest gradation. To keep the aforementioned PMe within the saturation area, therefore, the value of the second supply voltage Vcce should satisfy the condition given by an equation 9.

$$Vcce-Vss \geqq Vpo+Voled(\max) \quad (9)$$

If Vss is set to the ground potential of 0 V, an equation 10 is derived.

$$Vcce \geqq Vpo+Voled(\max) \quad (10)$$

<Relationship Between Variation in Characteristic of Organic EL Device and Voltage-Current Characteristic>

As shown in FIG. 4B, the resistance of the organic EL device OLED increases according to the drive history and changes in the direction of reducing the increasing ratio of the drive current Ioled with respect to the drive voltage Voled. That is, the resistance changes in the direction of reducing the inclination of the load curve SPe of the organic EL device OLED shown in FIG. 8A. FIG. 8B shows a change in the load curve SPe of the organic EL device OLED according to the drive history, and the load curve changes like SPe→SPe2→SPe3. As a result, the operational point of the drive transistor T1 shifts the characteristic curve SPh of the drive transistor T1 in the direction of PMe→PMe2→PMe3 according to the drive history.

At this time, while the operational point lies in the saturation area (PMe→PMe2), the drive current Ioled keeps the value of the expected current in the write operation mode, but when the operational point enters the saturation area (PMe3), the drive current Ioled becomes smaller than the expected current in the write operation mode, i.e., the difference between the current value of the drive current Ioled flowing to the organic EL device OLED and the current value of the expected current in the write operation mode becomes apparently different, so that the display characteristic changes. In FIG. 8B, a pinch-off point Po lies between the non-saturation area and the saturation area, i.e., the potential difference between the operational point PMe and the pinch-off point Po in emission mode becomes a compensation margin for keeping the OLED drive current in emission mode with respect to achievement of high resistance of the organic EL. In other words, the potential difference on the characteristic curve SPh of the drive transistor sandwiched between the locus SPo of the pinch-off point and the load curve SPe of the organic EL device at each Ioled level, and becomes a compensation margin. As shown in FIG. 8B, the compensation margin decreases according to an increase in the value of the drive current Ioled, and increases according to an increase in the voltage Vcce−Vss applied between the power supply terminal TMv and the cathode terminal TMc of the organic EL device OLED.

<Relationship Between Variation in Characteristic of TFT Device and Voltage-Current Characteristic>

In voltage gradation control using a transistor which is adapted to the above-described display pixel (pixel circuit section), the data voltage Vdata is set by the initially preset characteristics of the drain-source voltage Vds of the transistor and the drain-source current Ids (initial characteristics), but the threshold voltage Vth increases according to the drive history, so that the current value of the emission drive current does not correspond to display data (data voltage), disabling an emission operation at an adequate luminance gradation. It is known that when an amorphous silicon transistor is adopted, particularly, a variation in device characteristic becomes noticeable.

The following will illustrate one example of the initial characteristic of the drain-source voltage Vds and drain-source current Ids (voltage-current characteristic) in a case where an amorphous silicon transistor having designed values shown in Table 1 performs a display operation with 256 gradation levels.

TABLE 1

| <Transistor design values> | |
|---|---|
| Gate insulating film thickness | 300 nm (3000 Å) |
| Channel width W | 500 μm |
| Channel length L | 6.28 μm |
| Threshold voltage Vth | 2.4 V |

The voltage-current characteristic of an n-channel type amorphous silicon transistor or the relationship between the drain-source voltage Vds and drain-source current Ids shown in FIG. 4A will have an increase in Vth originating from cancellation of the gate field caused by carriers trapped in the gate insulating film according to the drive history or a change with time (shifting from SPw (initial state) to SPw2 (high-voltage side)). Accordingly, given that the drain-source voltage Vds applied to the amorphous silicon transistor is constant, the drain-source current Ids decreases to reduce the luminance of an emission device.

In the change in the device characteristic, mainly the threshold voltage Vth increases, and the voltage-current characteristic (V-I characteristic) of the amorphous silicon transistor becomes substantially the parallel shift of the characteristic curve in the initial state. Therefore, the V-I characteristic curve SPw2 after the shift is approximately identical to the voltage-current characteristic in a case where a given voltage corresponding to a change ΔVth (about 2 V in FIG. 4A) in threshold voltage Vth is added to the drain-source voltage Vds of the V-I characteristic curve SPw in the initial state (i.e., in a case where the V-I characteristic curve SPw is shifted in parallel by ΔVth).

In other words, this means that in performing the operation of writing display data into a display pixel (pixel circuit section DCx), a data voltage (equivalent to a gradation designating voltage Vpix to be discussed later) corrected by adding a given voltage (compensation voltage Vpth) corresponding to a change ΔVth in the device characteristic (threshold voltage) of the drive transistor T1 provided at the display pixel can be applied to the source terminal (node N2) of the drive transistor T1 to compensate for the shift of the voltage-current characteristic originating from a change in threshold voltage Vth of the drive transistor T1, thereby allowing a drive current Iem having a current value according to the display data to flow to the organic EL device OLED and enabling an emission operation at the desired luminance gradation.

The hold operation of changing the hold control signal Shld from the ON level to the OFF level and the emission operation of changing the supply voltage Vcc from the voltage Vccw to the voltage Vcce may be executed synchronously.

The following will specifically describe one embodiment of a display apparatus with a display panel having a two-dimensional array of display pixels including the structure of the essential portion of the above-described pixel circuit section.

<Display Apparatus>

Figure 9:
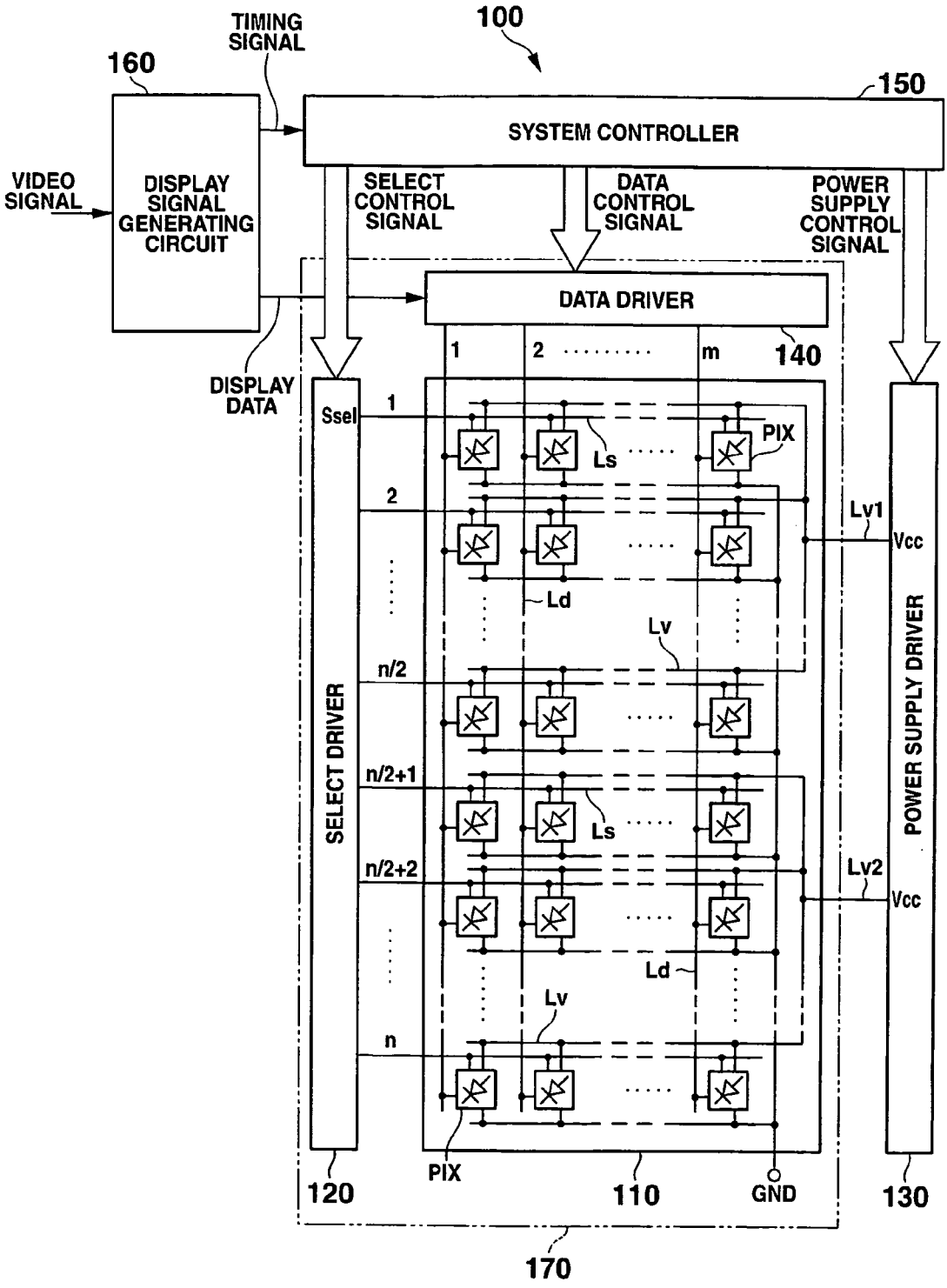
FIG. 9 is a schematic configurational diagram showing a first embodiment of the invention.

FIG. 9 is a schematic configurational diagram showing one embodiment of the display apparatus according to the invention.

Figure 10:
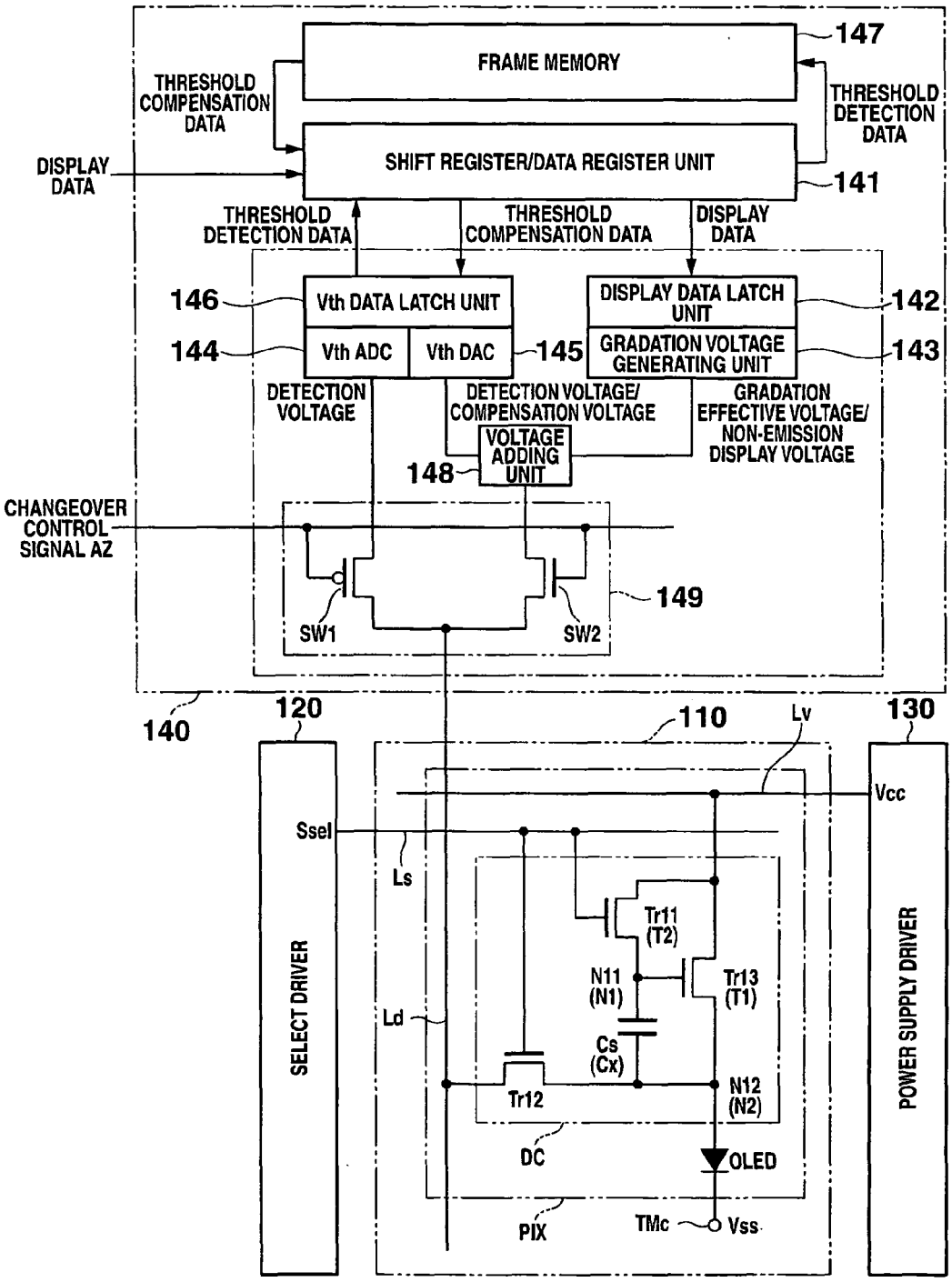
FIG. 10 is an essential configurational diagram exemplifying a data driver and a display pixel to be applicable to the display apparatus according to the embodiment.

FIG. 10 is an essential configurational diagram exemplifying a data driver (display drive apparatus) and a display pixel (pixel circuit section and emission device) to be applicable to the display apparatus according to the first embodiment.

FIG. 10 illustrates a part of a specific display pixel to be laid on the display panel of the display apparatus and a part of a data driver which performs emission drive control of the display pixel. In FIG. 10, reference numerals given to circuit structures corresponding to the above-described pixel circuit section DCx (see FIG. 1) are also shown. While various kinds of signals and data to be transferred among the individual components of the data driver, voltages and the like to be applied are shown for the sake of descriptive convenience, those signals, data, voltages, etc. are not necessarily be transferred or applied at the same time.

As shown in FIGS. 9 and 10, a display apparatus 100 according to the embodiment has a display area 110, a select driver 120, a power supply driver 130, a data driver (display drive apparatus) 140, a system controller 150, a display signal generating circuit 160, and a display panel 170. The display area 110 has an array of, for example, n rows by m columns (n and m being arbitrary positive integers) of a plurality of display pixels PIX each including the essential structure (see FIG. 1) of the foregoing pixel circuit section DCx and provided near the intersection of each of a plurality of select lines Ls disposed in the row direction (right and left direction in the diagrams and each of a plurality of data lines Ld disposed in the column direction (up and down direction in the diagrams). The select driver 120 applies a select signal Ssel to each select line Ls at a predetermined timing. The power supply driver 130 applies a supply voltage Vcc of a predetermined voltage level to a plurality of supply voltage lines Lv, disposed in the row direction in parallel to the select lines L, at a predetermined timing. The data driver 140 supplies a gradation signal (gradation designating voltage Vpix) to each data line Ld at a predetermined timing. The system controller 150 generates and outputs a select control signal, a power supply control signal and a data control signal for controlling the operational states of at least the select driver 120, the power supply driver 130 and the data driver 140, based on a timing signal supplied from the display signal generating circuit 160 to be described later. The display signal generating circuit 160 generates and supplies display data (luminance gradation data) comprised of a digital signal to the data driver 140, extracts or generates a timing signal (system clock or the like) for displaying predetermined image information on the display area 110, and supplies the timing signal to the system controller 150, based on a video signal supplied from, for example, outside the display apparatus 100. The display panel 170 has a board on which the display area 110, the select driver 120 and the data driver 140 are provided.

While the power supply driver 130 is connected outside the display panel 170 via a film board in FIG. 9, it may be disposed on, for example, the display panel 170. The data driver 140 may be configured so as to be partially provided at the display panel 170 while a part of the remaining portion is connected outside the display panel 170 via, for example, a film board. At this time, a part of the data driver 140 in the display panel 170 may be an IC chip or may comprise transistors which are fabricated together with the individual transistors of pixel drive circuits DC (pixel circuit sections DCx) to be described later.

The select driver 120 may be an IC chip or may comprise transistors which are fabricated together with the individual transistors of the pixel drive circuits DC (pixel circuit sections DCx) to be described later.

(Display Panel)

In the display apparatus 100 according to the embodiment, a plurality of display pixels PIX are provided in a matrix array at the display area 110 located at, for example, substantially the center of the display panel 170. As shown in FIG. 9, for example, the display pixels PIX are grouped into an upper area (upper side in the diagram) and a lower area (lower side in the diagram) of the display area 110, and the display pixels PIX included in each group are connected to respective branched supply voltage lines Lv. The individual supply voltage lines Lv of the upper area group are connected to a first supply voltage line Lv1, and the individual supply voltage lines Lv of the lower area group are connected to a second supply voltage line Lv2. The first supply voltage line Lv1 and the second supply voltage line Lv2 are connected to the power supply driver 130 electrically independently. That is, the supply voltage Vcc that is commonly applied to the display pixels PIX of the first to n/2-th rows (n being an even number) in the upper area of the display area 110 via the first supply voltage line Lv1 and the supply voltage Vcc that is commonly applied to the display pixels PIX of the (1+n/2)-th to n-th rows in the lower area of the display area 110 via the second supply voltage line Lv2 are independently output to the supply voltage lines Lv of different groups at different timings by the power supply driver 130.

(Display Pixels)

The display pixels PIX which are adopted in the embodiment are disposed near the intersections between the select lines Ls connected to the select driver 120 and the data lines Ld connected to the data driver 140. As shown in FIG. 10, for example, each display pixel PIX has the organic EL device OLED, which is a current drive type emission device, and the pixel drive circuit DC, which includes the essential structure (see FIG. 1) of the above-described pixel circuit section DCx and generates an emission drive current for allowing the organic EL device OLED to emit light.

The pixel drive circuit DC includes a transistor Tr11 (diode-connecting transistor) which has a gate terminal connected to the select line Ls, a drain terminal connected to the supply voltage line Lv and a source terminal connected to the node N11, a transistor Tr12 (select transistor) which has a gate terminal connected to the select line Ls, a source terminal connected to the data line Ld and a drain terminal connected to the node N12, a transistor Tr13 (drive transistor) which has a gate terminal connected to the node N11, a drain terminal connected to the supply voltage line Lv and a source terminal connected to the node N12, and a capacitor Cs (capacitive element) connected between the node N11 and the node N12 (between the gate and source terminals of the transistor Tr13).

The transistor Tr13 corresponds to the drive transistor T1 in the essential structure (FIG. 1) of the pixel circuit section DCx, the transistor Tr11 corresponds to the hold transistor T2, the capacitor Cs corresponds to the capacitor Cx, and the nodes N11 and N12 respective correspond to the nodes N1 and N2. The select signal Ssel to be applied to the select line Ls by the select driver 120 corresponds to the aforementioned hold control signal Shld, and the gradation designating signal (gradation designating voltage Vpix) to be applied to the data line Ld by the data driver 140 corresponds to the aforementioned data voltage Vdata.

The organic EL device OLED has the anode terminal connected to the node N12 of the pixel drive circuit DC and the cathode terminal TMc to which the reference voltage Vss which is a constant voltage is applied. In the drive operation of the display apparatus which will be described later, in the write operation period where the gradation designating signal (gradation designating voltage Vpix) according to display data is supplied to the pixel drive circuit DC, the correction gradation designating voltage Vpix applied by the data driver 140, the reference voltage Vss and the high-potential supply voltage Vcc (=Vcce) to be applied to the supply voltage line Lv in the emission operation period satisfy the relationships given in the equations 3 to 10, so that the organic EL device OLED is not turned on in the write operation mode.

The capacitor Cs may be a parasitic capacitor formed between the gate and source terminals of the transistor Tr13, or a capacitive element other than the transistor Tr13 formed between the node N1 and the node N2 in addition to the parasitic capacitor, or both.

The transistors Tr11 to Tr13 are not particularly limited, but an n-channel type amorphous silicon thin film transistor can be adopted for the transistors Tr11 to Tr13 if each constituted by an n-channel type field effect transistor. In this case, the pixel drive circuit DC having amorphous silicon thin film transistors with stable device characteristics (electron mobility, etc.) can be fabricated in a relatively simple fabrication process using the amorphous silicon fabrication technology already achieved. The following will describe a case where n-channel type thin film transistors are adopted for all of the transistors Tr11 to Tr13.

The circuit structure of the display pixel PIX (pixel drive circuit DC) is not limited to the one shown in FIG. 10, and the display pixel PIX may take another circuit structure as long as it has at least elements corresponding to the drive transistor T1, the hold transistor T2 and the capacitor Cx shown in FIG. 1, and the current path of the drive transistor T1 is connected in series to the current drive type emission device (organic EL device OLED). The emission device which is driven to emit light by the pixel drive circuit DC is not limited to the organic EL device OLED, but may be another current drive type emission device such as a light emitting diode.

(Select Driver)

The select driver 120 sets the display pixels PIX of each row in either a selected state or an unselected state by applying the select signal Ssel of a selection level (high level for the display pixel PIX shown in FIG. 10) to each select line Ls based on a select control signal supplied from the system controller 150. Specifically, for the display pixels PIX of each row, during a threshold voltage detection period Tdec to be described later, and a write operation period Twrt in a display operation period Tcyc to be described later, the operation of applying the select signal Ssel of the selection level (high level) to the select line Ls of that row is sequentially executed at predetermined timing row by row, thereby setting the display pixels PIX of each row in the selected state (selection period).

The select driver 120 in use may have a shift register which sequentially outputs shift signals corresponding to the select lines Ls of the individual rows based on the select control signal supplied from the system controller 150, and an output circuit section (output buffer) which sequentially outputs the select signal Ssel to the select lines Ls of the individual rows. Some or all of the transistors included in the select driver 120 may be fabricated as amorphous silicon transistors together with the transistors Tr11 to Tr13 in the pixel drive circuit DC.

(Power Supply Driver)

Based on the power supply control signal supplied from the system controller 150, the power supply driver 130 applies the low-potential supply voltage Vcc (=Vccw) to each supply voltage line Lv at least in operation periods other than an emission operation period (threshold voltage detection period Tdec and write operation period Twrt in the display operation period Tcyc), and applies the supply voltage Vcc (=Vcce>Vccw) having a higher potential than the low-potential supply voltage Vccw in the emission operation period.

In the embodiment, as shown in FIG. 9, the display pixels PIX are grouped into, for example, the upper area and the lower area of the display area 110, and the individual branched supply voltage lines Lv are laid out for each group, so that the power supply driver 130 outputs the supply voltage Vcc to the display pixels PIX arrayed in the upper area via the first supply voltage line Lv1 in the operation period of the upper area group, and outputs the supply voltage Vcc to the display pixels PIX arrayed in the lower area via the second supply voltage line Lv2 in the operation period of the lower area group.

The power supply driver 130 in use may have a timing generator (e.g., a shift register or the like which sequentially outputs the shift signals) which generates timing signals corresponding to the supply voltage lines Lv in each area (group), and an output circuit section which converts the timing signals to predetermined voltage levels (voltage values Vccw, Vcce) and outputs the voltage levels to the supply voltage lines Lv in each area as the supply voltage Vcc. If the number of the supply voltage lines is small like the first supply voltage line Lv1 and the second supply voltage line Lv2, the power supply driver 130 may be disposed at a part of the system controller 150, not at the display panel 170.

(Data Driver)

The data driver 140 corrects a signal voltage (gradation effective voltage Vreal) according to display data (luminance gradation data) for each display pixel PIX, which is to be supplied from the display signal generating circuit 160 to be described later to generate a data voltage (gradation designating voltage Vpix) corresponding to a change in voltage (voltage characteristic unique to the pixel drive circuit DC) originating from the emission drive operation of each display pixel PIX provided with the emission driving transistor Tr13 (equivalent to the drive transistor T1), and supplies the data voltage to each display pixel PIX via the data line Ld.

The data driver 140, as shown in FIG. 10, for example, includes a shift register/data register unit 141, a display data latch unit 142, a gradation voltage generating unit 143, a threshold detection voltage analog-digital converter (hereinafter referred to as "detection voltage ADC" and denoted as "VthADC" in the diagrams) 144, a compensation voltage digital-analog converter (hereinafter referred to as "compensation voltage DAC" and denoted as "VthDAC" in the diagrams) 145, a threshold data latch unit (denoted as "Vth data latch unit" in the diagrams) 146, a frame memory 147, a voltage adding unit 148 and a data line input/output switching unit 149.

The display data latch unit 142, the gradation voltage generating unit 143, the detection voltage ADC 144, the compensation voltage DAC 145, the threshold data latch unit 146, the voltage adding unit 148 and the data line input/output switching unit 149 are provided for the data line Ld of each column, and m sets of those components are provided in the data driver 140 in the display apparatus 100 according to the embodiment. One set of the shift register/data register unit 141 and the frame memory 147, or plural sets (<m sets) of shift register/data register units 141 and frame memories 147 are commonly provided for each of a plurality of data lines Ld (e.g. all the columns).

The shift register/data register unit 141 includes a shift register which sequentially outputs shift signals based on the data control signal supplied from the system controller 150, and a data register which sequentially fetches luminance gradation data comprised of at least a digital signal externally supplied, based on the shift signals.

More specifically, the shift register/data register unit 141 selectively executes one of an operation of sequentially fetching display data (luminance gradation data) corresponding to display pixels PIX in individual columns in one row of the display area 110 and transferring the display data to the display data latch unit 142 provided for the respective columns in parallel, an operation of sequentially fetching threshold voltages (threshold detection data) in one row of display pixels PIX, which are held in the threshold data latch unit 146, and transferring the threshold voltages to the frame memory 147, and an operation of sequentially fetching threshold compensation data of display pixels PIX in a specific one row from the frame memory 147 and transferring the threshold compensation data to the threshold data latch unit 146. Those operations will be described in detail later.

The display data latch unit 142 holds the display data (luminance gradation data) of one row of display pixels PIX fetched from outside and transferred by the shift register/data register unit 141, column by column, based on a data control signal supplied from the system controller 150.

The gradation voltage generating unit (gradation designating signal generating circuit, gradation voltage generating unit, non-emission display voltage applying circuit) 143 has a function of selectively supplying either a gradation effective voltage Vreal having a predetermined voltage value for permitting the organic EL device (current controlled type emission device) OLED to emit light at a luminance gradation corresponding to display data, or a non-emission display voltage Vzero having a predetermined voltage value for setting the organic EL device OLED in a black display (lowest luminance gradation) state without performing the emission operation (non-emission operation).

A structure having a digital-analog converter (D/A converter) which converts a digital signal voltage of each display data, held in the display data latch unit 142, to an analog signal voltage based on, for example, a gradation reference voltage supplied from a supply voltage supplying circuit (not shown), and an output circuit which outputs the analog signal voltage as the gradation effective voltage Vreal at a predetermined timing can be adopted as the structure that supplies the gradation effective voltage Vreal having a voltage value according to display data. The details of the gradation effective voltage Vreal will be given later.

As illustrated in the description of the drive method (non-emission display operation) which will be given later, the non-emission display voltage Vzero is set to an arbitrary voltage value needed to sufficiently discharge charges stored between the gate and source terminals of the emission driving transistor Tr13 (in the capacitor Cs) provided in the pixel drive circuit DC constituting the display pixel PIX to thereby set the gate-source voltage Vgs (potential across the capacitor Cs) equal to or lower than at least a threshold voltage Vth13 unique to the transistor Tr13, desirably 0 V (or approximate the gate-source voltage Vgs to 0 V) in the operation of writing a gradation designating voltage Vpix(0) which is generated by adding the non-emission display voltage Vzero and a compensation voltage Vpth in the voltage adding unit 148. The non-emission display voltage Vzero and the gradation reference voltage for generating a write current Iwrt with a minute current value corresponding to black display are likewise supplied from the supply voltage supplying circuit (not shown).

The detection voltage ADC (voltage detecting circuit) 144 fetches (detects) the threshold voltage of the emission driving transistor Tr13 (or voltage component corresponding to the threshold voltage) which supplies an emission drive current to the emission device (organic EL device OLED) provided in each display pixel PIX (pixel drive circuit DC) as an analog signal voltage, and converts the analog signal voltage to threshold detection data (voltage value data) comprised of a digital signal voltage.

The compensation voltage DAC (detection voltage applying circuit, gradation designating signal generating circuit, compensation voltage generating unit) 145 generates the compensation voltage Vpth comprised of an analog signal voltage based on threshold compensation data comprised of a digital signal voltage for compensating for the threshold voltage of the transistor Tr13 provided in each display pixel PIX. As illustrated in the description of the drive method to be given later, the compensation voltage DAC 145 is configured in such a way that a predetermined detection voltage Vpv can be output so that a potential difference higher than the threshold voltage of a switching element of the transistor Tr13 is set (voltage component is held) between the gate and source terminals of the transistor Tr13 (across the capacitor Cs) in an operation of measuring the threshold voltage of the transistor Tr13 by the detection voltage ADC 144 (threshold voltage detecting operation).

The threshold data latch unit 146 selectively executes an operation of fetching and holding threshold detection data, converted and generated by the detection voltage ADC 144 for each of display pixels PIX in one row, and sequentially transferring the threshold detection data to the frame memory 147 to be described later via the shift register/data register unit 141, or an operation of sequentially fetching and holding threshold compensation data for each of display pixels PIX in one row according to the threshold detection data from the frame memory 147 and transferring the threshold compensation data to the compensation voltage DAC 145.

The frame memory (memory circuit) 147 sequentially fetches threshold detection data based on the threshold voltage detected for each of the display pixels PIX in one row by the detection voltage ADC 144 and the threshold data latch unit 146 via the shift register/data register unit 141, and individually stores the threshold detection data for one screen (one frame) of display pixels PIX and sequentially outputs and transfers the threshold detection data as threshold compensation data, or threshold compensation data according to the threshold detection data to the threshold data latch unit 146 (compensation voltage DAC 145) prior to the operation of writing display data (luminance gradation data) in each of the display pixels PIX arrayed in the display area 110.

The voltage adding unit (gradation designating signal generating circuit, operation circuit unit) 148 has a function of adding the voltage component output from the gradation voltage generating unit 143 and the voltage component output from the compensation voltage DAC 145 and outputs a resultant voltage component to each of the data lines Ld, aligned in the display area 110 in the column direction, via the data line input/output switching unit 149 to be described later. Specifically, the voltage adding unit 148 outputs the detection voltage Vpv output from the compensation voltage DAC 145 in a threshold voltage detecting operation mode of detecting the threshold voltage of each display pixel PIX, analogously adds the gradation effective voltage Vreal output from the gradation voltage generating unit 143 and the compensation voltage Vpth output from the compensation voltage DAC 145 (when the gradation voltage generating unit 143 has a D/A converter) and outputs a voltage component which is the sum of the voltages as the gradation designating voltage Vpix in a gradation display operation mode which is accompanied with the emission operation of the display pixel PIX (emission device), or outputs the non-emission display voltage Vzero directly as the gradation designating voltage Vpix(0) (=Vzero) without adding the compensation voltage Vpth to the non-emission display voltage Vzero output from the gradation voltage generating unit 143 in a non-emission display operation (black display operation) mode.

The data line input/output switching unit (signal path changeover circuit) 149 has a voltage detecting side switch SW1 for fetching a threshold voltage of the emission driving transistor provided in each display pixel PIX or a voltage corresponding to the threshold voltage into the detection voltage ADC 144 via the data line Ld, and measuring the fetched voltage, and a voltage applying side switch SW2 for supplying the detection voltage Vpv, the gradation designating voltage Vpix or the gradation designating voltage Vpix(0) (=Vzero), selectively output from the voltage adding unit 148, to each display pixel PIX via the data line Ld.

The voltage detecting side switch SW1 and the voltage applying side switch SW2 can be configured by, for example, field effect transistors (thin film transistors) having different channel polarities, and a p-channel thin film transistor can be adopted as the voltage detecting side switch SW1 and an n-channel thin film transistor can be adopted as the voltage applying side switch SW2. The gate terminals (control terminals) of those thin film transistors are connected to a same signal line, so that the ON/OFF states of the thin film transistors are controlled based on the signal level of the changeover control signal AZ to be applied to the signal line.

The wiring resistance and capacitance from the data line Ld to the voltage detecting side switch SW1 are respectively and substantially set equal to the wiring resistance and capacitance from the data line Ld to the voltage applying side switch SW2. Therefore, a voltage drop caused by the data line Ld is the same at the voltage detecting side switch SW1 and the voltage applying side switch SW2.

(System Controller)

The system controller 150 supplies each of the select driver 120, the power supply driver 130 and the data driver 140 with the select control signal, the power supply control signal and the data control signal for controlling the operational states thereof to operate the individual drivers at predetermined timings to generate and output the select signal Ssel, the supply voltage Vcc the gradation designating voltage Vpix and the like, and to execute a sequence of drive control operations (voltage applying operation and voltage converging operation, threshold voltage detecting operation including a voltage reading operation, and a display drive operation including a write operation and emission operation) on each display pixel PIX (pixel drive circuit DC), thereby controlling display of predetermined image information based on a video signal on the display area 110.

(Display Signal Generating Circuit)

The display signal generating circuit 160 extracts a luminance gradation signal component from a video signal supplied from, for example, outside the display apparatus 100, and supplies the luminance gradation signal component to the data driver 140 as display data (luminance gradation data) comprised of a digital signal for each row. When the video signal, like a TV broadcast signal (composite video signal), contains a timing signal component defining the display timing for image information, the display signal generating circuit 160 may have a function of extracting and supplying the timing signal component to the system controller 150 in addition to the function of extracting the luminance gradation signal component. In this case, the system controller 150 generates the control signals to be individually supplied to the select driver 120, the power supply driver 130 and the data driver 140 based on the timing signals supplied from the display signal generating circuit 160.

<Drive Method for Display Apparatus>

Next, referring to the accompanying drawings, a description will be given of a drive method in a case where the display apparatus having the foregoing configuration causes the emission device of a display pixel to perform an emission operation to effect gradation display.

The drive operation of the display apparatus 100 according to the embodiment roughly includes a threshold voltage detecting operation (threshold voltage detection period) of measuring a threshold voltage Vth13 (unique device characteristic) of the emission driving transistor Tr13 provided in each of the display pixels PIX arrayed in the display area 110 at any timing prior to a display drive operation (write operation, emission operation) to be described later, and the display drive operation (display drive period) of writing a gradation designating voltage Vpix, which is generated by adding a voltage component (compensation voltage Vpth=βVth13 (β>1)) or the unique threshold voltage of the transistor Tr13 multiplied by a constant β to a gradation effective voltage Vreal having a predetermined voltage value according to display data, in the emission driving transistor Tr13, provided in each display pixel PIX, after termination of the threshold voltage detecting operation, thereby causing the organic EL device OLED to emit light at a desired luminance gradation according to display data. Each control operation will be described below.

(Threshold Voltage Detecting Operation)

Figure 11:
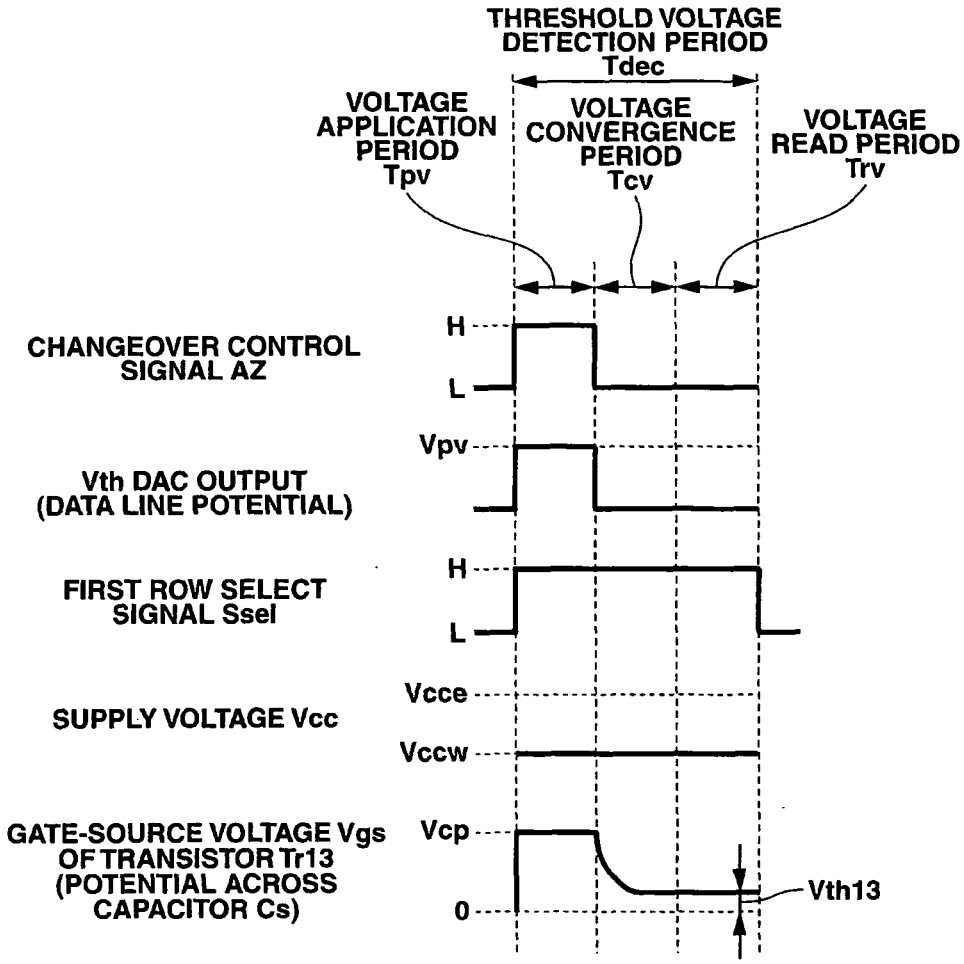
FIG. 11 is a timing chart showing one example of a threshold voltage detecting operation to be adopted to a drive method for the display apparatus according to the embodiment.

FIG. 11 is a timing chart showing one example of a threshold voltage detecting operation to be adopted to the drive method for the display apparatus according to the embodiment.

Figure 12:
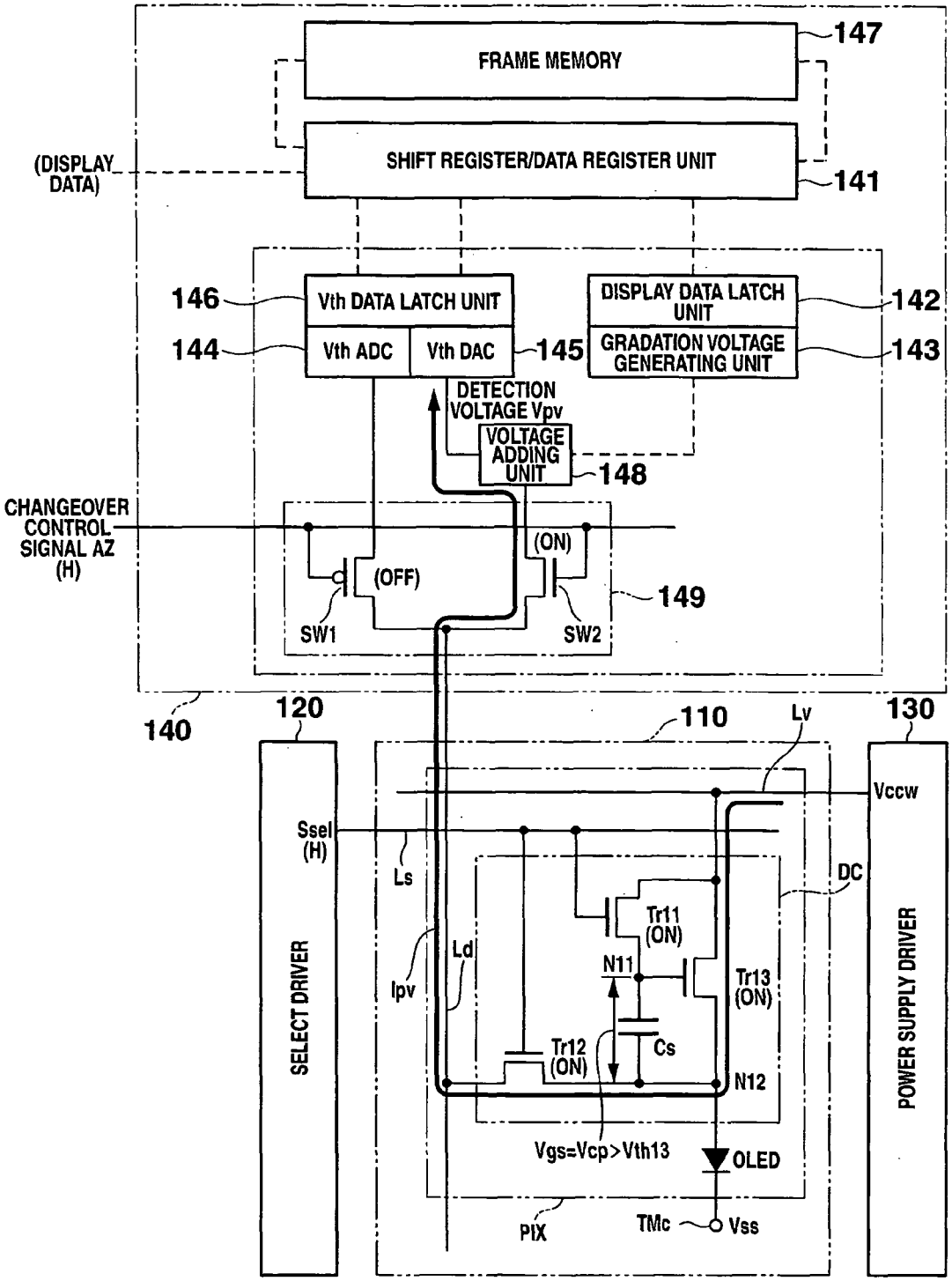
FIG. 12 is a conceptual diagram showing a voltage applying operation to be adopted to the drive method for the display apparatus according to the embodiment.

FIG. 12 is a conceptual diagram showing a voltage applying operation to be adopted to the drive method for the display apparatus according to the embodiment.

Figure 13:
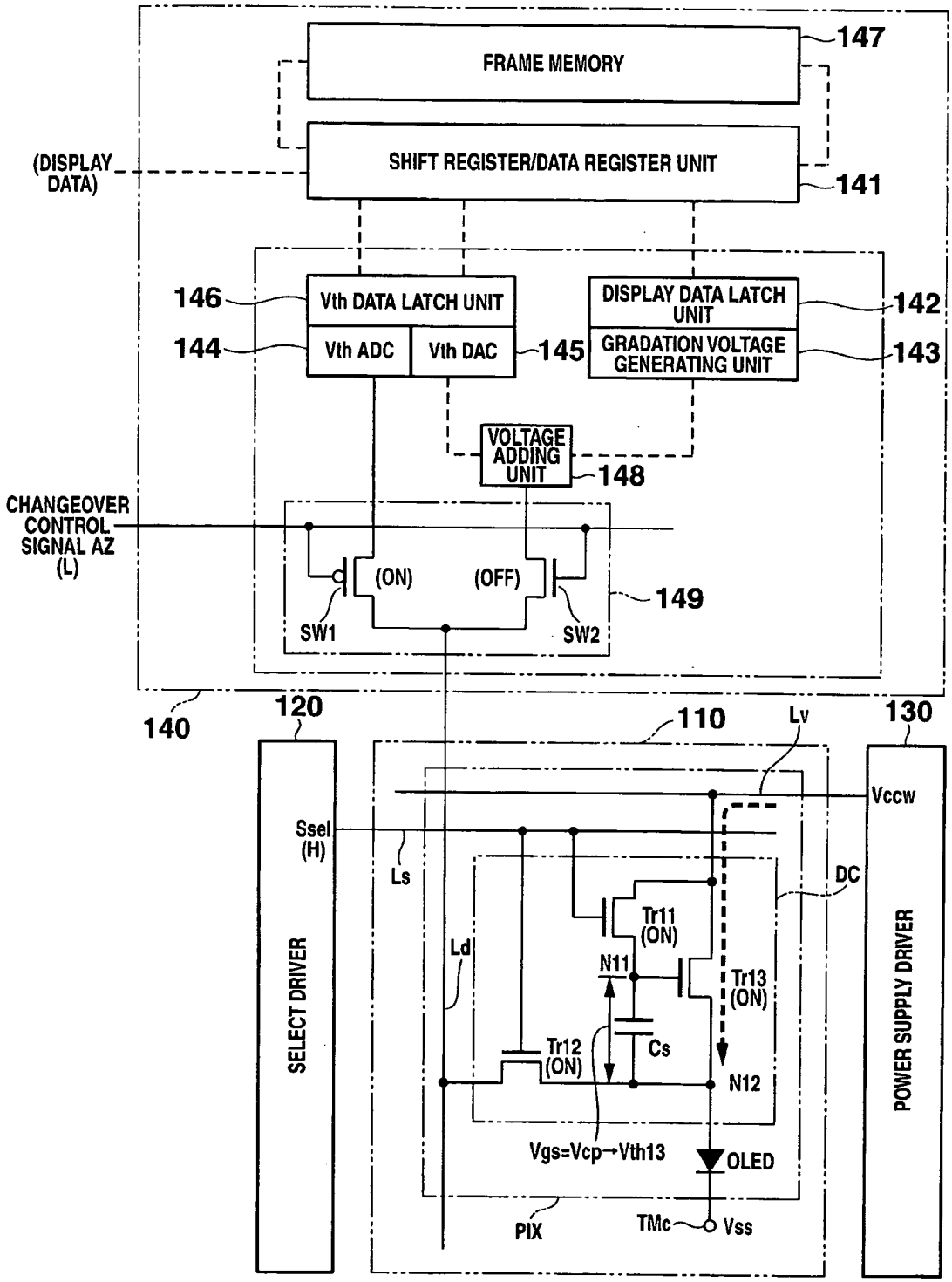
FIG. 13 is a conceptual diagram showing a voltage converging operation to be adopted to the drive method for the display apparatus according to the embodiment.

FIG. 13 is a conceptual diagram showing a voltage converging operation to be adopted to the drive method for the display apparatus according to the embodiment.

Figure 14:
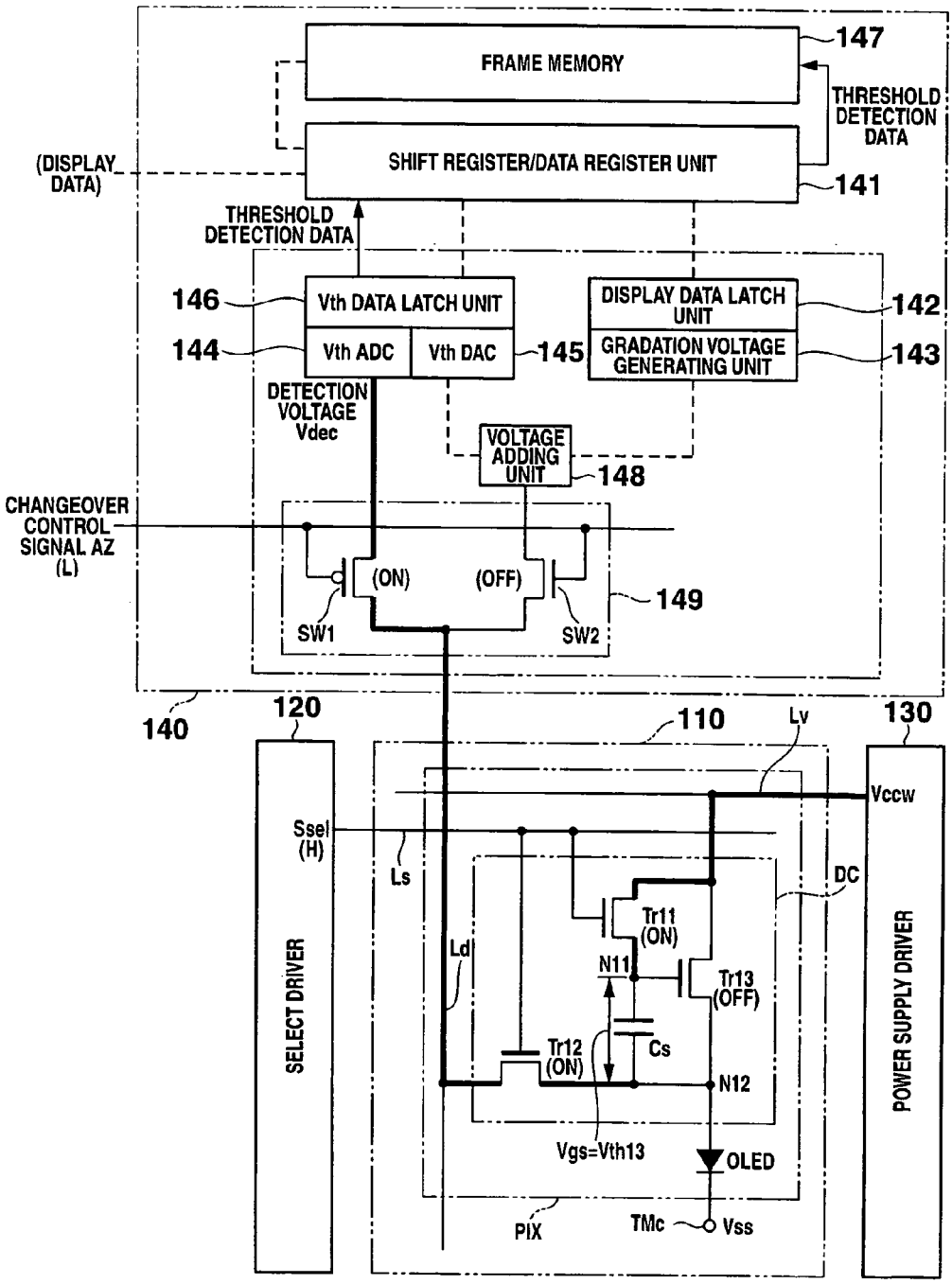
FIG. 14 is a conceptual diagram showing a voltage reading operation to be adopted to the drive method for the display apparatus according to the embodiment.

FIG. 14 is a conceptual diagram showing a voltage reading operation to be adopted to the drive method for the display apparatus according to the embodiment.

Figure 15:
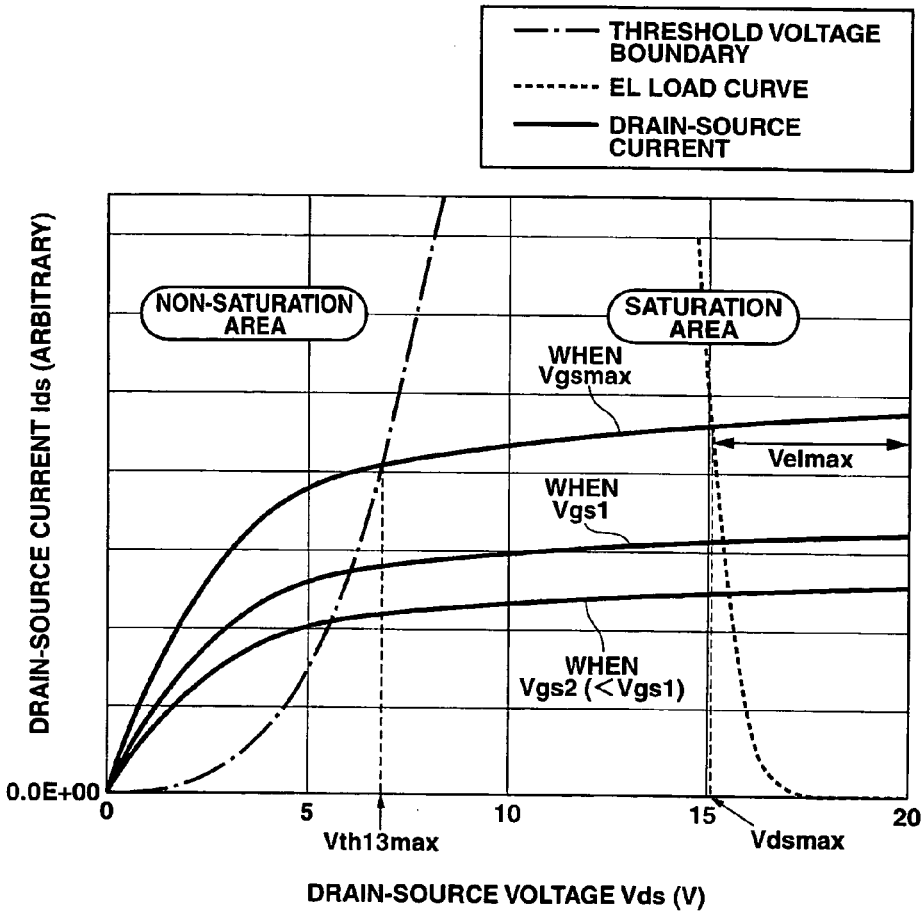
FIG. 15 is a diagram representing one example of a drain-source current characteristic when the drain-source voltage of an n-channel transistor is set to a predetermined condition and is modulated.

FIG. 15 is a diagram representing one example of a drain-source current characteristic when the drain-source voltage of an n-channel transistor is set to a predetermined condition and is modulated.

As shown in FIG. 11, the threshold voltage detecting operation of the display apparatus according to the embodiment is set in such a way that a voltage application period (detection voltage applying step) Tpv, a voltage convergence period Tcv and a voltage read period (voltage detecting step) Trv are included in a predetermined threshold voltage detection period Tdec (Tdec≧Tpv+Tcv+Trv).

In the voltage application period Tpv, a threshold voltage detecting voltage (detection voltage Vpv) is applied to the display pixel PIX via the data line Ld from the data driver 140 and a voltage component corresponding to the detection voltage Vpv is held between the gate and source terminals of the emission driving transistor Tr13 provided in the pixel drive circuit DC of the display pixel PIX (or charges according to the detection voltage Vpv are stored in the capacitor Cs) in a predetermined predetermined threshold voltage detection period Tdec.

In the voltage convergence period Tcv, the voltage component between the gate and source terminals of the emission driving transistor Tr13 held (charges stored in the capacitor Cs) in the voltage application period Tpv is partially discharged, so that only a voltage component (charges) which is equivalent to the threshold voltage Vth13 of the drain-source current Ids of the transistor Tr13 is held between the gate and source terminals of the transistor Tr13 (caused to remain in the capacitor Cs).

In the voltage read period Trv, the voltage component held between the gate and source terminals of the transistor Tr13 (voltage value based on the residual charges in the capacitor Cs; threshold voltage Vth13) is measured after elapse of the voltage convergence period Tcv, converted to digital data and stored in a predetermined memory area in the frame memory 147.

The threshold voltage Vth13 of the drain-source current Ids of the transistor Tr13 is the gate-source voltage Vgs of the transistor Tr13 which is an operational boundary at which the drain-source current Ids starts flowing as a slight voltage is further applied between the drain and source terminals.

Particularly, the threshold voltage Vth13 which is measured in the voltage read period Trv according to the embodiment indicates a threshold voltage at a point where the threshold voltage detecting operation is executed after the threshold voltage in the fabrication initial state of the transistor Tr13 is changed (Vth shift) due to a drive history (emission history) or use time or the like.

Next, the individual operation periods relating to the threshold voltage detecting operation will be described in more detail.

(Voltage Application Period)

First, in the voltage application period Tpv, as shown in FIGS. 11 and 12, the select signal Ssel with the selection level (high level) is applied to the select line Ls of the pixel drive circuit DC, and a low-potential supply voltage Vcc (=Vccw) is applied to the supply voltage line Lv. The low-potential supply voltage Vcc (=Vccw) can be a voltage equal to or lower than the reference voltage Vss, and may be a ground potential GND.

In synchronism with this timing, a changeover control signal AZ is set to a high level to set the voltage applying side switch SW2 is set on while the voltage detecting side switch SW1 is set off, the output from the gradation voltage generating unit 143 is stopped or blocked, thereby applying the detection voltage Vpv for the threshold voltage output from the compensation voltage DAC 145 is applied to the data line Ld via the voltage adding unit 148 and the data line input/output switching unit 149 (voltage applying side switch SW2).

Accordingly, the transistors Tr11 and Tr12 provided in the pixel drive circuit DC constituting the display pixel PIX are turned on, applying the supply voltage Vcc (=Vccw) to the gate terminal of the transistor Tr13 and one end side of the capacitor Cs (node N11) via the transistor Tr11, and applying the detection voltage Vpv applied to the data line Ld to the source terminal of the transistor Tr13 and the other end side of the capacitor Cs (node N12) via the transistor Tr12.

The characteristic diagram shown in FIG. 15 represents a verified characteristic of a change in the drain-source current Ids of the n-channel type transistor Tr13 which supplies an emission drive current to the organic EL device OLED in the display pixel PIX (pixel drive circuit DC) when the drain-source voltage Vds is modulated for a given gate-source voltage Vgs.

In FIG. 15, the abscissa represents a divided voltage of the transistor Tr13 and a divided voltage of the organic EL device OLED connected in series thereto, and the ordinate represents the current value of the drain-source current Ids of the transistor Tr13.

In FIG. 15, a one-dot chain line represents the boundary line of the threshold voltage between the gate and source terminals of the transistor Tr13, the left-hand side of the boundary representing an non-saturation area while the right-hand side represents a saturation area. Solid lines represent variant characteristics of the drain-source current Ids when the drain-source voltage Vds of the transistor Tr13 is modulated with the gate-source voltage Vgs of the transistor Tr13 being fixed to a voltage Vgsmax in the emission operation mode at the highest luminance gradation and voltages Vgs1 (<Vgsmax) and Vgs2 (<Vgs1) in the emission operation mode at arbitrary (different) luminance gradations below the highest luminance gradation. A broken line represents a load characteristic curve (EL load curve) when the organic EL device OLED is caused to perform an emission operation, a voltage on the right-hand side of the EL load curve being equivalent to a divided voltage of the organic EL device OLED at a voltage between the supply voltage Vcc and the reference voltage Vss (20 V in the diagram as an example) while a voltage on the left-hand side of the EL load curve is equivalent to the drain-source voltage Vds of the transistor Tr13. The higher the luminance gradation becomes, i.e., the greater the current value of the drain-source current Ids of the transistor Tr13 (emission drive current-gradation current) becomes, the greater the divided voltage of the organic EL device OLED becomes gradually.

In the non-saturation area in FIG. 15, even with the gate-source voltage Vgs of the transistor Tr13 being set constant, the current value of the drain-source current Ids noticeably increases (changes) as the drain-source voltage Vds of the transistor Tr13 becomes higher. In the saturation area, on the other hand, with the gate-source voltage Vgs of the transistor Tr13 being set constant, the current value of the drain-source current Ids of the transistor Tr13 does not increase so much and stays nearly constant even when the drain-source voltage Vds becomes higher.

The detection voltage Vpv which is applied to the data line Ld (further to the source terminal of the transistor Tr13 of the display pixel PIX (pixel drive circuit DC)) from the compensation voltage DAC 145 in the voltage application period Tpv is set to a voltage value which is sufficiently lower than the supply voltage Vcc (=Vccw) set to a low potential and provides the drain-source voltage Vds in an area where the gate-source voltage Vgs of the transistor Tr13 indicates a saturation characteristic in the characteristic diagram shown in FIG. 15. In the embodiment, the detection voltage Vpv may be set to, for example, a maximum voltage applicable to the data line Ld from the compensation voltage DAC 145.

Further, the detection voltage Vpv is set to satisfy the following equation 11.

$$|Vgs-Vpv|>Vth12+Vth13 \quad (11)$$

In the equation 11, Vth12 is the drain-source threshold voltage of the transistor Tr12 when the ON-level select signal Ssel is applied to the gate terminal of the transistor Tr12. The low-potential supply voltage Vcc (=Vccw) is applied to both the gate terminal and the drain terminal of the transistor Tr13, allowing both terminals to have nearly the same potentials, so that Vth13 is the drain-source threshold voltage of the transistor Tr13 and also the gate-source threshold voltage of the transistor Tr13. Note that while Vth12+Vth13 gradually becomes higher with time, the potential difference (Vgs−Vpv) is set large to always satisfy the equation 11.

As a potential difference Vcp greater than the threshold voltage Vth13 of the transistor Tr13 is applied between the gate and source terminals of the transistor Tr13 (i.e., across the capacitor Cs), a detection current Ipv according to the voltage Vcp is forced to flow toward the compensation voltage DAC 145 of the data driver 140 from the supply voltage line Lv via the drain and source terminals of the transistor Tr13. Therefore, charges corresponding to the potential difference based on the detection current Ipv are stored across the capacitor Cs quickly (i.e., the voltage Vcp is stored in the capacitor Cs). In the voltage application period Tpv, charges for permitting the flow of the detection current Ipv are stored not only in the capacitor Cs but also in another capacitor component formed in or parasitic to the current route extending from the supply voltage line Lv to the data line Ld.

At this time, because the reference voltage Vss (=GND) equal to or higher than the low-potential supply voltage Vcc (=Vccw) applied to the supply voltage line Lv is applied to the cathode terminal of the organic EL device OLED, between the anode and cathode of the organic EL device OLED is set in a field-free state or a reverse bias state, so that the emission drive current does not flow in the organic EL device OLED, disabling an emission operation.

(Voltage Convergence Period)

Next, in the voltage convergence period Tcv after the end of the voltage application period Tpv, shown in FIGS. 11 and 13, the changeover control signal AZ is changed to a low level with the ON-level select signal Ssel being applied to the select line Ls and the low-potential supply voltage Vcc (=Vccw) being applied to the supply voltage line Lv, thus setting the voltage detecting side switch SW1 on and setting the voltage detecting side switch SW1 off. In addition, the output of the detection voltage Vpv from the compensation voltage DAC 145 is stopped. Accordingly, the transistors Tr11, Tr12 keep the ON state, so that the display pixel PIX (pixel drive circuit DC) maintains the electric connection to the data line Ld, but voltage application to the data line Ld is blocked, so that the other end of the capacitor Cs (node N12) is set in a high-impedance state.

At this time, the gate voltage of the transistor Tr13 is held by the charges stored in the capacitor Cs (Vgs=Vcp>Vth13) in the voltage application period Tpv, so that the transistor Tr13 keeps the ON state and the current keeps flowing between the drain and source terminals thereof, thus causing the potential at the source terminal of the transistor Tr13 (node N12; the other end of the capacitor Cs) to gradually rises to approach the potential of the drain terminal thereof (supply voltage line Lv).

Consequently, the charges stored in the capacitor Cs are partially discharged, so that the gate-source voltage Vgs of the transistor Tr13 drops and changes to eventually converge to the threshold voltage Vth13 of the transistor Tr13. Accordingly, the drain-source current Ids of the transistor Tr13 decreases and the flow of the current eventually stops.

Because the potential at the anode terminal of the organic EL device OLED (node N12) is equal to lower than the reference voltage Vss at the cathode terminal in the voltage convergence period Tcv too, the organic EL device OLED remains applied with no voltage or the reverse bias voltage, so that the organic EL device OLED does not perform an emission operation.

(Voltage Read Period)

Next, in the voltage read period Trv after the end of the voltage convergence period Tcv, as shown in FIGS. 11 and 14, the potential of the data line Ld (detection voltage Vdec) is measured by the detection voltage ADC 144, electrically connected to the data line Ld, and the threshold data latch unit 146 with the ON-level select signal Ssel being applied to the select line Ls, the low-potential supply voltage Vcc (=Vccw) being applied to the supply voltage line Lv and the changeover control signal AZ being set to a low level as in the voltage convergence period Tcv.

Here, the data line Ld after elapse of the voltage convergence period Tcv is in a state of being connected to the source terminal of the transistor Tr13 (node N12) via the transistor Tr12 set in an ON state, and, as mentioned above, the potential at the source terminal of the transistor Tr13 (node N12) is equivalent to the potential at the other end of the capacitor Cs where charges equivalent to the threshold voltage Vth13 of the transistor Tr13 are stored.

The potential at the gate terminal of the transistor Tr13 (node N11) is the potential at the one end of the capacitor Cs where charges equivalent to the threshold voltage Vth13 of the transistor Tr13 are stored, and is connected to the low-potential supply voltage Vcc via the transistor Tr11 set in an ON state.

Accordingly, the potential at the data line Ld which is to be measured by the detection voltage ADC 144 is equivalent to the potential at the source terminal of the transistor Tr13 or a potential corresponding to that potential. This makes it possible to detect the gate-source voltage Vgs of the transistor Tr13 (potential across the capacitor Cs), i.e., the threshold voltage Vth13 of the transistor Tr13 or a voltage corresponding to the threshold voltage Vth13 based on the difference (potential difference) between the detection voltage Vdec and the low-potential supply voltage Vcc (e.g., Vccw=GND) whose preset voltage is known.

The threshold voltage Vth13 of the transistor Tr13 (analog signal voltage) detected this way is converted to threshold detection data comprised of a digital signal voltage by the detection voltage ADC 144, and the threshold detection data is temporarily held in the threshold data latch unit 146 after which threshold detection data in one row of display pixels PIX is sequentially read by the shift register/data register unit 141 and stored in a predetermined memory area in the frame memory 147. Because the degree of a change (Vth shift) of the threshold voltage Vth13 of the transistor Tr13 provided in the pixel drive circuit DC of each display pixel PIX differs from one display pixel PIX to another due to the drive history (emission history) or the like of each display pixel PIX, threshold detection data unique to each display pixel PIX is stored in the frame memory 147.

In the drive method for the display apparatus according to the embodiment, the above-described sequential threshold voltage detecting operation is sequentially performed on individual rows of display pixels PIX at different timings. In addition, the sequential threshold voltage detecting operation is executed at an arbitrary timing prior to the display drive operation to be described later, e.g., when the system (display apparatus) is activated or returned from a pause state, and executed within a predetermined threshold voltage detection period for every one of the display pixels PIX arrayed in the display area 110 as will be explained in the description of a specific example of the drive method to be given later.

(Display Drive Operation: Gradation Display Operation)

First, the drive method in a case where the emission device in the display apparatus and the display pixel having the foregoing structures is enabled to emit light at the desired luminance gradation (gradation display operation) will be described referring to the accompanying drawings.

Figure 16:
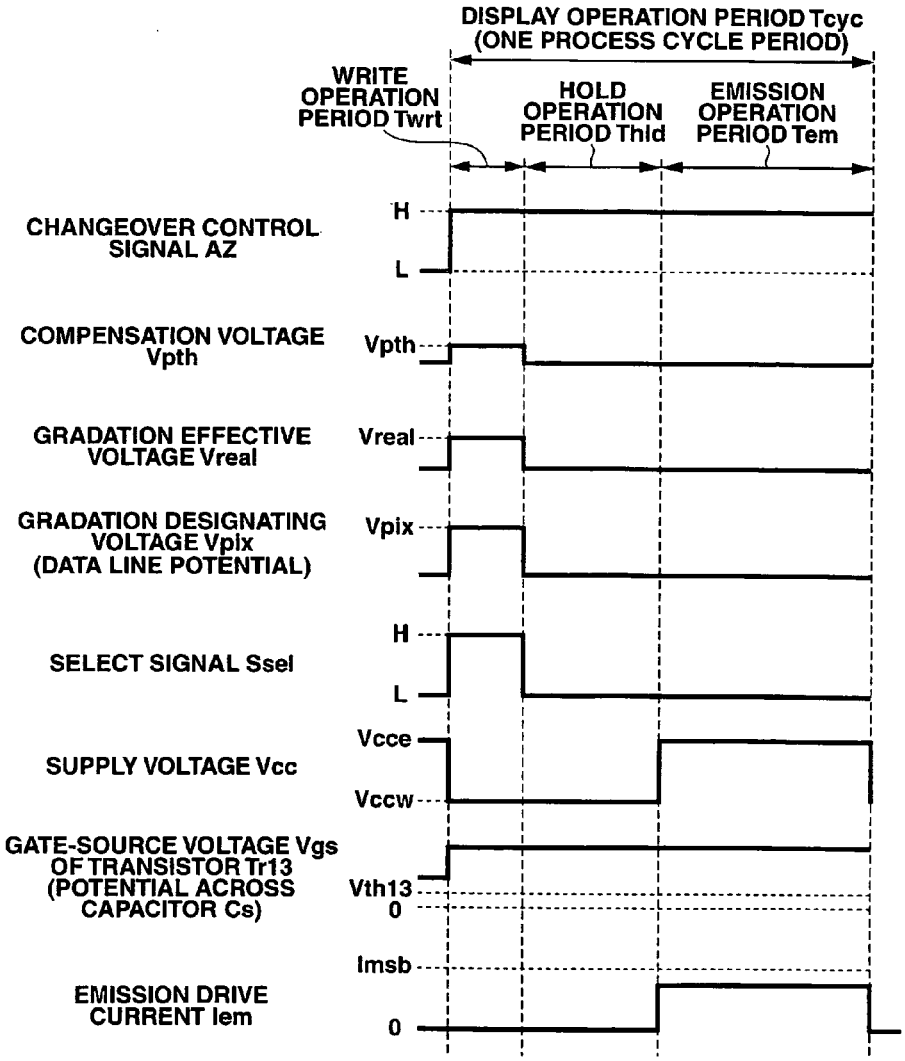
FIG. 16 is a timing chart illustrating the drive method for the display apparatus according to the embodiment in a case of performing a gradation display operation.

FIG. 16 is a timing chart illustrating the drive method for the display apparatus according to the embodiment in a case of performing the gradation display operation.

Figure 17:
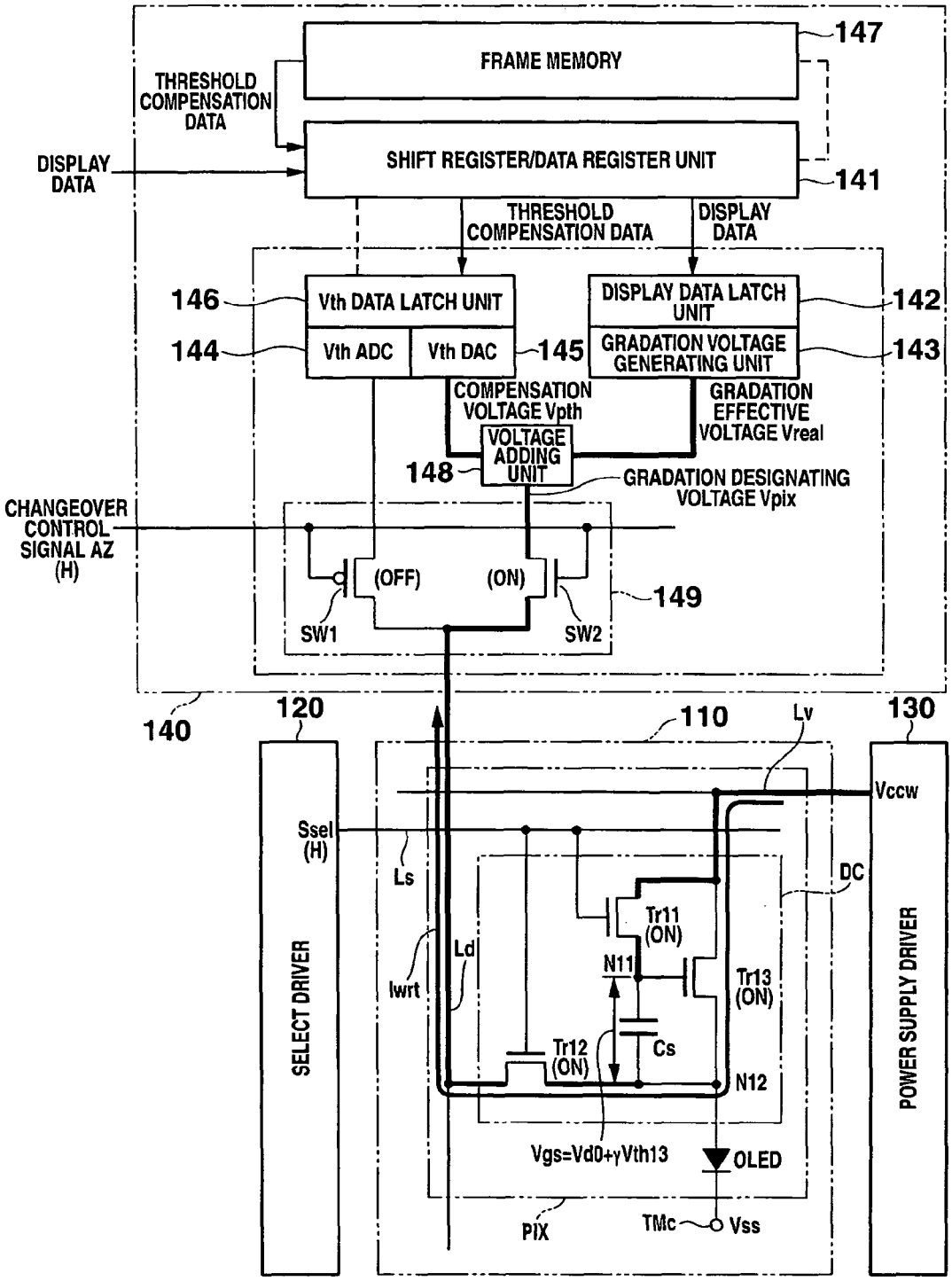
FIG. 17 is a conceptual diagram showing a write operation in the drive method (gradation display operation) according to the embodiment.

FIG. 17 is a conceptual diagram showing the write operation in the drive method (gradation display operation) according to the embodiment.

Figure 18:
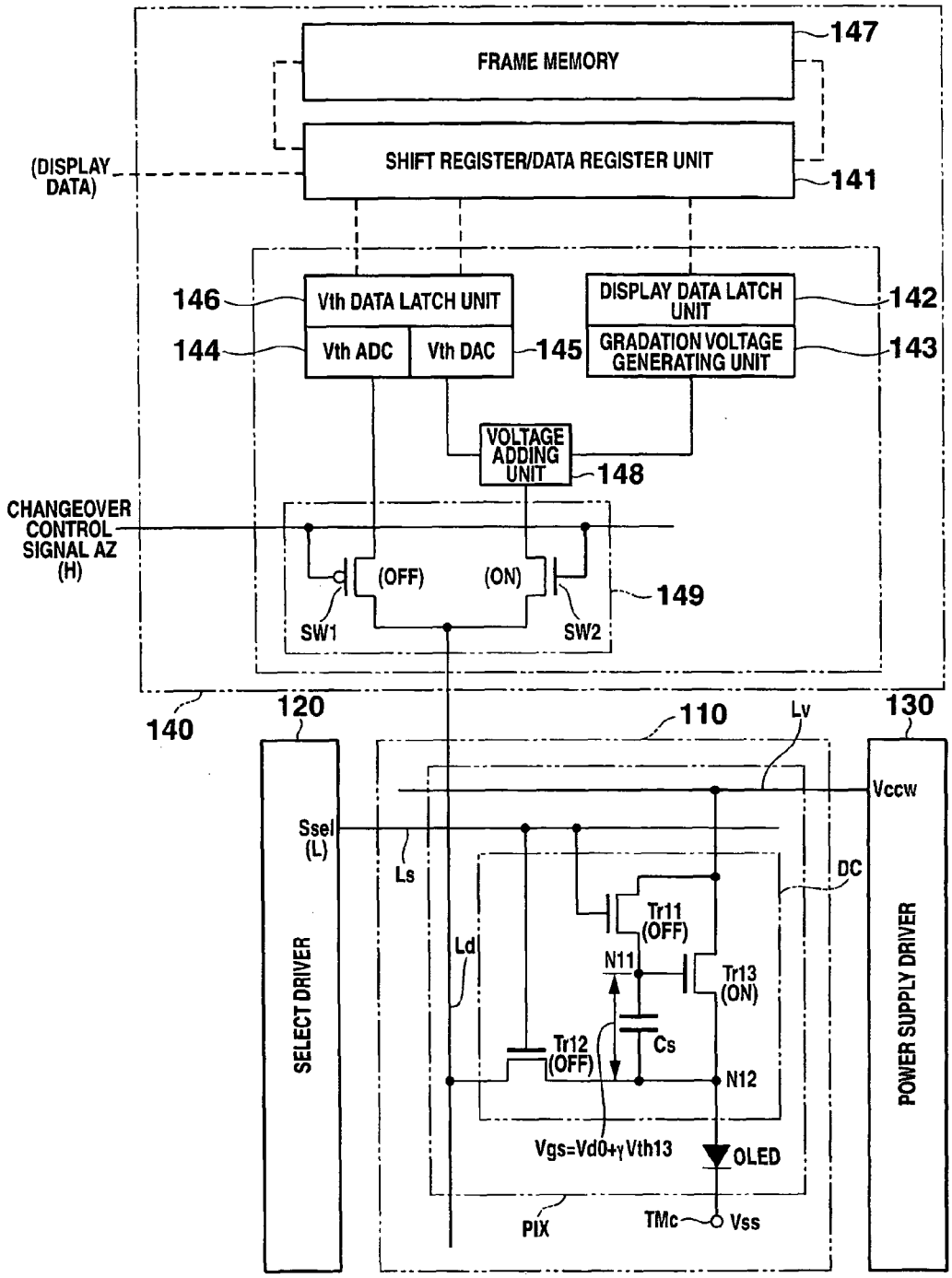
FIG. 18 is a conceptual diagram showing a hold operation in the drive method (gradation display operation) according to the embodiment.

FIG. 18 is a conceptual diagram showing the hold operation in the drive method (gradation display operation) according to the embodiment.

Figure 19:
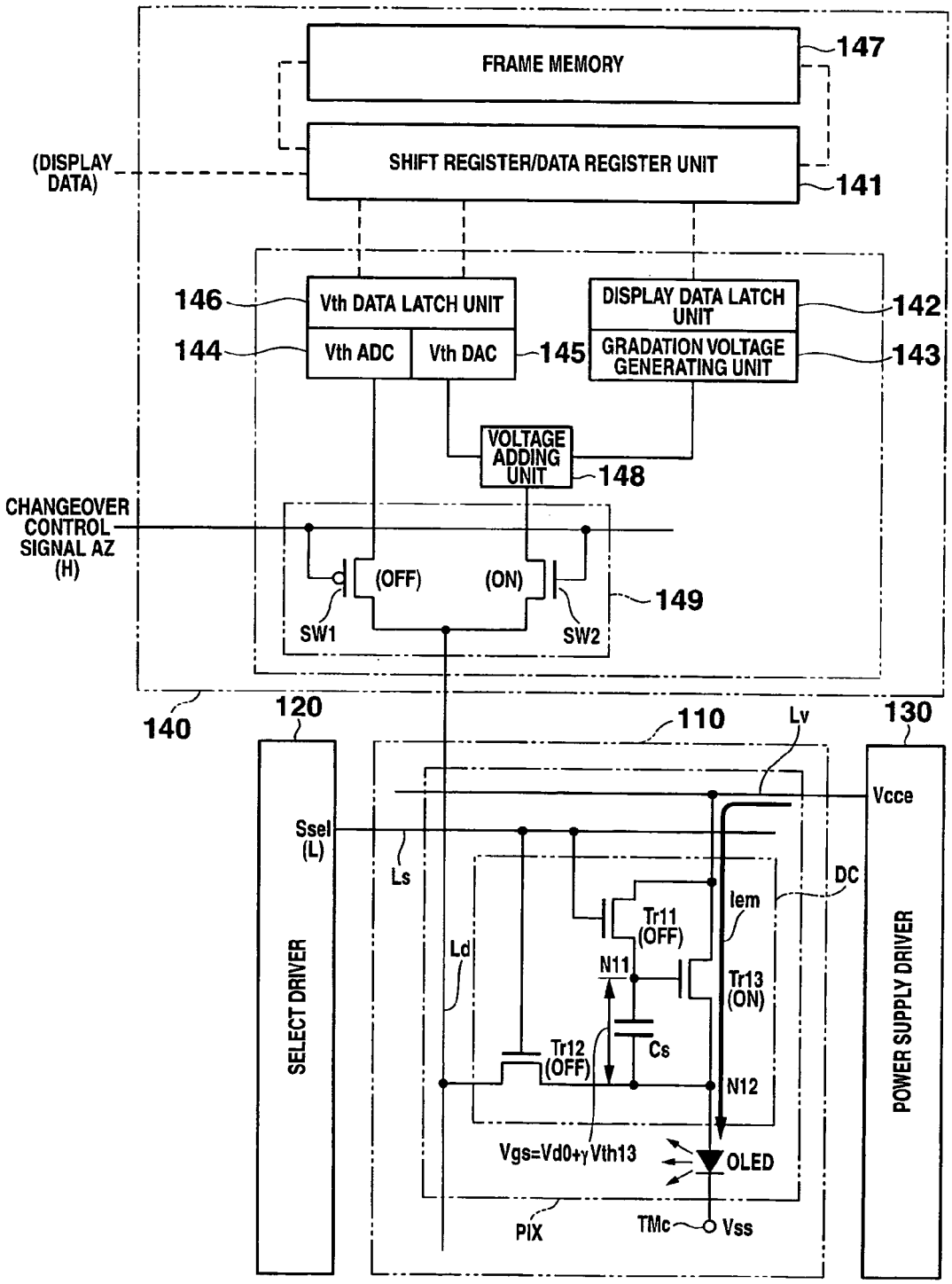
FIG. 19 is a conceptual diagram showing an emission operation in the drive method (gradation display operation) according to the embodiment.

FIG. 19 is a conceptual diagram showing the emission operation in the drive method (gradation display operation) according to the embodiment.

As shown in FIG. 16, the display drive operation (gradation display operation) of the display apparatus according to the embodiment is set in such a way that a write operation period (gradation designating signal writing step) Twrt, a hold operation period Thld and an emission operation period (gradation display step) Tem are included in a display operation period Tcyc (Tcyc≧Twrt+Thld+Tem).

In the write operation period Twrt, a voltage based on the gradation effective voltage Vreal according to display data and a predetermined compensation voltage Vpth (to be described in detail later), e.g., a voltage acquired by adding the compensation voltage Vpth to the gradation effective voltage Vreal is applied to the display pixel PIX via the data line Ld from the data driver 140 as the gradation designating voltage Vpix, a write current based on the gradation designating voltage Vpix (drain-source current Ids of the emission driving transistor Tr13) is let to flow to the pixel drive circuit DC of the display pixel PIX, and a voltage component which allows an emission drive current (drive current) Iem flowing to the organic EL device OLED from the pixel drive circuit DC in the emission operation mode to be described later to have a current value to enable emission at a luminance gradation corresponding to display data without being influenced by a change in the threshold voltage of the transistor Tr13 is held (written) between the gate and source terminals of the transistor Tr13 within a predetermined display operation period (one process cycle period) Tcyc.

In the hold operation period Thld, the voltage component according to the gradation designating voltage Vpix, which is written between the gate and source terminals of the transistor Tr13 provided in the pixel drive circuit DC of the display pixel PIX by the write operation, or charges enough to let the write current to flow in the transistor Tr13 are held in the capacitor Cs for a predetermined period.

In the emission operation period Tem, the emission drive current having a current value according to display data is let to flow to the organic EL device OLED based on the voltage component held between the gate and source terminals of the transistor Tr13 (charges stored in the capacitor Cs) to enable emission at a predetermined luminance gradation.

One process cycle period to be adopted to the display operation period Tcyc according to the embodiment is set to, for example, a period needed for the display pixel PIX to display one pixel of image information in one frame of images. That is, as will be explained in the description of the drive method for the display apparatus to be given later, in a case of display one frame of images on the display panel having a matrix of a plurality of display pixels PIX arrayed in the row direction and the column direction, the one process cycle period Tcyc is set to a period needed for one row of display pixels PIX to display one row of images in one frame of images.

The individual operation periods relating to the display drive operation will be described in more detail.

(Write Operation Period)

First, in the write operation period Twrt, as shown in FIGS. 16 and 17, the select signal Ssel having the selection level (high level) is applied to a specific select line Ls of the display area 110 from the select driver 120 based on the select control signal supplied from the system controller 150, and the low-potential supply voltage Vcc (=Vccw≦reference voltage Vss; for example, ground potential GND) is applied to the supply voltage line Lv, laid in parallel to the select line Ls, from the power supply driver 130 based on the power supply control signal supplied from the system controller 150.

As a result, the transistors Tr11 and Tr12 provided in the pixel drive circuit DC of the display pixel PIX in the row are turned on, so that the low-potential supply voltage Vcc (=Vccw) is applied to the gate terminal of the transistor Tr13 (node N11; one end of the capacitor Cs) via the transistor Tr11, and the source terminal of the transistor Tr13 (node N12; the other end of the capacitor Cs) is electrically connected to the data line Ld via the transistor Tr12.

In synchronism with this timing, the changeover control signal AZ supplied as the data control signal from the system controller 150 is set to a high level, thus setting the voltage applying side switch SW2 on and the voltage detecting side switch SW1 off. The compensation voltage Vpth generated by the compensation voltage DAC 145 is output to the voltage adding unit 148 based on the data control signal supplied from the system controller 150 (compensation voltage generating step), and the gradation effective voltage Vreal having a predetermined voltage value is generated and output by the gradation voltage generating unit 143 based on display data (luminance gradation data) fetched via the shift register/data register unit 141 and the display data latch unit 142 from the display signal generating circuit 160 (gradation voltage generating step).

In the voltage adding unit 148, the compensation voltage Vpth output from the compensation voltage DAC 145 is added to the gradation effective voltage Vreal output from the gradation voltage generating unit 143, and a voltage component which is the sum of both voltages is applied as the gradation designating voltage Vpix to the data line Ld via the voltage applying side switch SW2 of the data line input/output switching unit 149 (gradation designating signal writing step). The voltage polarity of the gradation designating voltage Vpix is set negative (Vpix<0) as given by the following equation 12 in such a way that the current flows toward the data driver 140 (voltage adding unit 148) from the supply voltage line Lv via the transistor Tr13, the node N12, the transistor Tr12 and the data line Ld. The gradation effective voltage Vreal is a positive voltage to be Vreal>0.

$$Vpix=-(V\text{real}+Vpth) \tag{12}$$

Accordingly, as shown in FIG. 17, as the gradation designating voltage Vpix set to a lower potential than the supply voltage Vcc (=Vccw) is applied to the source terminal of the transistor Tr (node N12; the other end of the capacitor Cs) via the data line Ld, the voltage component Vgs equivalent to the difference (Vccw-Vpix) between the gradation designating voltage Vpix and the low-potential supply voltage Vcc (voltage component equivalent to the gradation designating voltage Vpix when the supply voltage Vcc is the ground potential GND) is held between the gate and source terminals of the transistor Tr13 (across the capacitor Cs) (gradation designating signal writing step).

That is, a potential difference equivalent to the total (Vreal+Vpth) of the voltage component (compensation voltage Vpth) based on the threshold voltage Vth13 unique to the transistor Tr13 and the gradation effective voltage Vreal is produced across the capacitor Cs connected between the gate and source terminals of the transistor Tr13, so that charges according to the potential difference are stored in the capacitor Cs. This write operation causes the potential difference formed between the gate and source terminals of the transistor Tr13 to have a voltage value exceeding the threshold voltage Vth13 unique to the transistor Tr13. As a result, the transistor Tr13 is turned on, thus allowing a write current Iwrt to flow toward the data driver 140 (voltage adding unit 148) from the supply voltage line Lv via the transistor Tr13, the node N12, the transistor Tr12 and the data line Ld.

In the write operation period Twrt, the compensation voltage Vpth output from the compensation voltage DAC 145 is set a voltage value according to the threshold voltage Vth13 unique to the transistor Tr13 of each display pixel PIX (pixel drive circuit DC) based on the threshold detection data, detected for each display pixel PIX in the threshold voltage detecting operation and individually stored in the frame memory 147. Specifically, the compensation voltage Vpth is set to a voltage βVth13 which is acquired by multiplying the threshold voltage Vth13 generated based on the threshold detection data by the constant β, as given by the following equation 13.

$$Vpix=-(V\text{real}+Vpth)=-(V\text{real}+\beta Vth13) \tag{13}$$

Accordingly, as the gradation designating voltage Vpix which is the sum of the compensation voltage Vpth and the gradation effective voltage Vreal is applied to the display pixel PIX via each data line Ld, a voltage component which compensates for the current value of the emission drive current in the emission operation mode, not for the threshold voltage Vth13 of the transistor Tr13 in the write operation mode, can be held between the gate and source terminals of the transistor Tr13 (across the capacitor Cs) as illustrated below.

That is, as described above, it is known that when n-channel amorphous silicon thin film transistor is used as the transistors Tr11 to Tr13 constituting the pixel drive circuit DC provided in the display pixel PIX, the transistors have a device characteristic which is likely to cause a phenomenon (Vth shift) where the threshold voltage of the amorphous silicon thin film transistor changes. The amount of a change in threshold voltage in the Vth shift differs from one thin film transistor to another for the change is originated from the drive histories, the times of usage and the like of the thin film transistors.

In the embodiment, therefore, first, the threshold voltage of the emission driving transistor Tr13, which sets the emission luminance of the organic EL device (emission device) OLED, at a threshold voltage detecting operation executing point, i.e., the initial threshold voltage, or a threshold voltage changed by the Vth shift is individually detected and stored as threshold detection data in the frame memory 147 in the threshold voltage detecting operation, and then at the time of writing display data in the display pixel PIX, the threshold voltage unique to each transistor Tr13 is considered and the emission drive current to be supplied to the organic EL device OLED via the transistor Tr13 in the emission operation mode and a voltage component such that the emission drive current to be supplied to the organic EL device OLED via the transistor Tr13 in the emission operation mode is set to a current value corresponding to the luminance gradation of the written display data is held between the gate and source terminals of each transistor Tr13.

In the embodiment, the voltage Vgs (Vccw=0, source potential=−Vd) to be held between the gate and source terminals of the emission driving transistor Tr13 of each display pixel PIX (pixel drive circuit DC) is set to satisfy the following equation 14 based on the gradation designating voltage Vpix generated by the data driver 140 and applied via the data line Ld, making it possible to compensate for the current value of the emission drive current flowing to the organic EL device OLED from the pixel drive circuit DC in the emission operation mode.

$$Vgs=0-(-Vd)=Vd0+\gamma Vth13 \tag{14}$$

where the constant γ is defined by the following equation 15.

$$\gamma=(1+(Cgs11+Cgd13)/Cs) \tag{15}$$

Vd0 in the equation 14 is that voltage component in the voltage Vgs to be applied between the gate and source of the emission driving transistor Tr13 based on the gradation designating voltage Vpix output in the write operation mode which changes according to the designated gradation (digital bit), and γVth13 is a voltage component which depends on the threshold voltage. In the equation 14, Vd0 is equivalent to the first voltage component according to the present invention, and γVth13 is equivalent to the second voltage component according to the present invention.

As shown in the equivalent circuit of the pixel drive circuit DC in FIG. 24 to be described later, Cgs11 in the equation 15 is a parasitic capacitor between the node N11 (i.e., the source terminal of the transistor Tr11 and the gate terminal of the transistor Tr13) and the node N13 (i.e., the gate terminals of the transistors Tr11 and Tr12), and Cgd13 is a parasitic capacitor between the nodes N11 and N14 (i.e., between the gate and drain terminals of the transistor Tr13). In FIG. 24, Cpara is a wiring parasitic capacitor of the data line Ld, and Cpix is a pixel parasitic capacitor of the organic EL device OLED. The relationship between the gradation designating voltage Vpix given in the equation 13 and the gate-source voltage Vgs of the transistor Tr13 given in the equation 14 will be described in detail later.

Even when the Vth shift of the threshold voltage Vth13 of the transistor Tr13 occurs due to the emission history (drive history) or the like (in other words, regardless of a change in threshold voltage Vth13 caused by the Vth shift), the voltage component which allows the organic EL device OLED to emit light at an adequate luminance gradation according to display data is quickly written in the write operation period Twrt. That is, according to the embodiment, the current value of the emission drive current to be supplied to the organic EL device OLED in the emission operation mode, not the threshold voltage of the emission driving transistor Tr13 in the write operation mode, is compensated.

At this time, the low-potential supply voltage Vcc (=Vccw) is applied to the supply voltage line Lv, and further the gradation designating voltage Vpix lower than the supply voltage Vcc is applied to the node N12, so that the potential to be applied to the anode terminal of the organic EL device OLED (node N12) becomes equal to or lower than the potential at the cathode terminal (reference voltage Vss=GND). Therefore, the reverse bias voltage is applied to the organic EL device OLED, so that the current does not flow to the organic EL device OLED, disabling an emission operation.

(Hold Operation Period)

Next, in the hold operation period Thld after the termination of the above-described write operation, as shown in FIG. 16, the select signal Ssel having the non-selection level (low level) is applied to the select line Ls which has undergone the write operation, the transistors Tr11 and Tr12 are turned off to cut off the electric connection of the source terminal of the transistor Tr13 (node N12) to the data line Ld, so that the voltage component (Vgs=Vd0+γVth13) for compensating for the current value of the emission drive current to be supplied to the organic EL device OLED in the emission operation mode is kept held between the gate and source terminals of the transistor Tr13 (across the capacitor Cs) as shown in FIG. 18. In synchronism with this timing, the operation of outputting the gradation designating voltage Vpix corresponding to the display pixels PIX in the row undergone the write operation (i.e., operation of outputting the gradation effective voltage Vreal in the gradation voltage generating unit 143 and operation of outputting the compensation voltage Vpth in the compensation voltage DAC 145) in the data driver 140 is stopped.

In the drive method for the display apparatus according to the embodiment, as illustrated in the description of a specific example of the drive method to be described later, in the hold operation period Thld after the termination of the above-described write operation performed on display pixels PIX in a specific row (e.g., i-th row; i being a positive integer to be $1 \leqq i \leqq n$), the select signal Ssel having the selection level (high level) is sequentially applied to the individual select lines Ls in a next row to the row (e.g., (i+1)-th row) and subsequent rows from the select driver 120 at different timings, so that the display pixels PIX in the next and subsequent rows, like the i-th row of display pixels PIX, are set in the selected state and the write operation similar to the above-described one is sequentially executed row by row.

Accordingly, in the hold operation period Thld of the i-th row of display pixels PIX, the hold operation continues until the voltage component (gradation designating voltage Vpix) according to display data is sequentially written in all the other rows of display pixels PIX in the same group to which the same supply voltage Vcc shown in FIG. 9 is applied.

(Emission Operation Period)

Next, in the emission operation period Tem after the termination of the write operation period Twrt, as shown in FIGS. 16 and 19, with the select signal Ssel with the non-selection level (low level) being applied to every select line Ls, the supply voltage Vcc (=Vcce>Vccw) with a higher potential (positive potential) than the reference voltage Vss or the emission level is applied to the supply voltage line Lv commonly connected to the individual rows of display pixels PIX.

Because the high-potential supply voltage Vcc (=Vcce) to be applied to the supply voltage line Lv is set in such a way that, as in the case shown in FIGS. 7 and 8, its potential difference Vcce-Vss becomes greater than the sum of the saturation voltage (pinch-off voltage Vpo) of the transistor Tr13 and the drive voltage (Volded) of the organic EL device OLED, the transistor Tr13 operates in the saturation area as in the cases shown in FIGS. 7A, 7B, 8A and 8B. As a positive voltage according to the voltage component (Vgs=Vd0+γVth13) written between the gate and source terminals of the transistor Tr13 by the write operation is applied to the anode side (node N12) of the organic EL device OLED and the reference voltage Vss (e.g., ground potential GND) is applied to the cathode terminal TMc, the organic EL device OLED is set in a forward bias state. As shown in FIG. 19, therefore, the drive current Iem (drain-source current Ids of the transistor Tr13) having a current value set to provide a luminance gradation according to display data (gradation designating voltage Vpix) flows to the organic EL device OLED from the supply voltage line Lv via the transistor Tr13, enabling emission at a predetermined luminance gradation.

The emission operation is continuously executed for the next one process cycle period Tcyc until the timing at which application of the supply voltage Vcc (=Vccw) having the write operation level (negative voltage) by the power supply driver 130 starts.

In the sequential drive method for the display apparatus, the hold operation is provided between the write operation and the emission operation, for example, in a case where drive control to cause all the display pixels PIX in each group to perform an emission operation at a time after writing to every row of display pixels PIX in the group is terminated as described later. In this case, the length of the hold operation period Thld differs from one row to another. When such drive control is not carried out, the hold operation may not be executed.

According to the display apparatus and display pixel of the embodiment, as the voltage component (Vgs=Vccw−Vpix=Vd0+γVth13) corresponding to the sum of a voltage equivalent to the threshold voltage Vth13 multiplied by the constant β and a voltage equivalent to the gradation effective voltage Vreal according to display data is held between the gate and source terminals of the transistor Tr13 in the write operation period of the display data, it is possible to adopt the drive method of the voltage gradation designating type of permitting the drive current Iem having a current value substantially according to the display data (gradation effective voltage Vreal) to flow to the organic EL device (emission device) OLED to enable emission at a predetermined luminance gradation.

It is therefore possible to quickly write the gradation designating signal (gradation designating voltage) in each display pixel according to the luminance gradation at the time of causing the emission device to emit light (particularly, low-gradation operation mode) even in the low-gradation operation mode as compared with the current gradation designating type which causes insufficient writing of display data, and achieve adequate emission according to the display data at every luminance gradation.

The foregoing description of the above-described embodiment has been given of the configuration of the display apparatus and the drive method therefor to apply the detection voltage Vpv to be applied to the pixel drive circuit DC of the display pixel PIX (source terminal of the transistor Tr13) to the data line Ld from the compensation voltage DAC 145 via the voltage adding unit 148 and the voltage applying side switch SW2 in the voltage application period Tpv in the threshold voltage detecting operation that is executed before the in the display drive operation. However, the present invention is not limited to this case, but may have, for example, an exclusive power source for applying the detection voltage Vpv to the data line Ld as described below.

Figure 20:
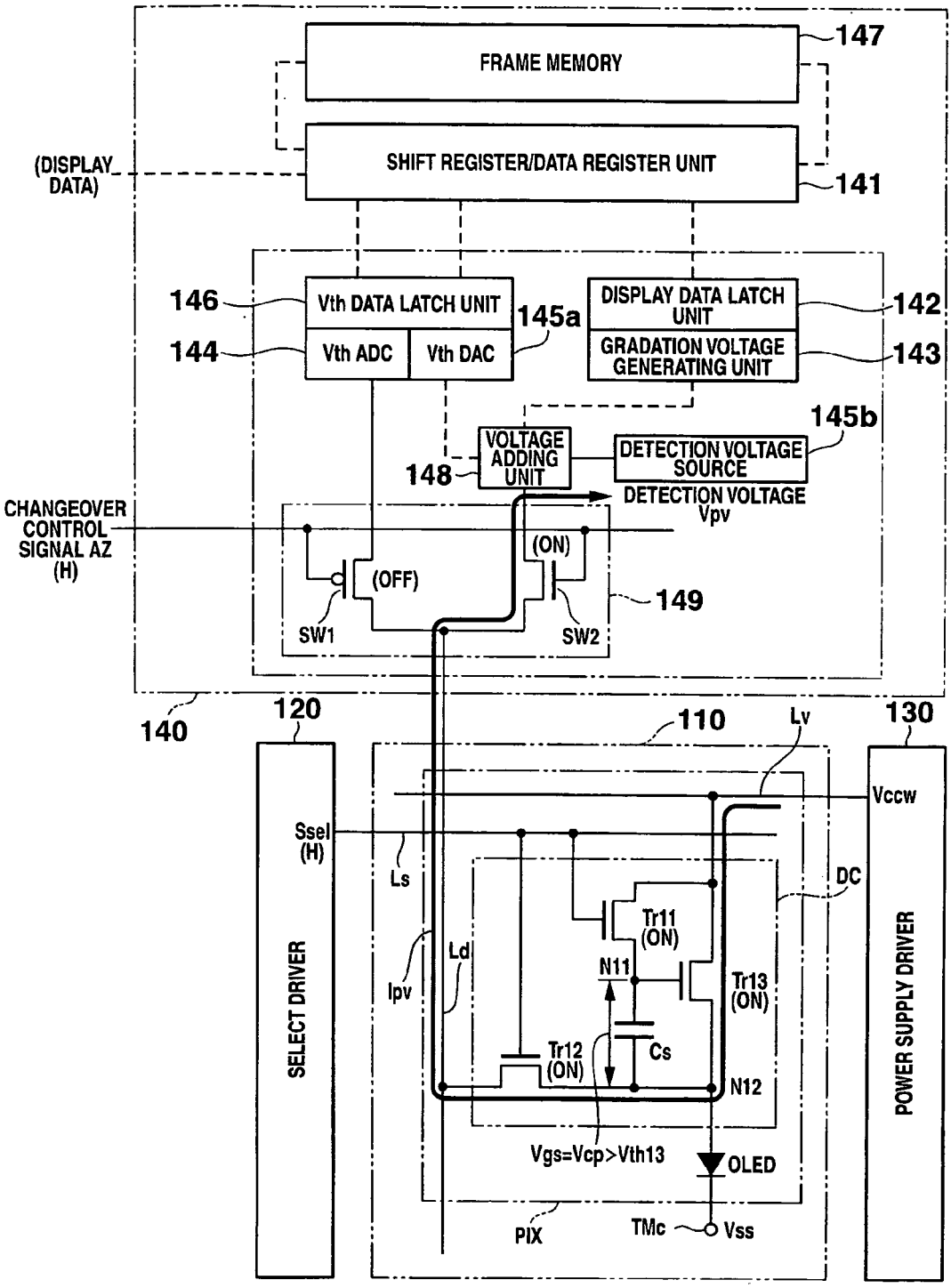
FIG. 20 is an essential configurational diagram showing another configuration example of the display drive apparatus according to the embodiment.

FIG. 20 is an essential configurational diagram showing another configuration example of the display drive apparatus according to the embodiment. The description of structures similar to those of the embodiment will be omitted.

The display apparatus according to the configurational example, as shown in FIG. 20, is configured to have a detection voltage source (detection voltage applying circuit) 145*b* which outputs the detection voltage Vpv as separate from a compensation voltage DAC 145*a* in addition to the structure of the data driver 140 (see FIG. 10), and have the detection voltage source 145*b* (detection voltage Vpv) connected as the input sources for voltage components to the voltage adding unit 148 in addition to the compensation voltage DAC 145*a* (compensation voltage Vpth) and the gradation voltage generating unit 143 (gradation effective voltage Vreal, non-emission display voltage Vzero).

With the structure, the detection voltage Vpv from the detection voltage source 145*b* can be applied to the data line Ld via the voltage adding unit 148 by only the control of stopping or setting the outputs from the compensation voltage DAC 145*a* and the gradation voltage generating unit 143 in a blocked state in the voltage application period Tpv, thus suppressing an increase in the processing load for the operation of outputting the detection voltage Vpv in the compensation voltage DAC 145*a* and complication of the circuit structure thereof.

(Display Drive Operation: Non-Emission Display Operation)

Next, the drive method in a case of performing a non-emission display (black display) operation in which the emission device in the display apparatus and the display pixel having the foregoing structures is disabled to emit light will be described referring to the accompanying drawings.

Figure 21:
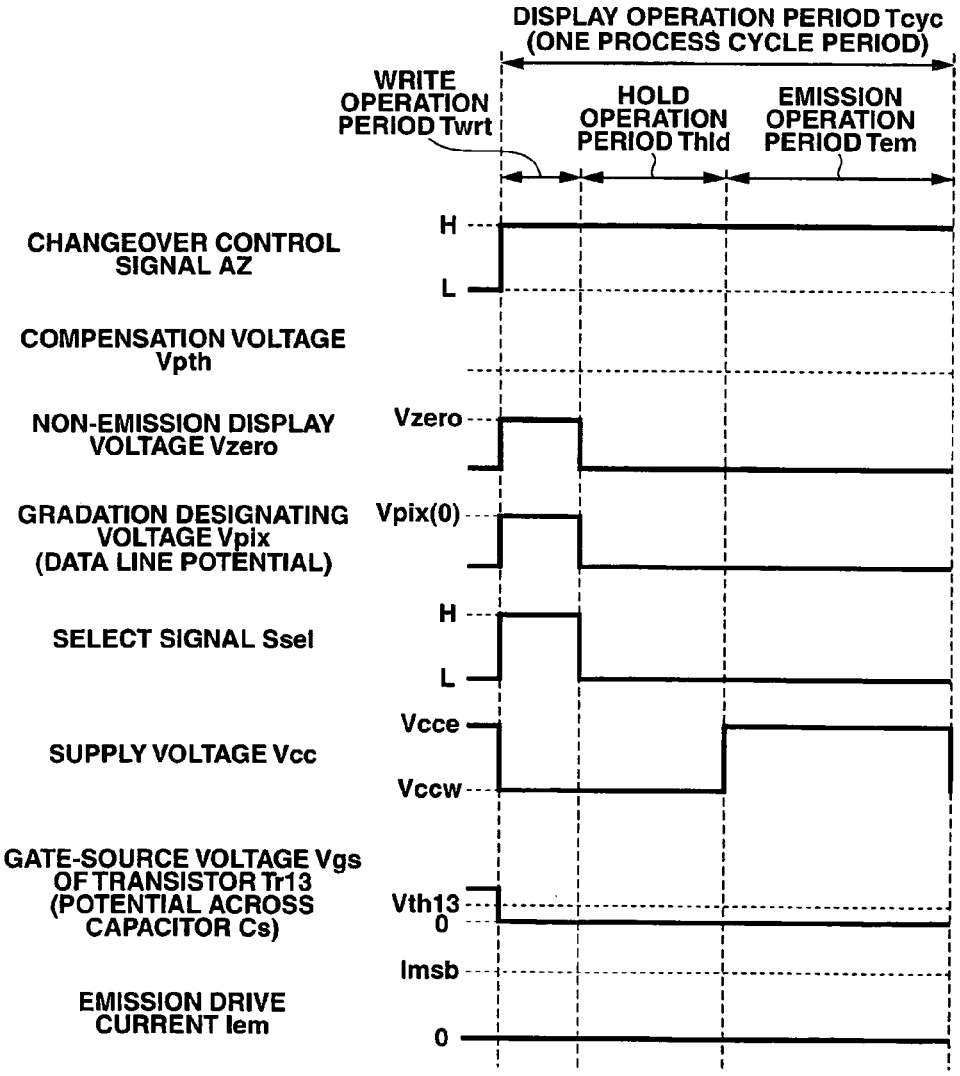
FIG. 21 is a timing chart showing one example of the drive method for the display apparatus according to the embodiment in a case of performing a non-emission display operation.

FIG. 21 is a timing chart showing one example of the drive method for the display apparatus according to the embodiment in the case of performing the non-emission display operation.

Figure 22:
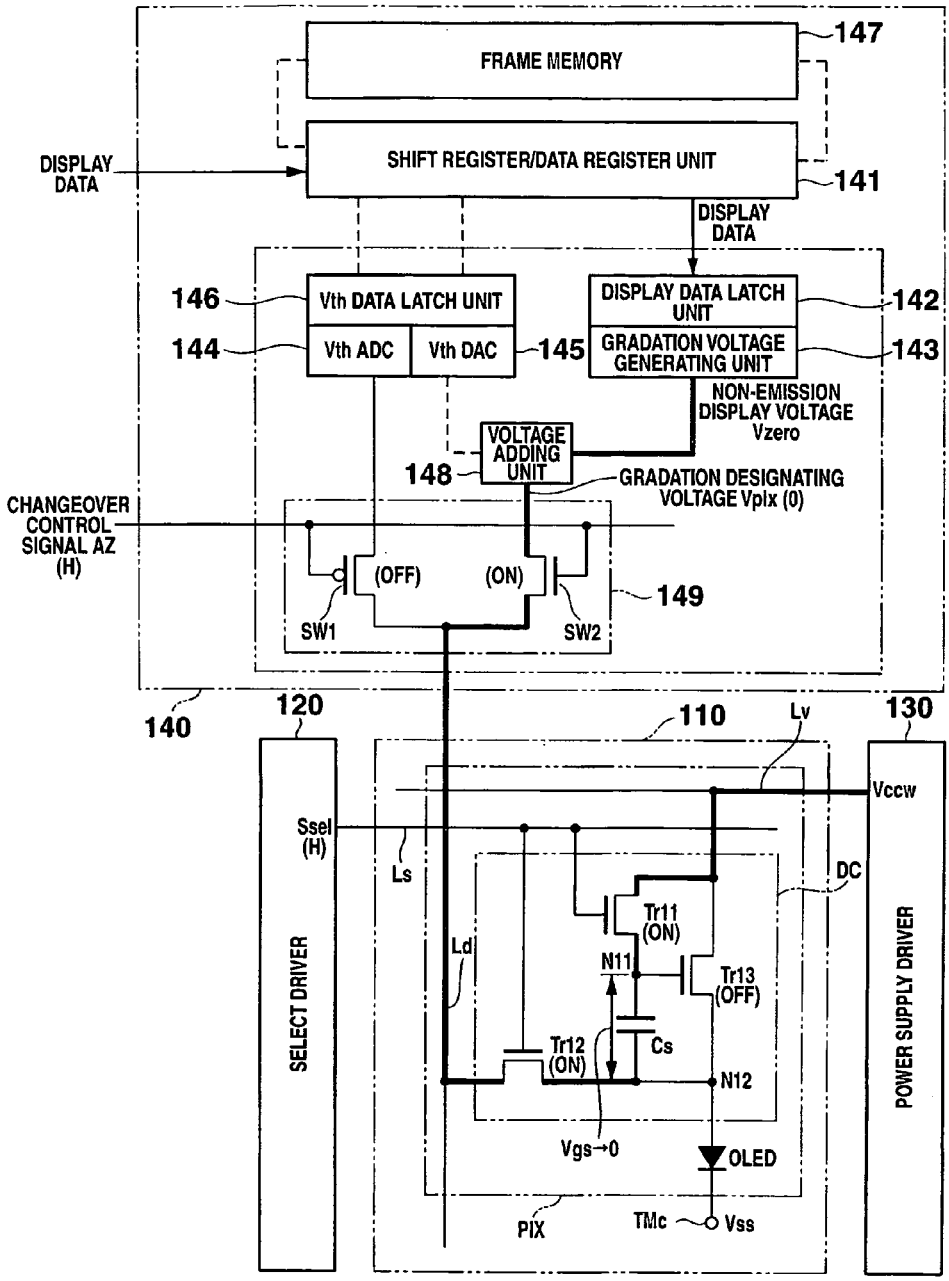
FIG. 22 is a conceptual diagram showing the write operation in the drive method (non-emission display operation) according to the embodiment.

FIG. 22 is a conceptual diagram showing the write operation in the drive method (non-emission display operation) according to the embodiment.

Figure 23:
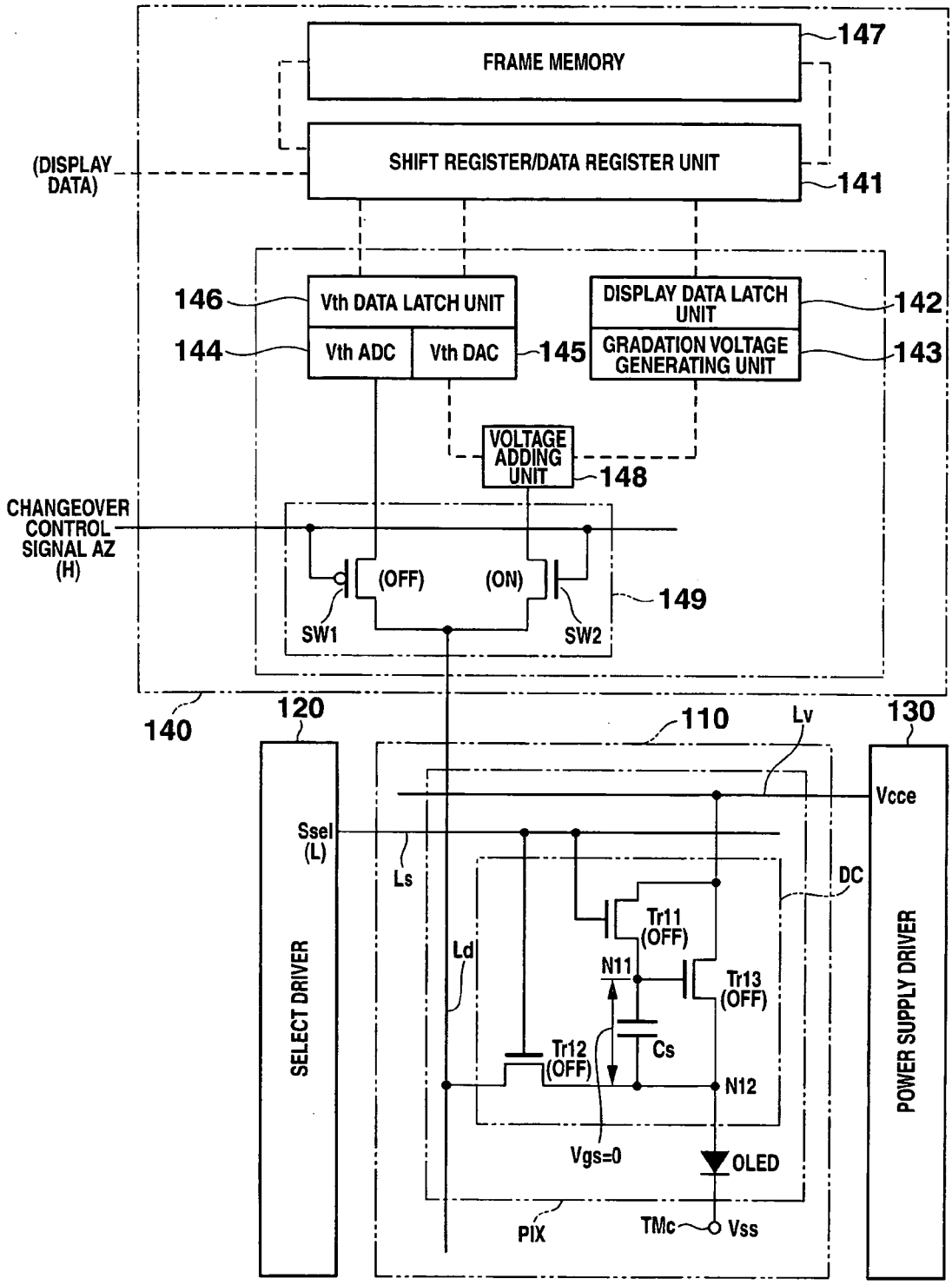
FIG. 23 is a conceptual diagram showing a non-emission operation in the drive method (non-emission display operation) according to the embodiment.

FIG. 23 is a conceptual diagram showing a non-emission operation in the drive method (non-emission display operation) according to the embodiment.

The description of drive control similar to that of the gradation display operation will be simplified or omitted.

In the display drive operation (non-emission display operation) of the display apparatus according to the embodiment, as shown in FIG. 21, after the above-described threshold voltage detecting operation (predetermined threshold voltage detection period Tdec), the display drive operation (display operation period Tcyc) is carried out to apply the non-emission display voltage Vzero having a constant voltage value, which enables discharge of a voltage component charged or remaining between the gate and source terminals of the emission driving transistor Tr13 (in the capacitor Cs) provided in the and display pixel PIX to thereby hold a voltage component sufficiently lower than the threshold voltage Vth13 unique to the transistor Tr13 (more desirably, 0 V; equal potentials at the node N11 and the node N12) between the gate and source terminals of the transistor Tr13, to the data line Ld as a gradation designating voltage Vpix(0) to completely turn off the transistor Tr13, thereby blocking the supply of the current to the organic EL device OLED to set the non-emission operation state.

That is, when the current gradation designating type drive method is adopted to realize such a voltage state, it is necessary to perform a write operation of supplying the gradation current with a minute voltage value corresponding to black display, thus requiring a relatively long time to sufficiently discharge charges stored in the capacitor Cs to set the gate-source voltage Vgs to the desired amount of charges (voltage value). Particularly, the closer to the highest luminance gradation voltage the voltage component charged in the capacitor Cs (potential across both ends thereof) becomes, the larger the amount of charges stored in the capacitor Cs in the write operation period Twrt of the previous display operation period (one process cycle period) Tcyc, so that a longer time is needed to discharge the charges to provide the desired voltage value.

In the display apparatus according to the embodiment, therefore, as shown in FIG. 10, the gradation voltage generating unit 143 is additionally provided with a function of generating and supplying the gradation effective voltage Vreal for emission of the organic EL device OLED at a predetermined luminance gradation according to display data, and a function of generating and supplying the non-emission display voltage Vzero for the darkest display (black display) without enabling emission of the organic EL device OLED, so that the non-emission display voltage Vzero is directly applied as the gradation designating voltage Vpix(0) to the data line Ld at the lowest luminance gradation (black display state).

Although the description of the embodiment has been given of the case where the gradation voltage generating unit 143 generates and outputs the non-emission display voltage Vzero as shown in FIG. 22, the present invention is not limited to this case and an exclusive power source for outputting the non-emission display voltage Vzero may be provided as separate from the gradation voltage generating unit 143.

The drive method for the display apparatus having such a configuration is set in such a way that as shown in FIG. 21, a write operation period Twrt of applying the gradation designating voltage Vpix(0) comprised of the non-emission display voltage Vzero to the display pixel PIX to discharge nearly all the charges held (remaining) between the gate and source terminals of the emission driving transistor Tr13 (across the capacitor Cs) provided in the pixel drive circuit DC to set the gate-source voltage Vgs of the transistor Tr13 to 0 V, a hold operation period Thld of holding the gate-source voltage Vgs of the transistor Tr13 set to 0 V, and an emission operation period Tem of disabling emission (permitting non-emission) of the organic EL device OLED are included in a predetermined display operation period (one process cycle period) Tcyc in the in the display drive operation after termination of the threshold voltage detecting operation (Tcyc≧Twrt+Thld+Tem).

That is, as in the in the drive control operation executed at the time of performing the gradation display operation, in the write operation period Twrt, the gradation designating voltage (non-emission operation display voltage) Vpix(0) equal in potential to the low-potential supply voltage Vcc (=Vccw), for example, is directly applied between the gate and source terminals of the emission driving transistor Tr13 provided in the display pixel PIX (pixel drive circuit DC), specifically, to the source terminal of the transistor Tr13 (node N12), via the data line input/output switching unit 149 and the data line Ld to set the gate-source voltage Vgs (potential across the capacitor Cs) to 0 V.

In this manner, almost all the charges stored in the capacitor Cs are discharged to set the gate-source voltage Vgs of the transistor Tr13 to a voltage value (0 V) sufficiently lower than the threshold voltage Vth13 unique to the transistor Tr13. Even when the supply voltage Vcc changes to a higher potential (Vcce) from a lower potential (Vccw), causing the gate potential of the transistor Tr13 (potential at the node N11) to slightly rise at the time of transition from the write operation period Twrt (including the hold operation period Thld) to the emission operation period Tem, therefore, the transistor Tr13 is not turned on (keeps the OFF state) as shown in FIG. 23, disabling supply of the drive current Iem to the organic EL device OLED, so that no emission takes places (non-emission state).

Accordingly, it is possible to surely achieve the non-emission state (non-emission display operation) of the organic EL device OLED while shortening the time needed for the operation of writing non-emission display data, as compared with the scheme of supplying a gradation current having a current value corresponding to non-emission display data via the data line Ld to discharge nearly all the charges stored in the capacitor Cs connected between the gate and source terminals of the transistor Tr13.

This makes it possible to achieve high-luminance and clear emission with the desired number of gradations (e.g., 256 gradations) according to display data (luminance gradation data) by setting and controlling the display drive operation of effecting non-emission display in addition to the display drive operation of effecting the above-described ordinary gradation display.

Although the foregoing description of the embodiment has been given of the case where an n-channel amorphous silicon thin film transistor is adopted as each of the transistors Tr11 to Tr13 provided in the pixel drive circuit DC shown in FIG. 10 in the display pixel PIX according to the embodiment, a polysilicon thin film transistor may be used as well, or a p-channel amorphous silicon thin film transistor may be adopted as every one of the transistors Tr11 to Tr13. In the case of using p-channel transistors for all the transistors Tr11 to Tr13, the ON level and OFF level or high and low of each signal are so set as to be inverted.

<Examination of Drive Method for Display Apparatus>

Next, the drive method for the display apparatus and display drive apparatus (data driver) are specifically verified.

The foregoing embodiment illustrated above employs the voltage designating type gradation control method of applying the gradation designating voltage Vpix (=−(Vreal+βVth13)), generated by correcting the gradation effective voltage Vreal according to display data, to the pixel drive circuit DC which lets the drive current Iem having a current value according to display data flow to the emission device (organic EL device OLED) via the data line Ld based on the previously detected threshold voltage Vth13 unique to the emission driving transistor Tr13, so that the voltage component Vgs (=Vd0+γVth13) for letting the drive current Iem having the current value according to the display data flow is held between the gate and source terminals of the transistor Tr13.

In reviewing a display panel which is demanded of having a smaller panel size and higher definition image quality as in a case where the display panel is mounted on, for example, a cellular phone, a digital camera, a portable music player or the like, there may be a case where as the size of each display pixel (pixel forming area) is set smaller, the capacitor (storage capacitance) Cs cannot be set sufficiently larger than the parasitic capacitor of the display pixel. When the voltage component written and held in each display pixel (write voltage) changes at the stage of its transition from the write operation state to the emission operation state, therefore, the gate-source voltage Vgs of the emission driving transistor Tr13 changes according to the parasitic capacitor. As a result, the current value of the drive current Iem supplied to the organic EL device OLED changes, which may disable emission of each display pixel at an adequate luminance gradation according to display data, leading to deterioration of the display image quality.

Specifically, in the display pixel PIX with the pixel drive circuit DC having the circuit structure as illustrated in the foregoing description of the embodiment (see FIG. 10), the select signal Ssel to be applied to the select line Ls is changed over to the low level from the high level at the time of transition from the write operation state to the emission operation state, or the supply voltage Vcc to be applied to the supply voltage line Lv is controlled to be changed over to the high level from the low level, there may be a case where the voltage component held between the gate and source terminals of the transistor Tr13 (in the capacitor Cs) changes.

In the embodiment, therefore, a change in the threshold voltage Vth of the emission driving transistor Tr13 is not directly compensated for, but the gradation designating voltage Vpix (=Vreal+βVth13) is applied to the data line Ld in the write operation mode to set the gate-source voltage Vgs of the transistor Tr13 (i.e., voltage component to be held in the capacitor Cs) to become Vgs=Vd0+γVth13 as shown in the equation 14, thereby compensating for the current value of the drive current Iem to be supplied to the emission device (organic EL device OLED) in the emission operation mode.

Next, a description will be given of a specific method of deriving the gate-source voltage Vgs (=Vd) of the transistor Tr13 which defines the drive current Iem flowing in the emission device (organic EL device OLED) in the emission operation mode.

Figure 24A:
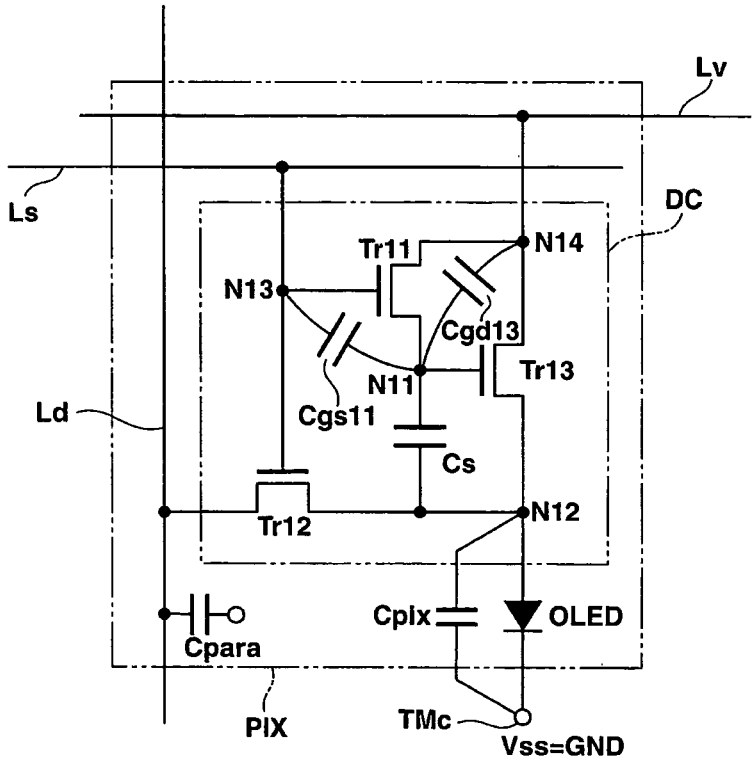
FIGS. 24A and 24B are equivalent circuit diagrams showing a capacitor component parasitic to a pixel drive circuit according to the embodiment.
Figure 24B:
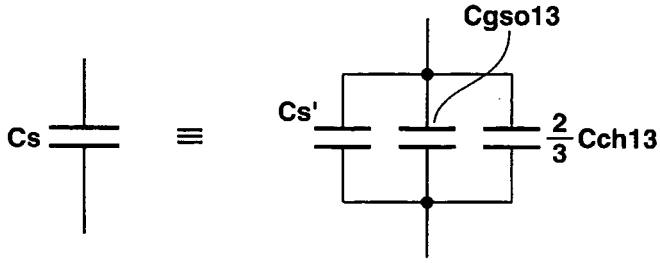

FIGS. 24A and 24B are equivalent circuit diagrams showing a capacitor component parasitic to the pixel drive circuit according to the embodiment.

FIGS. 25A, 25B, 25C and 25D are equivalent circuit diagrams showing a capacitor component parasitic to the pixel drive circuit according to the embodiment and changes in a voltage relationship of a display pixel in the write operation mode and the emission operation mode.

Figure 26:
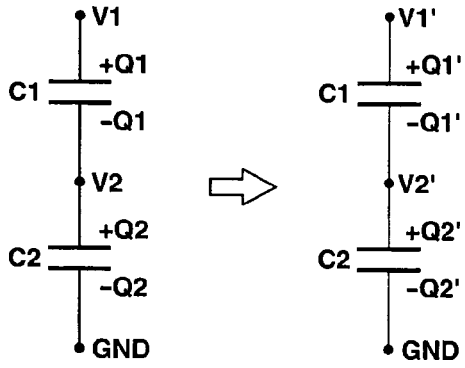
FIG. 26 is a simple model circuit for explaining the law of invariant charges, which is used in verifying the drive method for the display apparatus according to the embodiment.

FIG. 26 is a simple model circuit for explaining the conservation law of charges, which is used in verifying the drive method for the display apparatus according to the embodiment.

Figure 27A:
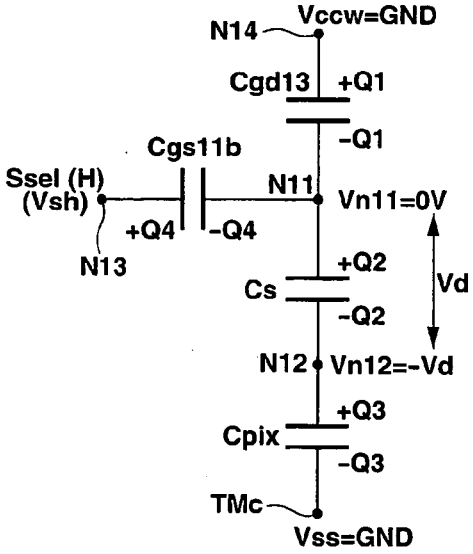
FIGS. 27A and 27B are model circuits for explaining the state of holding charges in a display pixel which is used in verifying the drive method for the display apparatus according to the embodiment.
Figure 27B:
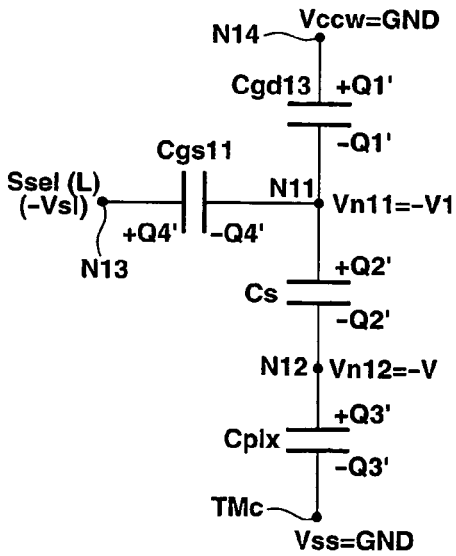

FIGS. 27A and 27B are model circuits for explaining the state of holding charges in a display pixel which is used in verifying the drive method for the display apparatus according to the embodiment.

For easier understanding, the supply voltage Vcc (=Vccw) in the write operation is taken as the ground potential hereinafter.

Figure 25A:
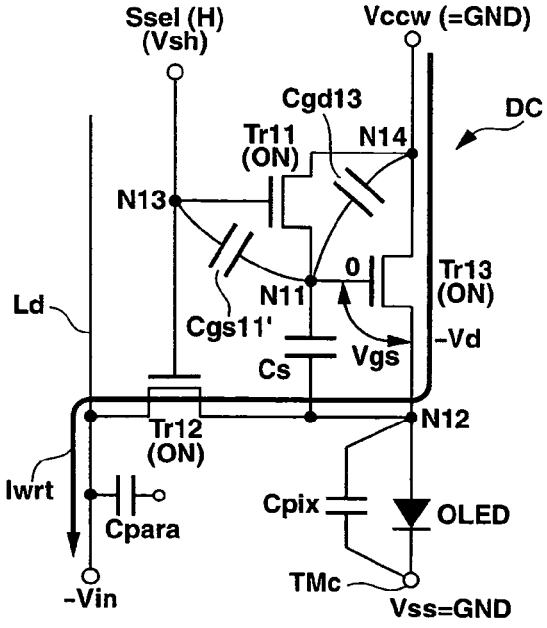
FIGS. 25A, 25B, 25C and 25D are equivalent circuit diagrams showing a capacitor component parasitic to the pixel drive circuit according to the embodiment and changes in a voltage relationship of a display pixel in a write operation mode and an emission operation mode.

In the display pixel PIX (pixel drive circuit DC) shown in FIG. 10, as shown in FIG. 25A, the gradation designating voltage Vpix having a negative polarity to be a lower potential than the supply voltage Vccw (=GND) is applied from the data driver 140 (voltage adding unit 148) in the write operation with the select signal Ssel (=Vsh) having the selection level (high level) being applied to the select line Ls and the low-potential supply voltage Vcc (=Vccw=GND) being applied.

Accordingly, the transistors Tr11, Tr12 are turned on, so that the supply voltage Vccw (=GND) is applied to the gate terminal (node N11) of the transistor Tr13 via the transistor Tr11 and the gradation designating voltage Vpix with a negative polarity is applied to the source terminal (node N12) of the transistor Tr13 via the transistor Tr12. This produces a potential difference between the gate and source terminals of the transistor Tr13, thus turning the transistor Tr13 on, so that the write current Iwrt flows to the data line Ld via the transistors Tr13, Tr12 from the supply voltage line Lv to which the low-potential supply voltage Vccw is applied. The voltage component Vgs (write voltage; Vd) according to the current value of the write current Iwrt is held in the capacitor Cs formed between the gate and source terminals of the transistor Tr13.

In FIG. 25A, Cgs11' is an effective parasitic capacitor produced between the gate and source terminals of the transistor Tr11 when the gate voltage (select signal Ssel) of the transistor Tr11 changes from the high level to the low level, and Cgd13 is a parasitic capacitor produced between the gate and drain terminals of the emission driving transistor Tr13 when the drain-source voltage of the emission driving transistor Tr3 is in the saturation area.

Figure 25B:
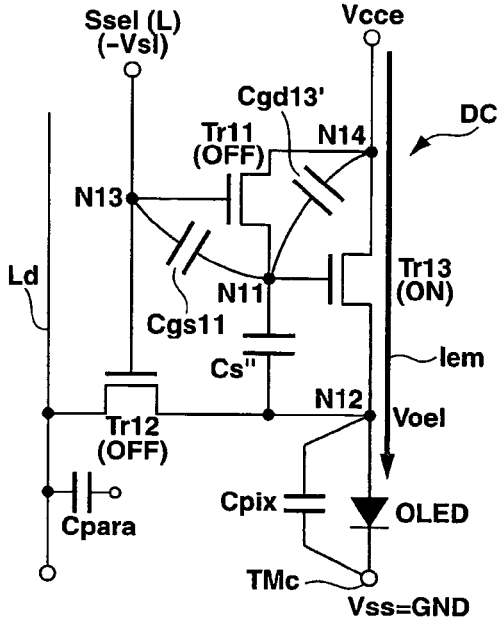

Next, in the emission operation mode, as shown in FIG. 25B, the select signal Ssel having a non-selection level (low level) voltage (−Vsl<0) is applied to the select line Ls, the high-potential supply voltage Vcc (=Vcce; e.g., 12 to 15 V) is applied, and application of the gradation designating voltage Vpix to the data line Ld from the data driver 140 (voltage adding unit 148) is blocked.

This turns off the transistors Tr11, Tr12, blocking application of the supply voltage Vcc to the gate terminal (node N11) of the transistor Tr13 and application of the gradation designating voltage Vpix to the source terminal (node N12) of the transistor Tr13. As a result, because the potential difference (0−(−Vd)) produced between the gate and source terminals of the transistor Tr13 in the write operation mode is held in the capacitor Cs as a voltage component, the potential difference between the gate and source terminals of the transistor Tr13 is maintained, and the drive current Iem according to the gate-source voltage Vgs (=0−(−Vd)) of the transistor Tr13 flows to the organic EL device OLED via the transistor Tr13 from the supply voltage line Lv to which the high-potential supply voltage Vcce is applied, so that the organic EL device OLED emit light at a luminance gradation according to the current value of the drive current Iem.

In FIG. 25B, Voel is the potential (Vn12−Vss) at the node N12 in the emission operation mode or the emission voltage of the organic EL device OLED, and Cgs11 is a parasitic capacitor produced between the gate and source terminals of the transistor Tr11 when the gate voltage (select signal Ssel) of the transistor Tr11 has a low level (−Vsl). The relationship between Cgs11' and Cgs11 is expressed by the following equation 16. Cch11 is a channel capacitor of the transistor Tr11.

$$Cgs11'=Cgs11+1/2\times Cch11\times Vsh/Vshl \tag{16}$$

The voltage Vshl is a potential difference between the high level (Vsh) and low level (−Vsl) of the select signal Ssel (voltage range; Vshl=Vsh−(−Vsl)).

The voltage component Vgs (=0−(−Vd)) held between the gate and source terminals of the emission driving transistor Tr13 by application of the gradation designating voltage Vpix from the data driver 140 in the write operation of the drive method changes as given by the following equation 17 as the voltage levels of the select signal Ssel and the supply voltage Vcc are changed according to the transition to the emission operation state. In the present invention, a tendency of variation when the voltage Vgs written and held in the pixel drive circuit DC changes according to such a change in (transition of) the state of the voltage to be applied to the display pixel PIX (pixel drive circuit DC) is expressed as "voltage characteristic unique to the pixel drive circuit".

$$Vgs = \frac{1}{1+c_{gs}+c_{gd}}\{Vd-(c_{gs}+c_{gd})Voel\} + \frac{1}{1+c_{gs}+c_{gd}}(c_{gd}Vcce - c_{gs'}Vshl) \tag{17}$$

In the equation 17, cgd, cgs and cgs' are the parasitic capacitors Cgd, Cgs and Cgs' normalized with the capacitance of the capacitor Cs, respectively, and are cgd=Cgd13/Cs, cgs=Cgs11/Cs, and cgs'=Cgs11'/Cs.

The equation 17 can be derived by applying the "conservation law of charges" before and after changing the control voltage (select signal Ssel, supply voltage Vcc) to be applied to the each display pixel PIX (pixel drive circuit DC).

When the voltage to be applied to one end side of a series circuit of capacitor components is changed from V1 to V1', as shown in FIG. 26, the quantities of charges Q1, Q2 and Q1', Q2' of the individual capacitor components before and after the status change can be expressed by the following equation 18.

$$\left.\begin{cases} Q1 = C1(V1-V2) \\ Q2 = C2V2 \end{cases}\right\} \quad \left.\begin{cases} Q1' = C1(V1'-V2') \\ Q2' = C2V2' \end{cases}\right\} \tag{18}$$

Calculating −Q1+Q2=−Q1'+Q2' using the "conservation law of charges" in the equation 18, the relationship between the potentials V2 and V2' can be expressed by the following equation 19.

$$V2' = V2 - \frac{C1}{C1 + C2}(V1 - V1') \tag{19}$$

A potential Vn11 at the gate terminal (node N11) of the transistor Tr13 when the select signal Ssel is changed applying the same potential deriving scheme as used in the equations 18 and 19 to the display pixel PIX (pixel drive circuit DC and organic EL device OLED) according to the embodiment can be represented by equivalent circuits as shown in FIGS. 24A and 24B, FIGS. 25A to 25D, FIG. 26, and FIGS. 27A and 27B, and can thus be expressed by equations 20 to 23 given below.

FIG. 27A shows a charge holding state when the select signal Ssel having the selection level (high level) and the low-potential supply voltage Vcc (=Vccw) are applied to the select line Ls, and FIG. 27B shows a charge holding state when the select signal Ssel having the non-selection level (low level) and the low-potential supply voltage Vcc (=Vccw) are applied to the select line Ls.

$$\left.\begin{cases} Q1 = 0 \\ Q2 = CsVd \\ Q3 = -CpixVd \\ Q4 = Cgs11bVsh \end{cases}\right. \quad \left.\begin{cases} Q1' = Cgd13V1 \\ Q2' = Cs(V - V1) \\ Q3' = -CpixV \\ Q4' = Cgs11Vsh(V1 - Vsl) \end{cases}\right\} \tag{20}$$

$$\left.\begin{aligned} -Q1 + Q2 - Q4 &= -Q1' + Q2' - Q4' \\ -Q2 + Q3 &= -Q2' + Q3' \end{aligned}\right\} \tag{21}$$

$$\left.\begin{aligned} Vn11 &= -V1 = -\frac{Cgs11'Cpix + Cgs11'Cs}{Ds}Vshl \\ Vn12 &= -V = -Vd - \frac{Cgs11'Cs}{D}Vshl \end{aligned}\right\} \tag{22}$$

$$D = Cgd13Cpix + Cgd13Cs + Cgs11Cpix + Cgs11Cs + CsCpix \tag{23}$$

The equation 20 represents the quantities of charges held in the capacitor components Cgs11, Cgs11*b*, Cgd13, Cpix, and the capacitor Cs, the equation 22 represents the potentials vn11, vn12 at the nodes N11, N12 computed applying the "conservation law of charges" given by the equation 21 to the equation 20.

The capacitor component Cgs11 between the nodes N11 and N13 in FIG. 27B is a gate-source parasitic capacitor Cgso11 excluding an intra-channel capacitor of the transistor Tr11, and the capacitor component Cgs11*b* between the nodes N11 and N13 in FIG. 27A is defined as the sum (Cgs11*b*=Cch11/2+Cgs11) of ½ of the channel capacitor Cch11 of the transistor Tr11 and Cgs11 (=Cgso11). Cgs11' in the equation 22 is defined by the equation, and D is defined by the equation 23.

This potential deriving scheme is applied to individual processes from the write operation to the emission operation according to the embodiment as follows.

Figure 28:
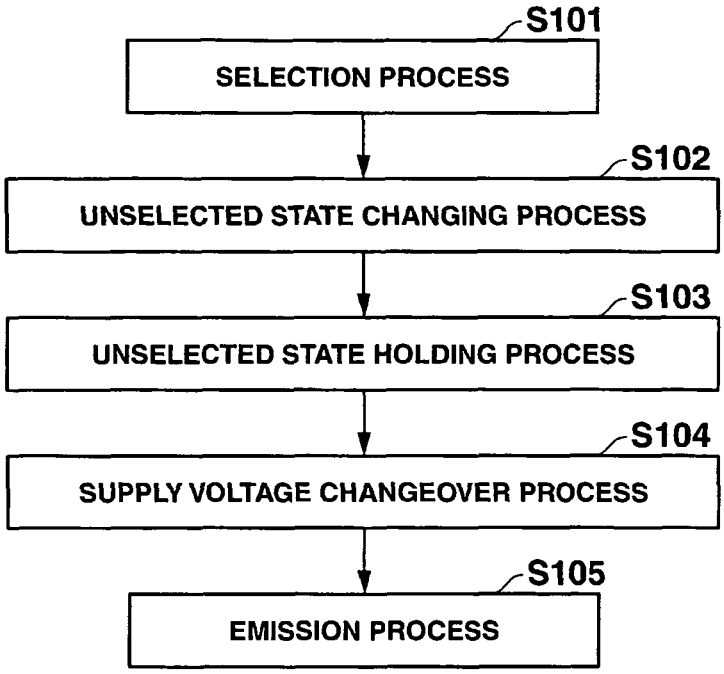
FIG. 28 is a schematic flowchart illustrating individual processes from the write operation to the emission operation of a display pixel according to the embodiment.

FIG. 28 is a schematic flowchart illustrating individual processes from the write operation to the emission operation of a display pixel according to the embodiment.

The drive method for the display apparatus according to the embodiment will be analyzed in detail. As shown in FIG. 28, the drive method can be separated into a selection process (S101) where the select signal Ssel having the selection level is applied to the select line Ls (node N13 shown in FIG. 25)) to write a voltage component according to display data, an unselected state changing process (S102) where the select signal Ssel having the non-selection level is applied to the select line Ls to change the transistor in an unselected state, an unselected state holding process (S103) where the written voltage component is held, a supply voltage changeover process (S104) where the supply voltage Vcc is changed from the write operation level (low potential) to the emission operation level (high potential), and an emission process (S105) where the emission device is allowed to emit light at a luminance gradation according to display data. It is to be noted that depending on the drive method in use, the unselected state holding process (S103) may be omitted and the unselected state changing process (S102) and the supply voltage changeover process (S104) may be synchronized.

(Selection Process S101→Unselected State Changing Process S102)

Figure 29A:
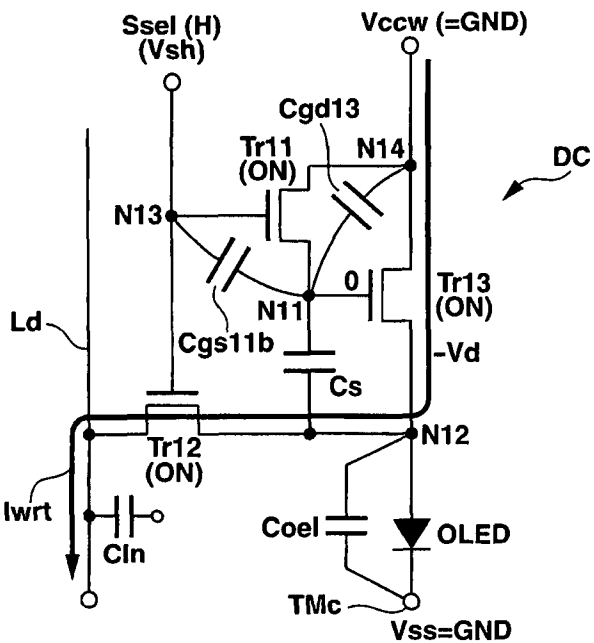
FIGS. 29A and 29B are equivalent circuit diagrams showing changes in a voltage relationship in a selection process and an unselected state switching process of a display pixel according to the embodiment.
Figure 29B:
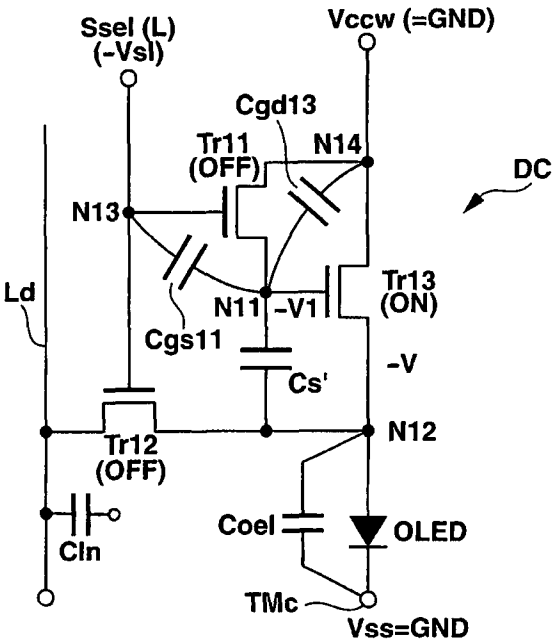

FIGS. 29A and 29B are equivalent circuit diagrams showing changes in a voltage relationship in a selection process and an unselected state switching process of a display pixel according to the embodiment.

FIG. 29A is a diagram showing the state where the transistor Tr11 and the transistor Tr12 are selected to let the write current Iwrt flow between the drain and source terminals of the transistor Tr13, and FIG. 29B is a diagram showing the state where the transistor Tr11 and the transistor Tr12 are changed into a non-selected state. In FIG. 29A, the potentials at the node N11 and node N12 are respectively defined as Vccw (ground potential) and −Vd, while in FIG. 29B, the potentials at the node N11 and node N12 are respectively defined as −V1 and −V.

In the unselected state changing process S102 following the transition to an unselected state from the selected state of a display pixel PIX (selection process S101), the select signal Ssel changes from a high level (Vsh) or a positive potential to a low level (−Vsl) or a negative potential as apparent from the equivalent circuits shown in FIGS. 29A and 29B. Therefore, the gate-source voltage Vgs' of the emission driving transistor Tr13 (potential difference between the node N11 and the node N12) is expressed in the form of voltage shift of −ΔVgs from the gate-source voltage Vd of the transistor Tr13 (potential difference between the node N11 and the node N12 or the write voltage) in the write operation mode as given by an equation 24 which is derived from the equations 22, 23 and 16. The voltage shift ΔVgs is expressed by Cgs11'CpixVshl/D.

$$\begin{aligned} Vgs' &= Vn11 - Vn12 = -V1 - (-V) = V - V1 \\ &= Vd - \frac{Cg11'Cpix}{D}Vshl = Vd - \Delta Vgs \end{aligned} \tag{24}$$

That is, ΔVgs is a change in the potential difference between the node N11 and the node N12 when the selected state is changed to the unselected state.

In the unselected state changing process S102, the capacitor component Cs' between the nodes N11 and N12 shown in FIG. 29B is a capacitor component formed other than the gate-source capacitor of the transistor Tr13, Cs shown in the equations 22 and 23 is the sum of the capacitor component Cs', a gate-source parasitic capacitor Cgso13 of the transistor Tr13 excluding the intra-channel capacitor thereof, and ⅔ of an intra-channel gate-source capacitor of the transistor in the saturation area or ⅔ of a channel capacitor Cch13 of the transistor Tr13 (Cs=Cs'+Cgso13+2 Cch13/3), as shown in FIG. 24B, and Cgd13 is just a gate-drain parasitic capacitor Cgdo13 of the transistor Tr13 excluding the intra-channel capacitor thereof for the intra-channel gate-drain capacitor in the saturation area can be regarded as zero. Cgs11' shown in the equation 24 is defined as the sum (Cgs11'=Cgso11+Cch11Vsh/2Vshl) of the gate-source parasitic capacitor Cgso11 of the transistor Tr11 excluding the intra-channel capacitor thereof and the product of ½ of the intra-channel gate-source capacitor of the transistor Tr11 when Vds=0 or the intra-channel capacitor Cch11 of the transistor Tr11 and the voltage ratio of the select signal Ssel (Vsh/Vshl), as given by the equation 16.

(Unselected State Holding Process S103)

Figure 30A:
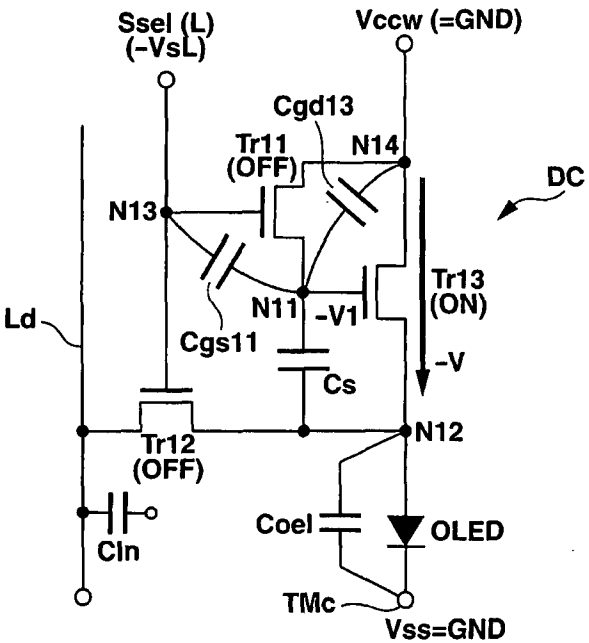
FIGS. 30A and 30B are equivalent circuit diagrams showing changes in a voltage relationship in an unselected state holding process of a display pixel according to the embodiment.
Figure 30B:
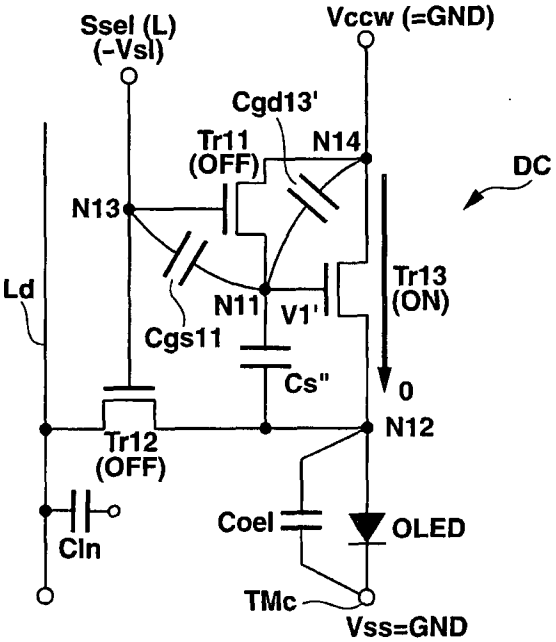

FIGS. 30A and 30B are equivalent circuit diagrams showing changes in a voltage relationship in the unselected state holding process of a display pixel according to the embodiment.

FIG. 30A is a diagram showing the state where the drain-source current Ids flows into the transistor Tr13 while the potential at the node N12 has a negative potential (−V) lower than that of the supply voltage Vcc (Vccw), and FIG. 30B is a diagram showing the state where the potential at the node N12 rises as a result of the continuing flow of the drain-source current Ids to the transistor Tr13.

In the process of holding the unselected state of the display pixel PIX, as apparent from the equivalent circuits shown in FIGS. 30A and 30B, the transistor Tr13 keeps ON based on the voltage Vgs' held between the gate and source terminals of the transistor Tr13 (capacitor component Cs') at the time of transition from the selection process (write operation) to the unselecting process, and the drain-source current Ids flows to the source from the drain of the transistor Tr13, so that the voltage relationship changes in the direction canceling the difference between the drain voltage of the transistor Tr13 (potential at the node N14) and the source voltage thereof (potential Vn12 at the node N12). The time needed for the change is +several microseconds. From the equations 22 and 23, therefore, the gate potential V1' of the transistor Tr13 is influenced by the change in source potential and changes as given by the following equation 25.

$$V1' = \frac{Cs}{Cgs11 + Cgd13' + Cs''}V - \frac{Cgs11 + Cgd13 + Cs}{Cgs11 + Cgd13' + Cs''}V1 \tag{25}$$

Figure 25C:
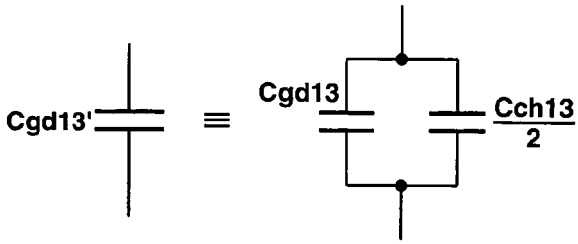
Figure 25D:
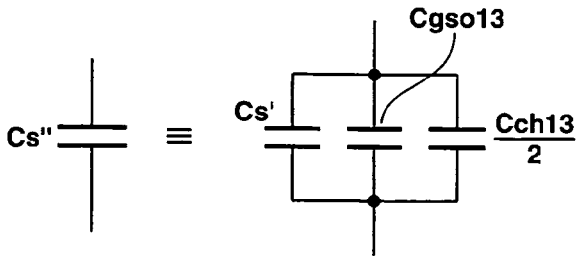

Cs" in the equation 25 is the intra-channel gate-source capacitor of the transistor Tr13 when Vds=0 or a half of Cch13 added to the Cs' and Cgso13 as shown in FIG. 25D, and is expressed by the following equation 26a.

$$Cs''=Cs'+Cgso13+Cch13/2=Cs-Cch13/6 \tag{26a}$$

Cgd13' is the intra-channel gate-drain capacitor of the transistor Tr13 when Vds=0 or a half of Cch13 added to the Cgd13 as shown in FIG. 25C, and is expressed by the following equation 26b.

$$Cgd13'=Cgd13+Cch13/2 \tag{26b}$$

−V1 and V1' in the equation 25 are the potentials at the node N11 in FIG. 30A and FIG. 30B, respectively, not V1 and V1' shown in FIG. 26.

In the unselected state holding process, the capacitor component Cgd13' between the nodes N11 and N14 shown in FIG. 30 is the sum of the gate-drain capacitor component Cgdo13 of the transistor Tr13, excluding the intra-channel capacitor thereof and ½ of the channel capacitor Cch13 of the transistor Tr13

$$(Cgd13'=Cgdo13+Cch13/2=Cgd13+Cch13/2).$$

(Unselected State Holding Process S103→Supply Voltage Changeover Process S104→Emission Process S105)

Figures 31A, 31B, 31C:
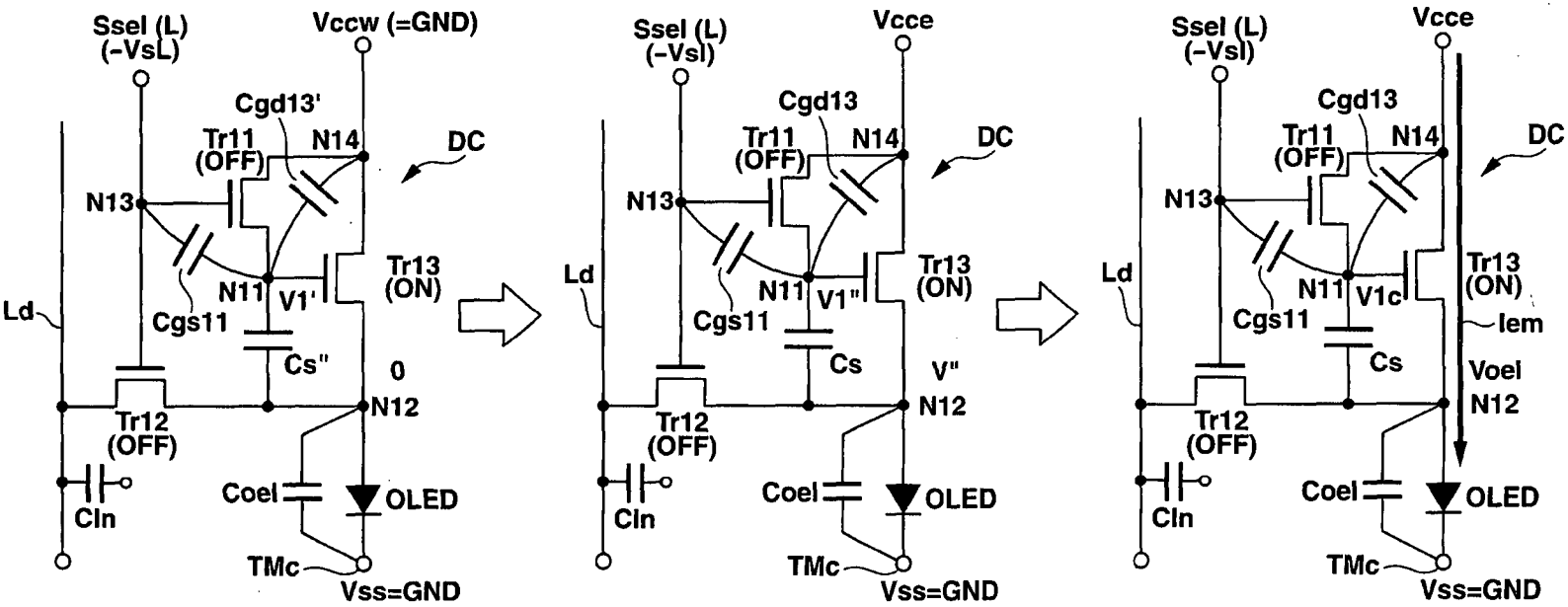
FIGS. 31A, 31B and 31C are equivalent circuit diagrams showing changes in a voltage relationship in the unselected state holding process, a supply voltage switching process and an emission process of a display pixel according to the embodiment.

FIGS. 31A, 31B and 31C are equivalent circuit diagrams showing changes in a voltage relationship in the unselected state holding process, the supply voltage switching process and the emission process of a display pixel according to the embodiment.

FIG. 31A is a diagram showing the state where there is no drain-source potential difference in the transistor Tr13 so that the drain-source current Ids does not flow, FIG. 31B is a diagram showing the state where the supply voltage Vcc is changed from the low potential (Vccw) to the high potential (Vcce), and FIG. 31C is a diagram showing the state where the drive current Iem is flowing to the organic EL device OLED via the transistor Tr13.

In the transition from the process of holding the unselected state of the display pixel PIX to the supply voltage changeover process, as indicated by equivalent circuits shown in FIGS. 31A to 31C, after the drain-source voltage of the transistor Tr13 has changed to converge (be approximated) to 0 V in the unselected state holding process, the supply voltage Vcc is changed from the low potential (Vccw) to the high potential (Vcce) in the supply voltage changeover process, so that the potentials Vn11, Vn12 at the gate terminal (node N11) and source terminal (node N12) of the transistor Tr13 rise and can be expressed by the following equation 27.

$$\left.\begin{aligned} Vn11 &= V1' \\ &= \left\{1 + \frac{Cch13(3Cs + 2Cpix)}{6D}\right\}V' + \\ &\quad \frac{Cgd13Cpix + Cgd13Cs}{D}Vcce \\ Vn12 &= V'' \\ &= \frac{Cgd13Cs}{D}Vcce + \\ &\quad \frac{Cch13}{6D}(Cgs11 + Cgd13 + 3Cs)V1' \end{aligned}\right\} \tag{27}$$

V1" and V" in the equation 27 are the potential Vn11 at the node N11 and the potential Vn12 at the node N12 in FIG. 31B, respectively.

Next, in the emission process of the display pixel PIX, as indicated by equivalent circuits shown in FIGS. 31B and 31C, the potential Vn11 produced at the gate terminal (node N11) of the transistor Tr13 through the supply voltage changeover process converges and can be expressed by the following equation 28 using the voltages V1" and V" given in the equation 27.

$$Vn11 = V1c = V1'' + \frac{Cs}{Cgd13 + Cgs11 + Cs}(Vpix - V'') \tag{28}$$

V1*c* in the equation 28 is the potential Vn11 at the node N11 in FIG. 31C.

In view of the above, in the voltage change from the write operation to the emission operation as shown in FIG. 25, changing the sign of every voltage component given in the equations 24 to 28 to the voltage sign in the unselected state changing process, the gate-source voltage Vgs of the emission driving transistor Tr13 can be expressed by the following equation 29 from the equation 24. V and ΔVgs in the equation 29 are described again as given in the following equation 30 respectively from the equation 22 and the equation 24.

$$\begin{aligned} Vgs &= Vn11 - Vn12 = V1c - Voel \\ &= (Vd - \Delta Vgs) + \frac{Cgs11 + Cgd13}{Cs + Cgs11 + Cgd13} \left( \frac{Cgd13}{Cgs11 + Cgd13} Vcce - Voel - V \right) \end{aligned} \tag{29}$$

$$\left. \begin{aligned} V &= Vd + \frac{Cgs11'Cs}{D} Vshl \\ \Delta Vgs &= \frac{Cgs11'Cpix}{D} Vshl \end{aligned} \right\} \tag{30}$$

Vd in the equation 29 is the voltage that is produced between the gate and source of the transistor Tr13 in the write mode and is −Vd which is the potential at the node N12 in FIG. 29A, while ΔVgs is a change in the potential difference between the node N11 and the node N12 when the voltage relationship is changed from the one in FIG. 29A to the one in FIG. 29B.

Next, the influence of the threshold voltage Vth on the gate-source voltage Vgs of the emission driving transistor Tr13 (dependency of Vgs on Vth) will be studied based on the equation 29.

Substituting the values of ΔVgs, V and D in the equation 29 and arranging the equation yields the following equation 31, and the individual capacitor components Cgs11, Cgs11' and Cgd13 in the equation 31 are normalized with the capacitor component Cs and arranging the equation yields the following equation 32.

The capacitor components Cgs11, Cgs11', Cgd13 and Cs are the same as defined in the foregoing description of the unselected state changing process. The first term on the right-hand side of the equation 32 depends on the designated gradation based on display data and the threshold voltage Vth of the transistor Tr13, and the second term on the right-hand side of the equation 32 is a constant term to be added to the gate-source voltage Vgs of the transistor Tr13. Compensation for Vth by designating the voltage means solving the problem of hot to set the source potential −Vd in the write mode to set Vgs-Vth in the emission mode (value which determines a drive current Ioel in the emission mode) not to depend on Vth.

If Vgs=0−(−Vd)=Vd is maintained even in the emission mode, to set Vgs−Vth not to depend on Vth, Vd=Vd0+Vth if set yields Vgs−Vth=Vd0+Vth−Vth=Vd0 and the emission current can be expressed only by Vd0. Further, when Vgs in the write mode is changed in the emission mode, it is understood that to set Vgs−Vth not to depend on Vth, Vd=Vd0+ϵVth should be set.

$$Vgs = \frac{Cs}{Cs + Cgs11 + Cgd13} Vd + \frac{Cgs11 + Cgd13}{Cs + Cgs11 + Cgd13} \times \left( \frac{Cgd13}{Cgs11 + Cgd13} Vcce - Voel - \frac{Cgs11'}{Cgs11 + Cgd13} Vshl \right) \tag{31}$$

-continued $$Vgs = \frac{1}{1 + c_{gs} + c_{gd}} \{Vd - (c_{gs} + c_{gd})Voel\} + \frac{1}{1 + c_{gs} + c_{gd}} (c_{gd} Vcce - c_{gs'} Vshl) \tag{32}$$

$$\boxed{\text{First term}} \quad \frac{1}{1 + c_{gs} + c_{gd}} \{Vd - (c_{gs} + c_{gd})Voel\}$$

$$\boxed{\text{Second term}} \quad \frac{1}{1 + c_{gs} + c_{gd}} (c_{gd} Vcce - c_{gs'} Vshl)$$

cgd, cgs and cgs' in the equation 32 match with cgd, cgs and cgs' in the equation 17.

Strictly speaking, the dependency of the emission voltage Voel of the organic EL device OLED included in the first term on the right-hand side of the equation 32 is determined in such a way that the relationship given by the following equation 33 is fulfilled without contradiction. In the equation 33, f(x), g(x) and h(x) indicate functions of a variable x, the gate-source voltage Vgs of the transistor Tr13 can be expressed as a function of the emission voltage Voel, the emission drive current Iem can be expressed as a function of (Vgs-Vth13), the emission voltage Voel can be expressed as a function of the emission drive current Iem, and the emission voltage Voel of the organic EL device OLED has a characteristic to depend on the threshold voltage Vth13 via a capacitor component parasitic to the display pixel PIX (pixel drive circuit DC).

$$\left. \begin{aligned} Vgs &= f(Voel) \\ Iem &= g(Vgs - Vth) \\ Voel &= h(Iem) \end{aligned} \right\} \tag{33}$$

As described above, given that Vd0 is a data voltage for giving a voltage component (gradation voltage) based on display data to the source terminal (node N12) of the emission driving transistor Tr13 in the write operation mode, and the term which does not depend on Vth, Vth(t1) is the threshold voltage of the transistor Tr13 at time t1, Vth(t2) is the threshold voltage at time t2 sufficiently after time t1, Voel1 applied between the anode and cathode of the organic EL device OLED in the emission operation mode at time t1 and Voel2 applied between the anode and cathode of the organic EL device OLED in the emission operation mode at time t2 becomes Vth(t2)>Vth(t1), and the difference between the voltages applied to the organic EL device OLED in the emission operation mode at time t2 and time t1, ΔVoel approaches as close to 0 as possible by compensating for Vth in order to compensate for a change in threshold voltage (Vth shift) ΔVth, and it is sufficient that the write voltage Vd included in first term on the right-hand side of the equation 32 should be set as given in an equation 34 below.

$$Vd = Vd0 + (1 + c_{gs} + c_{gd})\Delta Vth \tag{34}$$

Since the threshold voltage ΔVth can be expressed by ΔVth=Vth13 taking the threshold voltage ΔVth in the equation 34 as a difference from the threshold voltage Vth13=0 V, and cgs+cgd is a designed value, defining the constant ϵ as ϵ=1+cgs+cgd, the voltage component Vd can be expressed by the following equation 35. Note that a variation in threshold voltage in the initial state of each transistor Tr13 in the display area 110 is also regarded as part of ΔVth, it may be considered as a change from Vd0.

$$Vd \approx Vd0 + (1 + c_{gs} + c_{gd})\Delta Vth = Vd0 + \varepsilon\Delta Vth \tag{35}$$

An equation 36, which represents a voltage relationship which does not depend on the threshold voltage Vth13 of the transistor Tr13, is derived from the equation 32 based on the equation 35. It is to be noted that in the equation 36, the emission voltage Voel of the organic EL device OLED when the threshold voltage Vth13=0 V is Voel=Voel0. The equations 14 and 15 are derived from this equation 35.

$$Vgs - Vth = \frac{1}{1 + c_{gs} + c_{gd}}\{Vd0 - (c_{gs} + c_{gd})Voel0\} + \frac{1}{1 + c_{gs} + c_{gd}}(c_{gd}Vcce - c_{gs'}Vshl) \tag{36}$$

In the state of black display or the 0th gradation, a condition that a voltage equal to or higher than the threshold voltage Vth13 is not applied between the gate and source terminals of the transistor Tr13 (i.e., voltage condition that the emission drive current Iem is not permitted to flow to the organic EL device OLED) can be expressed by the following equation 37. Accordingly, the non-emission display voltage Vzero output from the gradation voltage generating unit 143 of the data driver 140 can be defined (determined) in the non-emission display operation shown in FIG. 22.

$$-Vd0(0)=Vzero \geqq cgdVcce-cgs'Vshl \tag{37}$$

Next, the gradation designating voltage Vpix generated and output from the data driver 140 according to the embodiment will be reviewed.

Figure 32:
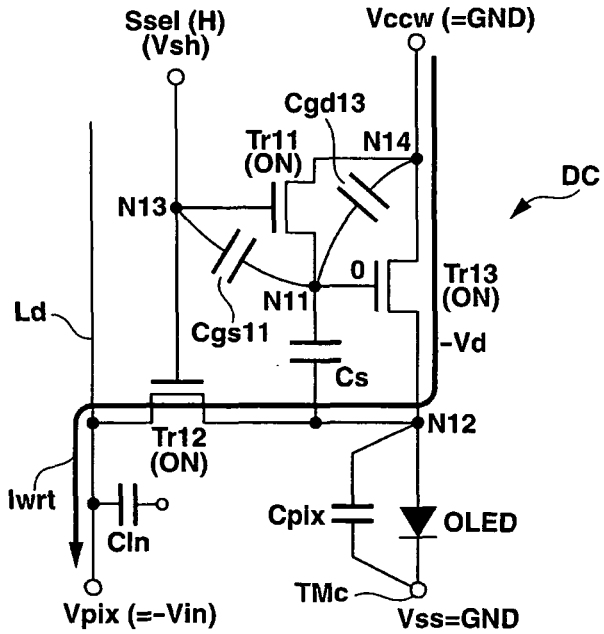
FIG. 32 is an equivalent circuit diagram showing the voltage relationship in the write operation mode of a display pixel according to the embodiment.

FIG. 32 is an equivalent circuit diagram showing the voltage relationship in the write operation mode of a display pixel according to the embodiment.

To compensate for a shift of the gate-source voltage Vgs of the emission driving transistor Tr13 with other capacitor components or the like at the time of passing through each process shown in FIG. 28, the gradation designating voltage Vpix output from the voltage adding unit 148 within the write operation period Twrt (time of application of the gradation designating voltage Vpix) is set as given in the following equation 38.

$$Vpix=-(Vd+Vds12)=-Vreal-\beta Vth13 \tag{38}$$

where Vds 12 is the drain-source voltage of the transistor Tr12.

Then, in the write operation shown in FIG. 32, the write current Iwrt flowing between the drain and source terminals of the transistors Tr13, Tr12 can be expressed by the following equations 39 and 40, respectively.

$$Iwrt = \mu_{FET}Ci(Vd - Vth13)\frac{W13}{L13}Vdes13 \approx p\mu_{FET}Ci(Vd - Vth13)^2\frac{W13}{L13} \tag{39}$$

$$Iwrt = \mu_{FET}Ci(Vsh + Vd + Vds12 - Vth12)\frac{W12}{L12}Vdse12 \tag{40}$$

Vdse12 and Vsat12 can be defined by the following equation 41 based on the equations 39 and 40.

$$\left.\begin{aligned} Vdse12 &= \frac{Vds12}{\left\{1 + \left(\frac{Vds12}{Vsat12}\right)^q\right\}^{\frac{1}{q}}} \\ Vsat12 &= p(Vsh + Vd + Vds12 - Vth12) \end{aligned}\right\} \tag{41}$$

In the equations 39 to 41, μFET is the mobility of a transistor, Ci is the transfer gate capacitance per unit area, W12 and L12 are the channel width and channel length of the transistor Tr12, respectively, Vds12 is the drain-source voltage of the transistor Tr12, Vth12 is the threshold voltage of the transistor Tr12, Vdse13 is the effective drain-source voltage of the transistor Tr13 in the write mode, and p and q are unique parameters (fitting parameters) which match with the thin film transistor. In the equation, the drain-source voltage Vdse12 of the transistor Tr12 is defined as given in the equation 41. In the equations 39 and 40, the threshold voltages of the transistors Tr12 and Tr13 are respectively denoted by Vth12 and Vth13 to be distinguished from each other. Vsat12 is the effective drain-source voltage of the transistor Tr12 in the write operation mode.

The amount of the shift of the threshold voltage of the n-channel amorphous silicon transistor is likely to increase as the ON-duration time of the transistor (time in which the gate-source voltage is positive) is longer. Therefore, while the transistor Tr13 is ON in the emission operation period Tem where the ratio thereof in one process cycle period Tcyc is high so that the threshold voltage is shifted more toward the positive voltage side with time, resulting in an increase in resistance, the transistor Tr12 is ON only in the selection period Tsel where the ratio thereof in one process cycle period Tcyc is relatively low so that the time-variant shift of the threshold voltage is smaller than that of the transistor Tr13. Therefore, a change in the threshold voltage Vth12 of the transistor Tr12 is small enough to be neglected as compared with change in the threshold voltage Vth13 of the transistor Tr13, and is treated as having no change.

Apparently, the equation 39 and the equation 40 includes the TFT characteristic fitting parameters like q and p, the transistor size parameters (W13, L13, W12, L12), the process parameters, such as the gate thickness of the transistor and the mobility of amorphous silicon, and the voltage set value (Vsh).

As the drain-source voltage Vds of the transistor Tr12 is acquired by solving an equality that Iwrt in the equation 39 is equal to Iwrt in the equation 40, the gradation designating voltage Vpix can be derived from Vpix=−Vd−Vds12.

As the acquired gradation designating voltage Vpix is output from the voltage adding unit 148 within the write operation period Twrt, −Vd is written at the source (node N12) of the transistor Tr13. Accordingly, the gate-source voltage Vgs of the transistor Tr13 in the write operation period Twrt and the drain-source voltage Vds of the transistor Tr13 become Vgs=Vds=0−(−Vd)=Vd0+εΔVth, the write current Iwrt which allows a drive current Ioled originating from compensation for the shift caused by the influence of the parasitic capacitor or the like can be let to flow in the write operation period Twrt.

Next, the operational effects of the display apparatus according to the embodiment and the drive method therefor will be described, showing specific experimental results.

Figure 33:
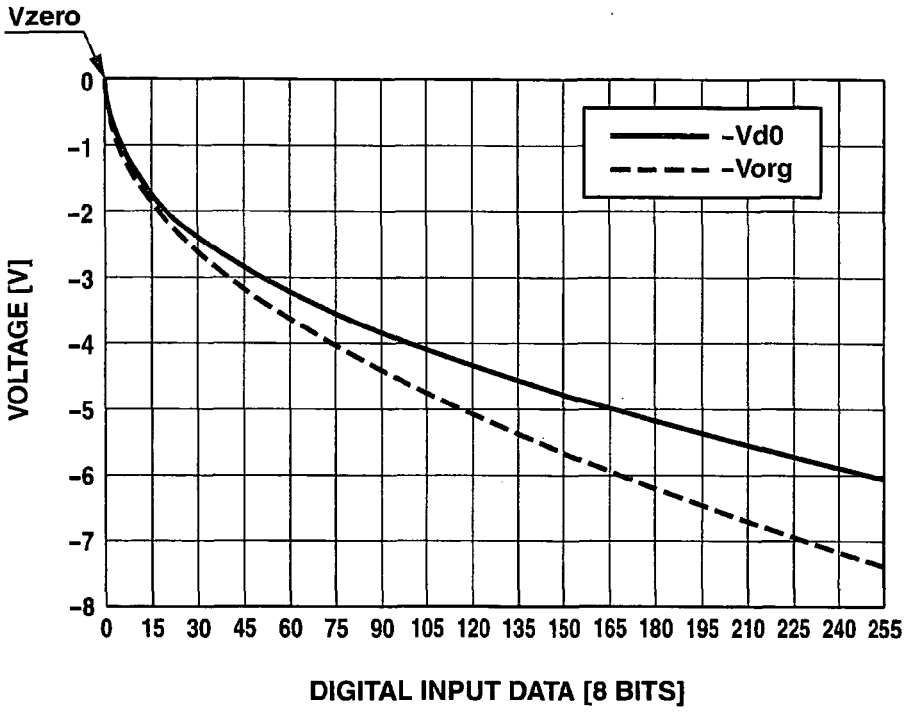
FIG. 33 is a characteristic diagram showing the relationship between a data voltage and a gradation effective voltage with respect to input data in the write operation of a display pixel according to the embodiment.

FIG. 33 is a characteristic diagram showing the relationship between a data voltage and a gradation effective voltage with respect to input data in the write operation of a display pixel according to the embodiment.

As described above, the potential (−Vd) produced at the source terminal (node N12) by the voltage component Vgs held between the gate and source terminals of the emission driving transistor Tr13 in the write operation is set (determined) (Vd=−Vd0−γVth13) from the equation 14 based on the data voltage Vd0 and the threshold voltage Vth13 multiplied by the constant γ.

The gradation designating voltage Vpix generated by the data driver 140 (voltage adding unit 148) is set (determined) (Vpix=−Vreal−βVth13) based on the gradation effective voltage and the threshold voltage Vth13 multiplied by the constant β, as given in the equation 13.

Examining the relationship between the data voltage Vd0 and the gradation effective voltage Vreal in the equations 14 and 13, which do not depend on the constants γ, β and the threshold voltage Vth13, as shown in FIG. 33, a change in data voltage Vd0 for giving a voltage component (gradation voltage) according to display data (input data) to the source terminal of the transistor Tr13 of the display pixel PIX (pixel drive circuit DC) with respect to the input data (designated gradation) is likely to have a larger voltage difference for a higher gradation range with respect to a change in gradation effective voltage Vreal generated by the display data latch unit 142 of the data driver 140 with respect to input data (designated gradation). Specifically, the data voltage Vd0 and the gradation effective voltage Vreal are both Vzero (=0V) at the 0th gradation (black display state), whereas the data voltage Vd0 and the gradation effective voltage Vreal have a voltage difference of approximately 1.3 V or greater at the 255-th gradation (highest luminance gradation). This is because the higher Vpix is, the larger the current value in the write mode becomes, resulting in an increase in the source-drain voltage of the transistor Tr12.

The verification experiment shown in FIG. 33 was conducted using the display pixels PIX given that the supply voltage Vcc (=Vccw) in the write operation mode was set to the ground potential GND (=0V), the supply voltage Vcc (=Vcce) in the emission operation mode was set to 12 V, the voltage difference (voltage range) between the high level (Vsh) and the low level (−Vsl) of the select signal Ssel was set to 27 V, the channel width W13 of the emission driving transistor Tr13 was set to 100 μm, the channel widths W11, W12 of the transistor Tr11 and the transistor Tr12 were set to 40 μm, the pixel size was set to 129 μm×129 μm, the aperture ratio of the pixel was set to 60%, and the capacitance of the capacitor (storage capacitor) Cs was set to 600 fF (=0.6 pF).

Figure 34:
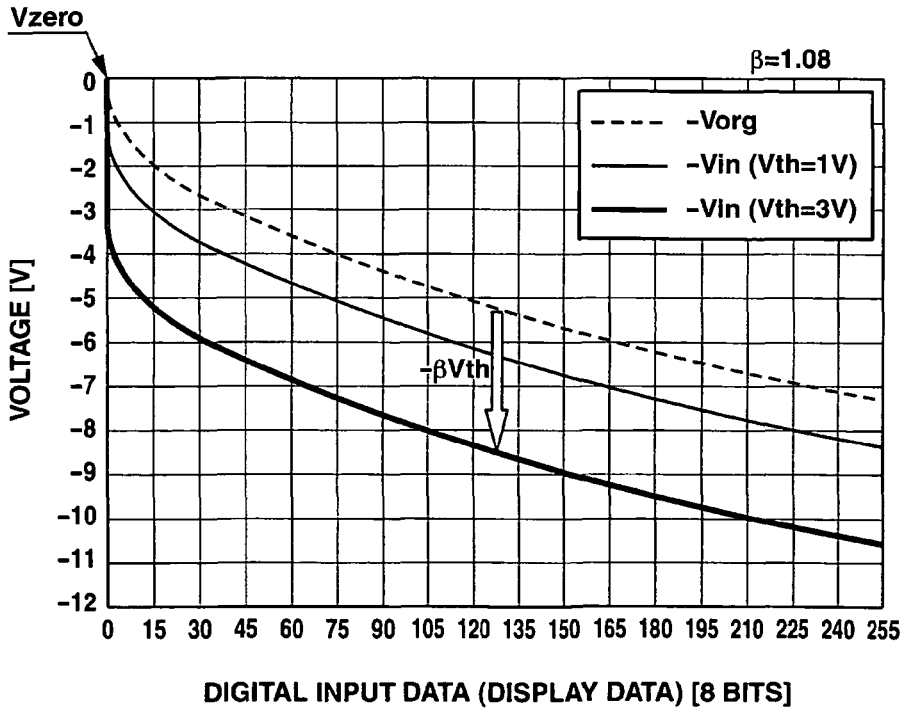
FIG. 34 is a characteristic diagram showing the relationship between a gradation designating voltage and a threshold voltage with respect to input data in the write operation of a display pixel according to the embodiment.

FIG. 34 is a characteristic diagram showing the relationship between the gradation designating voltage and the threshold voltage with respect to input data in the write operation of a display pixel according to the embodiment.

Examining the gradation designating voltage Vpix which depends on the constant β and the threshold voltage Vth13 in the equation 13 under the same experimental conditions as given in FIG. 33, a change in the gradation designating voltage Vpix generated by the voltage adding unit 148 of the data driver 140 with respect to input data (designated gradation) is likely show that the voltage value of the gradation designating voltage Vpix becomes lower by the threshold voltage Vth13 over the entire gradation range as the threshold voltage Vth13 becomes larger in the case where the constant β is set to a constant value. Specifically, with the constant β being set to β=1.08, as the threshold voltage Vth13 is changed in the pattern of 0 V→1 V→3 V, the characteristic curve at each threshold voltage Vth13 which defines the gradation designating voltage Vpix is shifted approximately in parallel in the direction of lowering the voltage. At the 0th gradation (black display state), the gradation designating voltage Vpix becomes Vzero (=0 V) regardless of the threshold voltage Vth13.

Figure 35A:
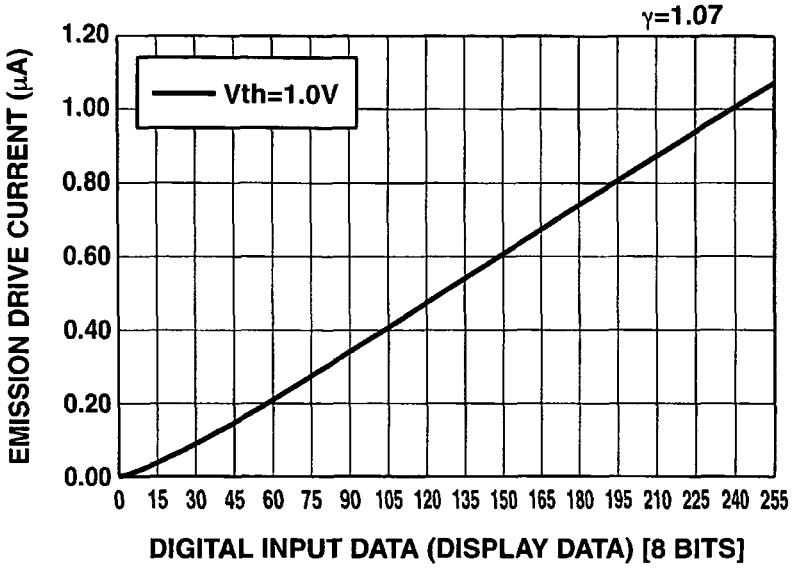
FIGS. 35A and 35B are characteristic diagrams showing the relationship between an emission drive current and a threshold voltage with respect to input data in the emission operation of a display pixel according to the embodiment.
Figure 35B:
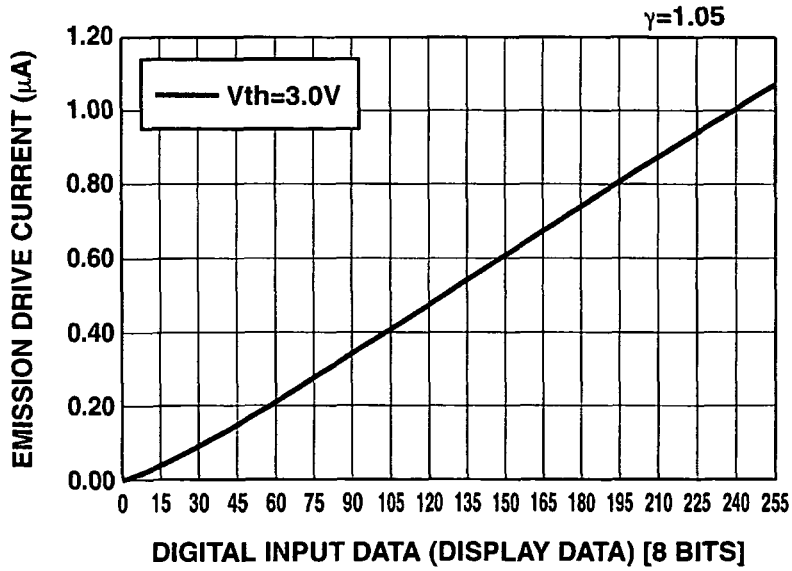

FIGS. 35A and 35B are characteristic diagrams showing the relationship between the emission drive current and the threshold voltage with respect to input data (which is the gradation value of display data and "0" as the lowest luminance gradation and "255" as the highest luminance gradation) in the emission operation of a display pixel according to the embodiment.

Next, verifying the dependency of the emission drive current Iem supplied to the organic EL device OLED in the emission operation mode on the constant γ and the threshold voltage Vth13 of the transistor Tr13 in the case where the gradation designating voltage Vpix shown in the equation 13 is applied to each display pixel PIX (pixel drive circuit DC) to write and hold the voltage component Vgs (write voltage; 0−(−Vd)=Vd0+γVth13) as shown in the equation 14 between the gate and source terminals of the emission driving transistor Tr13 under the same experimental conditions as adopted in the case in FIG. 33, it has turned out that when the constant γ is set to approximately a constant, as shown in FIG. 35, the emission drive current Iem having an approximately equal current value regardless of the threshold voltage Vth13 is supplied to the organic EL device OLED at each gradation.

Specifically, comparing the case where the constant γ is set to γ=1.07 and the threshold voltage Vth13 is set to 1.0 V as shown in FIG. 35A with the case where the constant γ is set to γ=1.05 and the threshold voltage Vth13 is set to 3.0 V as shown in FIG. 35B shows that approximately the same characteristic curves are obtained regardless of the threshold voltage Vth13 and as shown in Table 2, a change in luminance (luminance difference) over nearly the entire gradation range with respect to the theoretical value is suppressed roughly to 1.3% or below. The effect of suppressing a change in luminance (luminance difference) with respect to the theoretical value to roughly 1.3% or below by writing and holding the voltage component Vgs (write voltage; 0−(−Vd)=Vd0+γVth13) that depends on the constant γ shown in the equation 14, as described above, is expressed as "γ effect" herein for the sake of descriptive convenience.

TABLE 2

| | Designated gradation (8 bits) | | |
|---|---|---|---|
| | 63 | 127 | 255 |
| | <γ = 1.07> | | |
| Luminance change | 0.27% | 0.62% | 1.29% |
| | <γ = 1.05> | | |
| Luminance change | 0.27% | 0.61% | 1.27% |

Figure 36A:
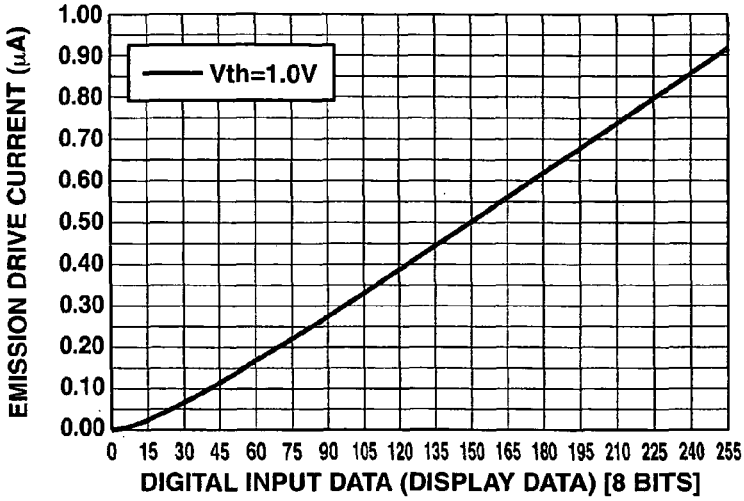
FIGS. 36A, 36B and 36C are characteristic diagrams showing the relationship between the emission drive current and a change in the threshold voltage (Vth shift) with respect to input data in the emission operation of a display pixel according to the embodiment.
Figure 36B:
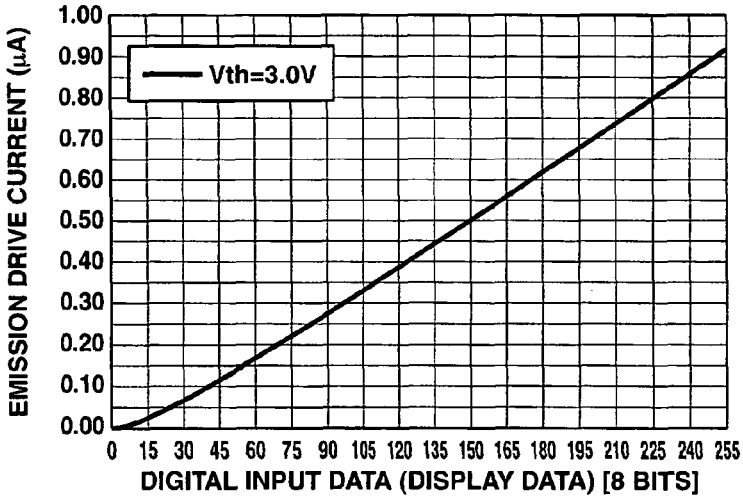
Figure 36C:
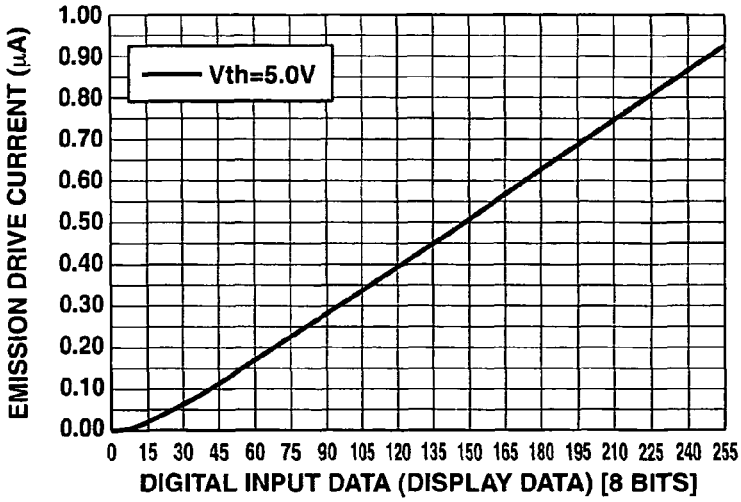

FIGS. 36A, 36B and 36C are characteristic diagrams showing the relationship between the emission drive current and a change in the threshold voltage (Vth shift) with respect to input data in the emission operation of a display pixel according to the embodiment.

Next, the dependency of the γ effect on a change in the threshold voltage Vth13 (Vth shift) will be verified. It has turned out that when the constant γ is set to a constant value, as shown in FIGS. 36A to 36C, the difference between the emission drive current Iem for the changed threshold voltage Vth13 and the emission drive current Iem for the initial threshold voltage Vth13 at each gradation becomes smaller as the width of the change in the threshold voltage Vth13 (Vth shift) becomes larger.

Specifically, with the constant γ being set to γ=1.1 comparing the characteristic curve in the case where the threshold voltage Vth13 is changed from 1.0 V to 3.0 V as shown in FIGS. 36A and 36B with the characteristic curve in the case where the threshold voltage Vth13 is changed from 1.0 V to 5.0 V as shown in FIGS. 36A and 36C, it has turned out that as the width of a change in the threshold voltage Vth13 (Vth shift) gets larger, the characteristic curves are approximated and a change in luminance (luminance difference) over nearly the entire gradation range with respect to the theoretical value is suppressed very small (about 0.3% or below) as shown in Table 3.

TABLE 3

| | | Designated gradation (8 bits) | | |
|---|---|---|---|---|
| | | 63 | 127 | 255 |
| Luminance change | Vth shift width (Vth13 = 1 V→3 V) | 0.24% | 0.59% | 1.29% |
| | Vth shift width (Vth13 = 1 V→5 V) | 0.04% | 0.12% | 0.27% |

To prove the superiority of the operational effects of the embodiment, experimental results in a case where different threshold voltages Vth13 are set while the voltage component Vgs (write voltage; 0−(−Vd)=Vd0+Vth13) which does not depend on the constant γ in the equation 14 is written and held between the gate and source terminals of the emission driving transistor Tr13 will be verified.

Figure 37A:
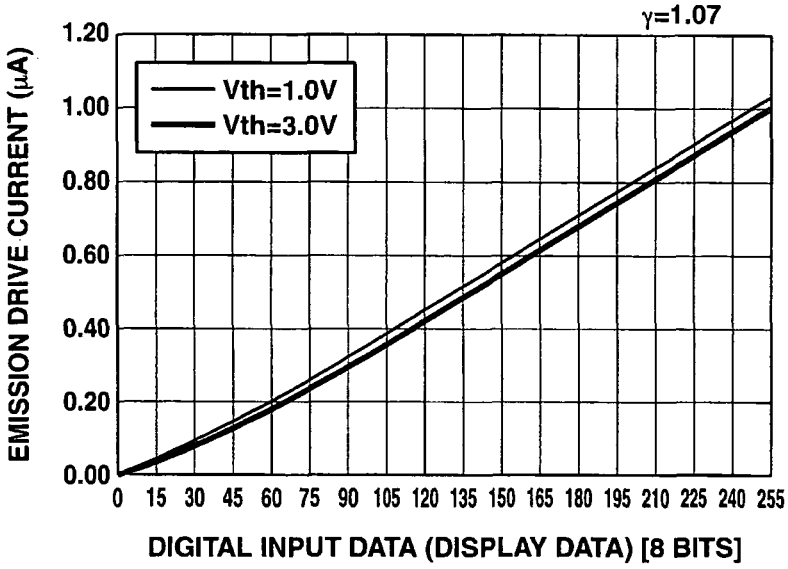
FIGS. 37A and 37B are characteristic diagrams showing the relationship (comparative example) between the emission drive current and threshold voltage with respect to input data when a γ effect according to the embodiment is not present.
Figure 37B:
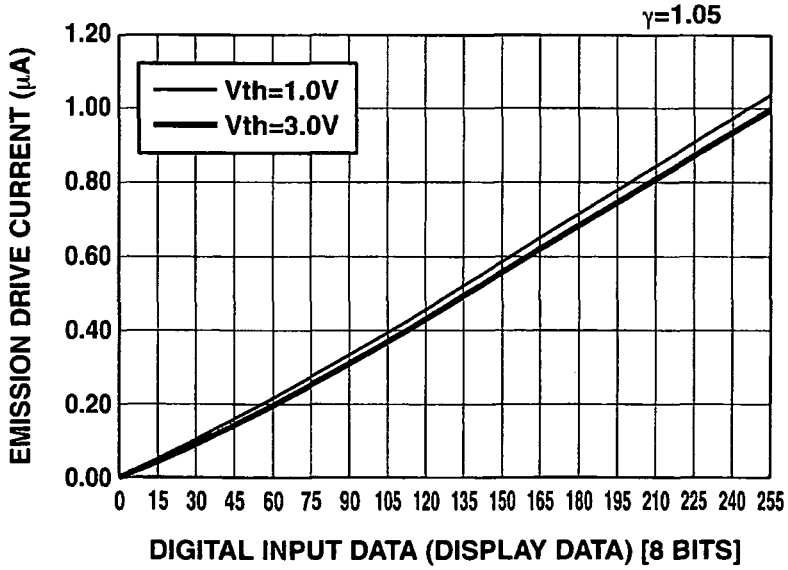

FIGS. 37A and 37B are characteristic diagrams showing the relationship (comparative example) between the emission drive current and threshold voltage with respect to input data when the γ effect according to the embodiment is not present.

Specifically, it has turned out that a characteristic curve in which the current value of the emission drive current Iem becomes smaller as the threshold voltage Vth13 of the transistor Tr13 gets higher is acquired regardless of the constant γ (=1+(Cgs11+Cgd13)/Cs=1+cgs+cgd) at each gradation in both the case where the constantly is set to γ=1.07 and the threshold voltage Vth13 is set to 1.0 V and 3.0 V as shown in FIG. 37A, and the case where the constant γ is set to γ=1.05 and the threshold voltage Vth13 is set to 1.0 V and 3.0 V as shown in FIG. 37B, and as shown in Table 4, a change in luminance (luminance difference) over nearly the entire gradation range with respect to the theoretical value shows 1.0% or greater, and reaches 2% or greater particularly at an intermediate gradation or greater (127th gradation or greater in the illustrated example of 256 gradations).

TABLE 4

| | Designated gradation (8 bits) | | |
|---|---|---|---|
| | 63 | 127 | 255 |
| | <γ = 1.07> | | |
| Luminance change | 1.93% | 2.87% | 4.13% |
| | <γ = 1.05> | | |
| Luminance change | 1.46% | 2.09% | 2.89% |

According to various verifications conducted by the present inventor, it is found that unless the constant γ is corrected, a change in luminance (luminance difference) at each gradation with respect to the theoretical value may reach about 2% or greater, in which case burning of an image is visually observed. When the voltage component Vgs (write voltage Vd=−Vd0−Vth13) which does not depend on the constant γ is written and held as in the comparative example, the display image quality is deteriorated.

According to the embodiment, by way of contrast, as the voltage component Vgs (write voltage; 0−(−Vd)=Vd0+γVth13) that depends on the constant γ shown in the equation 14 is written and held, a change in luminance (luminance difference) at each gradation with respect to the theoretical value can be significantly suppressed as shown in FIGS. 36 and 36 and Tables 2 and 3, making it possible to implement a display apparatus which prevents image burning to bring about excellent display image quality.

Next, the relationship between the gradation designating voltage Vpix and the gate-source voltage Vgs of the transistor Tr13 shown in the equations 13 and 14 will be explained specifically.

Figure 38:
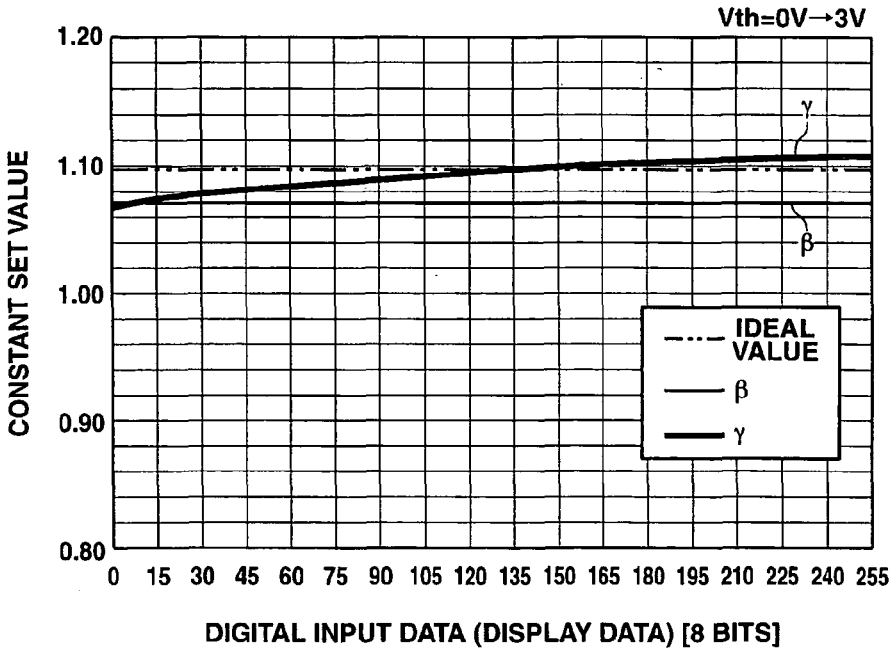
FIG. 38 is a characteristic diagram showing the relationship between a constant to be set to achieve the operational effects according to the embodiment.

FIG. 38 is a characteristic diagram showing the relationship between a constant to be set to achieve the operational effects according to the embodiment.

As described above, the relationship between the gradation designating voltage Vpix and the gate-source voltage Vgs of the transistor Tr13 shown in the equations 13 and 14 is such that because of the presence of the potential difference by the ON resistance of the transistor Tr12 between the source terminal (node N12) of the transistor Tr13 and the data line Ld, to hold the sum of a voltage which is the threshold voltage Vth13 of the transistor Tr13 multiplied by γ and the data voltage Vd0 at the node N12, the sum of the threshold voltage Vth multiplied by P and the gradation effective voltage Vreal is written as the gradation designating voltage Vpix.

Examining the relationship between the gradation designating voltage Vpix and a change in the gate-source voltage Vgs of the transistor Tr13 or γVth13 with βVth13 being offset in the relationship between Vpix and Vgs, the constants β and γ with respect to input data (designated gradation) when the threshold voltage Vth13 is changed from 0 V to 3 V take values such that while the constant β defining the gradation designating voltage Vpix is constant (indicated by a solid line in FIG. 38) for every input data as shown in FIG. 38, the constant γ defining the gate-source voltage Vgs of the transistor Tr13 changes at an approximately constant slope (indicated by a thick solid line in FIG. 38) with respect to the input data. To set the constant γ to the ideal value (indicated by a two-dot chain line in FIG. 38) at, for example, an intermediate gradation (near 128th gradation in 256 gradations shown in FIG. 38), γ=1.097 needs to be set for β=1.08 and the constants β and γ can be set to approximated values, so that practically β=γ may be set.

As a result of various verifications conducted by the present inventor based on the foregoing verification results, it is preferable that the constant γ (=β) defining the gate-source voltage Vgs of the emission driving transistor Tr13 be 1.05 or greater, and it is concluded that the gradation designating voltage Vpix which allows the voltage component Vgs (write voltage Vd) to be written and held at the source terminal (node N12) of the transistor Tr13 to become the voltage (−Vd0−γVth13) as given in the equation 14 should be set applied to the one gradation in input data (designated gradation).

In this case, it is preferable that the dimension of the emission driving transistor Tr13 (i.e., the ratio of the channel width to the channel length; W/L) and the voltage (Vsh, −Vsl) of the select signal Ssel should be set in such a way that a change in emission drive current Iem caused by a change in threshold voltage Vth13 (Vth shift) falls within approximately 2% with respect to the maximum current value in the initial state before the threshold voltage Vth13 changes.

The gradation designating voltage Vpix needs to be −Vd or the source potential of the transistor Tr13 added to the drain-source voltage of the transistor Tr12. The greater the absolute value of supply voltage Vccw minus gradation designating voltage Vpix gets, the larger the value of the current flowing between the drain and source of the transistor Tr13 becomes, so that the difference between Vpix and −Vd becomes larger. It is to be noted that making the influence of a voltage drop caused by the drain-source voltage of the transistor Tr12 can allow the effect of the threshold voltage Vth multiplied by β to be directly reflected on the γ effect.

That is, if the voltage component γVth which satisfies the equation 14 and depends on the threshold voltage can be set, a change in the value of the emission drive current Iem at the time of transition from the write operation state to the emission operation state can be compensated for, but the influence of the drain-source voltage of the transistor Tr12 needs to be considered.

For example, the transistor Tr12 is designed in such a way that the drain-source voltage of the transistor Tr12 at the highest luminance gradation in the write operation or the maximum drain-source voltage of the transistor Tr12 becomes 1.3 V or so, as shown in FIG. 33.

FIG. 38 is a characteristic diagram of the constant in the pixel drive circuit DC which has provided the characteristic diagram in FIG. 33, and in which the difference between the constant γ (≈1.07) at the lowest luminance gradation of "0" and the constant γ (≈1.11) at the highest luminance gradation of "255" can be made sufficiently small and can be approximated to β in the equation 22.

That is, even when the voltage component Vd0 of the gate-source voltage Vgs of the transistor Tr13 in the supply voltage Vccw minus gradation designating voltage Vpix becomes the gradation effective voltage Vreal, the compensation voltage Vpth (=βVth13) added to the gradation effective voltage Vreal and the sign of the resultant voltage is set negative to be the gradation designating voltage Vpix, and the gradation designating voltage Vpix in the write operation mode is set to satisfy the equation 13, the constant γ can be approximated to β if the maximum drain-source voltage of the transistor Tr12 is adequately set, and highly accurate gradation display can be achieved over the range from the lowest luminance gradation to the highest luminance gradation.

Figure 39:
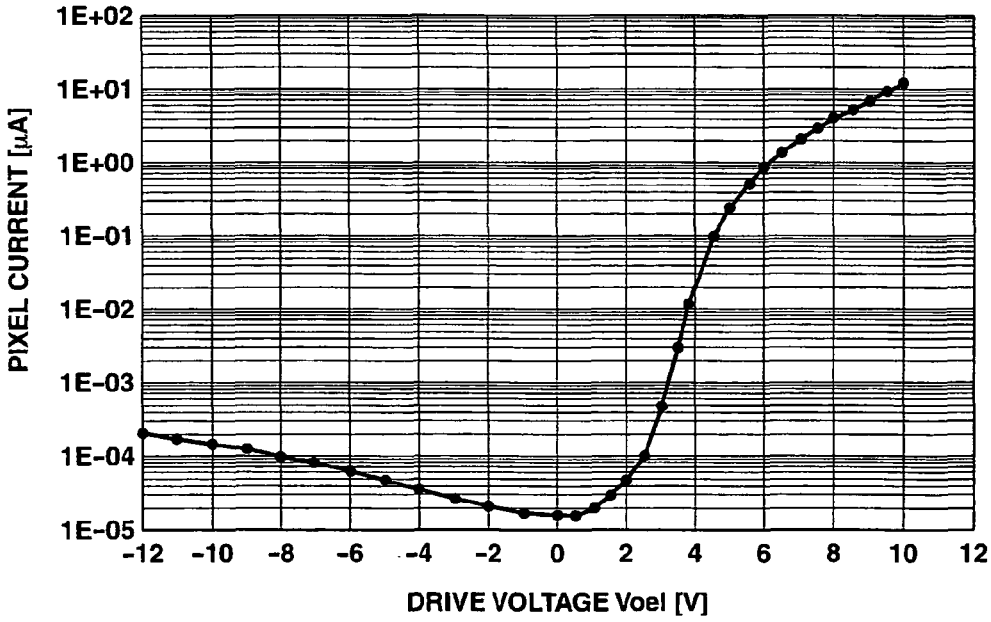
FIG. 39 is a diagram showing the voltage-current characteristic of an organic EL device OLED to be used in verifying a series of operational effects according to the embodiment.

A characteristic (V-I characteristic) of a change in pixel current with respect to the drive voltage of the organic EL device OLED (pixel size of 129 μm×129 μm, aperture ratio of 60%) used in the verification of the series of operational effects shows a tendency that as shown in FIG. 39, a relative minute pixel current (approximately in the order of 1.0E-3 μA to 1.0E-5 μA) flows in the area where the drive voltage is negative, and the pixel current becomes minimum when the drive voltage is nearly 0 V, and sharply rises as the voltage value rises in the positive voltage area of the drive voltage.

FIG. 39 is a diagram showing the voltage-current characteristic of an organic EL device to be used in verifying the series of operational effects.

Figure 40:
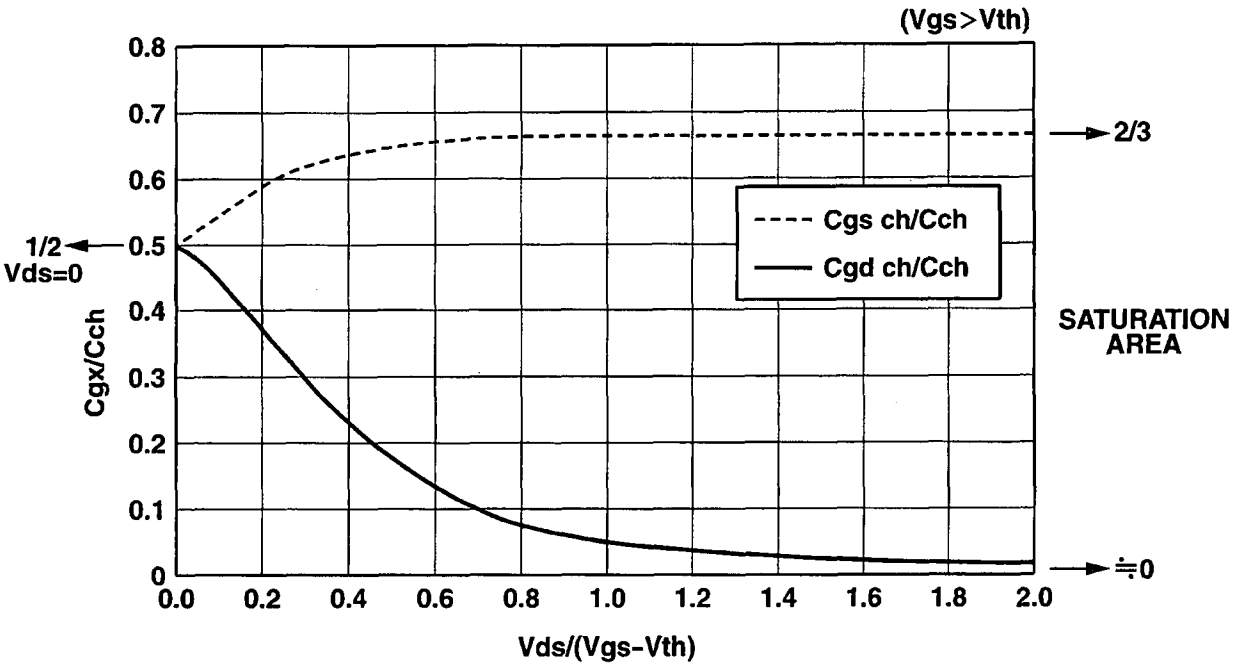
FIG. 40 is a characteristic diagram showing the voltage dependency of a parasitic capacitor in the channel of a transistor to be used in a display pixel (pixel drive circuit) according to the embodiment.

FIG. 40 is a characteristic diagram showing the voltage dependency of an intra-channel parasitic capacitor of a transistor to be used in a display pixel (pixel drive circuit) according to the embodiment.

FIG. 40 shows the capacitance characteristic under the condition that the gate-source voltage Vgs is greater than the threshold voltage Vth (Vgs>Vth), i.e., a channel is formed between the source and drain, based on the Meyer capacitance model which is generally referred to at the time of discussing a parasitic capacitor in a thin film transistor.

The intra-channel capacitance Cch of a thin film transistor roughly includes a gate-source parasitic capacitance Cgsch and a gate-source parasitic capacitance Cgdch, and the relationship between the ratio of the drain-source voltage Vds to the difference (Vgs−Vth) between the gate-source voltage Vgs and the threshold voltage Vth (voltage ratio; Vds/(Vgs−Vth)) and the ratio of the gate-source parasitic capacitance Cgsch or the gate-drain parasitic capacitance Cgdch to the channel capacitance Cch of the transistor (capacitance ratio; Cgsch/Cch, Cgdch/Cch) has a characteristic such that as shown in FIG. 40, when the voltage ratio is 0 (i.e., when the drain-source voltage Vds=0 V), the source and the drain are not distinguished, the capacitance ratio Cgsch/Cch and Cgdch/Cch are equal and ½, and as the voltage ratio increases (i.e., when the drain-source voltage Vds reaches the saturation area), the capacitance ratio Cgsch/Cch becomes approximately ⅔ while the capacitance ratio Cgdch/Cch approaches to 0.

As explained above, as the gradation designating voltage Vpix having the voltage value shown in the equation 41 is generated and applied to the data line Ld by the data driver 140 in the write operation of the display pixel PIX, the gate-source voltage Vgs set in consideration (expectation) of the influence of a voltage change in the pixel drive circuit DC in addition to display data (luminance gradation value) can be held between the gate and source terminals of the transistor Tr13 to compensate for the value of the emission drive current Iem to be supplied to the organic EL device OLED in the emission operation mode. As the emission drive current Iem having a current value corresponding to display data can be let to flow to the organic EL device OLED to ensure emission a light emitting operation in a luminance gradation according to the display data, therefore, it is possible to implement a display apparatus which suppresses a deviation in luminance gradation in each display pixel to bring about excellent display quality.

<Specific Example of Drive Method>

The unique drive method for the display apparatus 100 having the display area 110 as shown in FIG. 9 will be described specifically.

In the display apparatus according to the embodiment (see FIG. 9), a plurality of display pixels PIX arrayed in the display area 110 are separated into two groups respectively having the upper area and lower area of the display area 110, and the independent supply voltage Vcc is applied to the groups via the individual supply voltage lines Lv1, Lv2, so that a plurality of display pixels PIX included in each group can perform an emission operation at a time.

Figure 41:
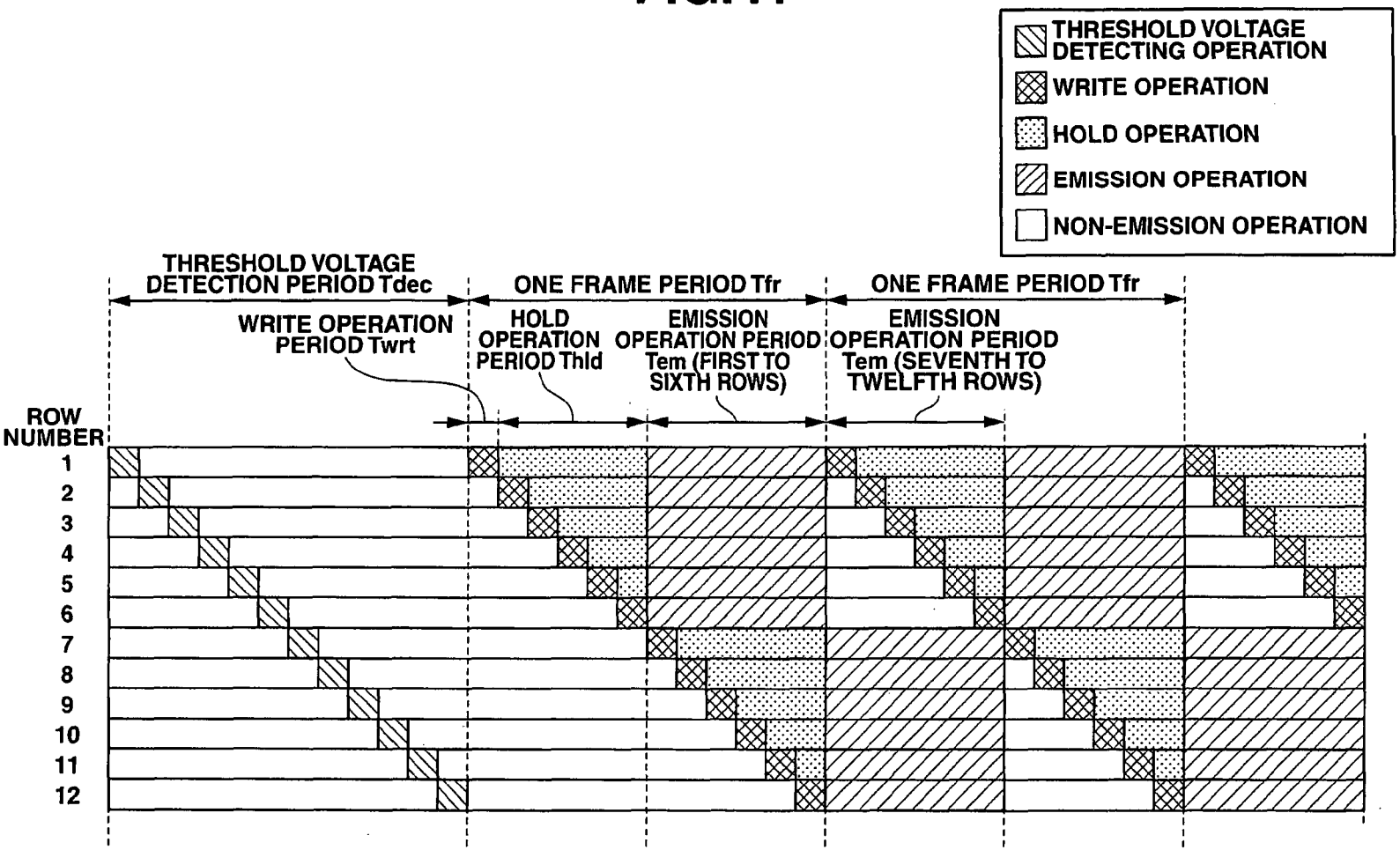
FIG. 41 is an operational timing chart exemplarily showing a specific example of the drive method for the display apparatus with a display area according to the embodiment.

FIG. 41 is an operational timing chart exemplarily showing a specific example of the drive method for the display apparatus having the display area according to the embodiment.

FIG. 41 shows an operational timing chart in a case where 12 rows (n=12; first to twelfth rows) of display pixels PIX are arrayed in the display area for the sake of descriptive convenience, the display pixels are grouped into a set of the first to sixth rows (corresponding to the upper area) of display pixels and a set of the seventh to twelfth rows (corresponding to the lower area) of display pixels.

The drive method for the display apparatus 100 according to the embodiment sequentially (alternately in the display apparatus 100 shown in FIG. 9) repeating, for each group, processes of first executing the threshold voltage detecting operation (threshold voltage detection period Tdec) of detecting the threshold voltage Vth13 of the emission driving transistor Tr13 (or voltage component corresponding to the threshold voltage Vth13) which controls the emission state of the organic EL device OLED in the pixel drive circuit DC provided at each of the display pixels PIX arrayed in the display area 110 prior to the display drive operation (display drive period shown in FIG. 16) of displaying image information in the display area 110, then holding the gate-source voltage Vgs corresponding to the gradation designating voltage Vpix comprised of the compensation voltage Vpth, obtained by multiplying the threshold voltage Vth13 of the transistor Tr13 by the constant β, and the gradation effective voltage Vreal according to display data (writing display data), and causing all the display pixels PIX included in the group of first to sixth rows of display pixels PIX or the group of seventh to twelfth rows of display pixels PIX to emit light at a luminance gradation according to the display data at a timing when the write operation is finished.

The threshold voltage detecting operation (threshold voltage detection period Tdec), as per the above-described embodiment, sequentially executes, at a predetermined timing for each row, a series of drive controls including the voltage applying operation (voltage application period Tpv) of applying a predetermined detection voltage Vpv to each row of display pixels PIX (pixel drive circuits DC) of the display area 110, the voltage converging operation (voltage convergence period Tcv) of converging the voltage component based on the detection voltage Vpv to the threshold voltage Vth13 of each transistor Tr13 at the time of detection, and the voltage reading operation (voltage read period Trv) of measuring (reading) the threshold voltage Vth13 after voltage convergence in each display pixel PIX and storing the threshold voltage Vth13 as threshold detection data for each display pixel PIX.

Specifically, as shown in FIG. 41, with the low-potential supply voltage Vcc (=Vccw) being applied to the group of the first to sixth rows of display pixels PIX arrayed in the display area 110 via the first supply voltage line Lv1 commonly connected to the display pixels PIX in the group, the threshold voltage detecting operation (voltage applying operation, voltage converging operation, voltage reading operation) is repeatedly executed row by row in order from the first row of display pixels PIX, and then with the low-potential supply voltage Vcc (=Vccw) being applied to the group of the seventh to twelfth rows of display pixels PIX via the second supply voltage line Lv2 commonly connected to the display pixels PIX in the group, the threshold voltage detecting operation is repeatedly executed row by row in order from the seventh row of display pixels PIX. As a result, for each row of display pixels PIX, threshold detection data corresponding to the threshold voltage Vth13 of the emission driving transistor Tr13 provided in the pixel drive circuit DC is acquired, and stored in the frame memory 147.

In the timing chart shown in FIG. 41, a hatched portion in the threshold voltage detection period Tdec indicated by hatches in each row represents the sequential threshold voltage detecting operation including the voltage applying operation, the voltage converging operation and the voltage reading operation according to the embodiment, and the threshold voltage detecting operations in the individual rows are sequentially executed at shifted timings so that the operations do not sequentially overlie one another.

Next, for the display drive operation (display operation period Tcyc), as per the above-described embodiment, a series of drive controls including the write operation (write operation period Twrt) of generating the compensation voltage Vpth, which is the threshold voltage Vth13 multiplied by the constant β for each of the display pixels PIX in each row of the display area 110 based on threshold detection data, detected and stored by the threshold voltage detecting operation for the transistor Tr13 in each display pixel PIX (pixel drive circuit DC) and writing a voltage component based on the compensation voltage Vpth and the gradation effective voltage Vreal according to the display data, e.g., a voltage component (gradation designating voltage Vpix, Vpix(0)) which is the sum of the compensation voltage Vpth and the gradation effective voltage Vreal, the hold operation (hold operation period Thld) of holding the written voltage component, and the emission operation (emission operation period Tem) of causing each display pixel PIX (organic EL device OLED) to emit light at a luminance gradation according to the display data (gradation effective voltage) at a predetermined timing are sequentially executed at predetermined timings row by row within one frame period Tfr.

Specifically, as shown in FIG. 41, with the low-potential supply voltage Vcc (=Vccw) being applied to the group of the first to sixth rows of display pixels PIX arrayed in the display area 110 via the first supply voltage line Lv1 commonly connected to the display pixels PIX in the group, the write operation of writing the gradation designating voltage Vpix generated by adding the compensation voltage Vpth=βVth13 and the gradation effective voltage Vreal in the group in order from the first row of display pixels PIX, and the hold operation of holding the gate-source voltage Vgs corresponding to the gradation designating voltage Vpix in that row of display pixels PIX whose writing has been finished are repeatedly executed row by row.

At the timing when writing to the sixth row of display pixels PIX is finished, the high-potential supply voltage Vcc (=Vcce) is applied via the first supply voltage line Lv1 in the group, the six rows of display pixels PIX in the group are caused to perform, at a time, an emission operation at luminance gradations according to the display data based on the gradation designating voltage Vpix written in each display pixel PIX. This emission operation continues until the timing at which the next the display drive operation (write operation) for the first row of display pixels PIX is started (emission operation period Tem of first to sixth rows). According to the drive method, the display pixels PIX in the sixth row which is the last row in that group can perform an emission operation without going to the hold operation after the write operation (without having the hold operation period Thld).

In the timing chart shown in FIG. 41, the hatched portions indicated by cross meshing in each row of the display operation period Tcyc represent the display data write operation according to the embodiment. According to the embodiment, particularly, the write operations in the individual rows are sequentially executed at shifted timings, and of the display drive operations in the individual rows, only the emission operations are executed so as to sequentially overlie one another among the rows (at the same timing).

At the high-potential supply voltage Vcc (=Vcce) is applied via the supply voltage line Lv1 in the group the timing when writing to the first to sixth rows of display pixels PIX is finished (or at the timing when the emission operation of the first to sixth rows of display pixels PIX has started), with the low-potential supply voltage Vcc (=Vccw) being applied to the group of seventh to twelfth rows of display pixels PIX via the second supply voltage line Lv2 commonly connected to the display pixels PIX in the group, the write operation of writing the gradation designating voltage Vpix generated by adding the compensation voltage Vpth=βVth13 and the gradation effective voltage Vreal in the group in the order from the seventh row of display pixels, and the hold operation of holding the gate-source voltage Vgs corresponding to the gradation designating voltage Vpix in that row of display pixels PIX whose writing has been finished are repeatedly executed row by row.

Then, at the timing when writing to the twelfth row of display pixels PIX has been finished, the high-potential supply voltage Vcc (=Vcce) is applied via the second supply voltage line Lv2 thereof to allow the sixth row of display pixels PIX in the group to emit light at a luminance gradation according to display data based on the gradation designating voltage Vpix written in each display pixel PIX. This emission operation continues until the timing at which the next display drive operation (write operation) for the sixth row of display pixels PIX is started (emission operation period Tem of seventh to twelfth rows).

In this manner, drive control of a matrix of display pixels PIX arrayed in the display area 110 is carried out in such a way that after threshold detection data is acquired for each display pixel PIX by previously executing the threshold voltage detecting operation for each row of display pixels PIX, a series of processes including the write operation and the hold operation are sequentially executed for each row of display pixels PIX, and at the time when writing to every row of display pixels PIX included in each preset group has been finished, all the display pixels PIX in that group are cause to perform an emission operation at a time.

In the drive method for the display apparatus, before the emission operation period Tem, the emission operation of every display pixel (emission device) in the same group is not performed to set the non-emission state (black display state) while the write operation (hold operation) is performed on each row of display pixels in the group.

That is, in the operational timing chart shown in FIG. 41, the twelve rows of display pixels PIX constituting the display area 110 are separated into two groups and are controlled in such a way that the display pixels PIX in each group execute the emission operation at a time at a timing different from the timing for the other group. This makes it possible to set the ratio (black insertion ratio) of the black display period in one frame period Tfr provided by the non-emission operation to 50%. To clearly view a moving image without blurring or bleeding with the human visual sense, generally, the tentative black insertion ratio is about 30%. Therefore, the drive method of the present invention can realize a display apparatus having a relatively good display image quality.

Although FIG. 9 shows the case where a plurality of display pixels PIX in the display area 110 to be adopted to the display apparatus 100 are grouped into two sets containing consecutive rows, the present invention is not limited to this case but the display pixels PIX may be grouped into sets each of which does not contain consecutive rows, like odd rows or even rows. A plurality of display pixels PIX arrayed in the display area 110 may be grouped into an arbitrary number of sets, such as three sets or four sets. This modification can allow the emission time and the ratio of the black display period (black display state) to be arbitrarily set according to the number of sets, and can thus improve the display image quality. Specifically, while the black insertion ratio can be set to approximately 33% in the case of separating the display pixels PIX into three groups, the black insertion ratio can be set to approximately 25% in the case of separating the display pixels PIX into four groups.

The display pixels PIX may be caused to perform an emission operation row by row by laying (connecting) power supply lines for the respective rows without grouping the display pixels PIX and independently applying the supply voltage Vcc thereto at different timings. Accordingly, the above-described display drive operation is executed row by row, so that any row of display pixels PIX whose writing is finished can be allowed to perform an emission operation at an arbitrary timing. According to another mode, all the display pixels PIX for one screen of the display area 110 may be caused to perform an emission operation at a time by applying a common supply voltage Vcc to all the display pixels PIX for one screen of the display area 110 at a time.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2007-091367 filed on Mar. 30, 2007 and including specification, claims, drawings and summary. The disclosure of the above Japanese Patent Application is incorporated herein by reference in its entirety.

What is claimed is:

1. a display drive apparatus for driving display pixels each having an optical element and a pixel drive circuit having a drive transistor including a first control terminal and a first current path, a diode connecting transistor including a second control terminal and a second current path, and a capacitive element, wherein a first end of the first current path is connected to the optical element, a supply voltage is applied to a second end of the first current path, a select signal is supplied to the second control terminal, a first end of the second current path is connected to the first end of the first current path, a second end of the second current path is connected to the second end of the first current path, and the capacitive element is provided between the first control terminal and the first end of the first current path, the display drive apparatus comprising:

a select driver that supplies the select signal to the pixel drive circuit;

a power supply driver that supplies the supply voltage to the pixel drive circuit;

a detection voltage applying circuit that applies a predetermined detection voltage to the drive transistor of the pixel drive circuit;

a voltage detecting circuit that detects a voltage value corresponding to a device characteristic unique to the drive transistor after a predetermined time elapses after the application of the detection voltage to the drive transistor by the detection voltage applying circuit; and a gradation designating signal generating circuit that generates a gradation designating signal based on an absolute value of a voltage component according to a gradation value of display data and a value, acquired by multiplying an absolute value of the voltage value detected by the voltage detecting circuit, by a constant set to a value of at least 1.05 and at most 1.11, and applies the gradation designating signal to the pixel drive circuit so that charges corresponding to the gradation designating signal are stored in the capacitive element;

wherein:

the power supply driver (i) sets a potential of the supply voltage to a first potential which sets the optical element in a non-operation state, when the detection voltage applying circuit applies the detection voltage and the voltage detecting circuit detects the voltage value and when the gradation designating signal generating circuit applies the gradation designating signal to the pixel drive circuit, and (ii) sets the potential of the supply voltage to a second potential, which differs from the first potential and sets the optical element in an operable state, when the optical element is operated in accordance with the gradation designating signal;

the select driver (i) supplies to the pixel drive circuit the select signal with a potential of a selection level, which sets the diode connecting transistor in an on state, to set the drive transistor in a diode connected state when the detection voltage applying circuit applies the detection voltage and the voltage detecting circuit detects the voltage value and when the gradation designating signal generating circuit applies the gradation designating signal to the pixel drive circuit, and (ii) supplies to the pixel drive circuit the select signal with a potential of a non-selection level, which sets the diode connecting transistor in an off state and differs from the selection level, to release the diode connected state of the drive transistor when the optical element is operated in accordance with the gradation designating signal; and in the gradation designating signal generating circuit, the constant is set to a value that compensates for a change in the charges stored in the capacitive element, which change occurs due to the potential of the supply voltage changing from the first potential to the second potential and the potential of the select signal changing from the selection level to the non-selection level when the optical element is operated in accordance with the gradation designating signal.

2. The display drive apparatus according to claim 1, further comprising a memory circuit that stores voltage value data corresponding to the voltage value detected by the voltage detecting circuit, wherein the gradation designating signal generating circuit reads the voltage value data stored in the memory circuit, and generates the gradation designating signal based on the absolute value of the voltage component according to the gradation value of the display data and a value, acquired by multiplying an absolute value of the voltage value data read from the memory circuit, by the constant.

3. The display drive apparatus according to claim 1, wherein after the detection voltage is applied to the drive transistor by the detection voltage applying circuit and charges corresponding to the detection voltage are stored in the capacitive element, the detection voltage applying circuit is disconnected from the pixel drive circuit, the charges are partially discharged in the predetermined time, and the voltage detecting circuit detects a voltage corresponding to residual charges in the capacitive element after the predetermined time elapses as a voltage value corresponding to the device characteristic.

4. The display drive apparatus according to claim 1, wherein the detection voltage has a polarity to permit a current to flow toward a detection voltage applying circuit side from a display pixel side and has a constant voltage value whose absolute value is greater than an absolute value of the voltage value corresponding to the device characteristic.

5. The display drive apparatus according to claim 4, wherein the detection voltage applying circuit has a detection voltage source that outputs the detection voltage having the constant voltage value.

6. The display drive apparatus according to claim 1, wherein the gradation designating signal generating circuit includes:

a gradation voltage generating unit that generates a gradation effective voltage having a voltage value to cause the optical element to emit light at a luminance gradation according to the gradation value of the display data;

a compensation voltage generating unit that generates a compensation voltage having a voltage value which is an absolute value of the voltage value detected by the voltage detecting circuit multiplied by the constant; and an operation circuit unit that generates the gradation designating signal based on a sum of an absolute value of the gradation effective voltage and an absolute value of the compensation voltage.

7. The display drive apparatus according to claim 1, wherein the optical element comprises a current controlled type emission device, and wherein a device characteristic unique to the pixel drive circuit is a threshold voltage of the drive transistor.

8. A display apparatus for displaying image information, the display apparatus comprising:

display pixels each having an optical element and a pixel drive circuit having a drive transistor including a first control terminal and a first current path, a diode connecting transistor including a second control terminal and a second current path, and a capacitive element, wherein a first end of the first current path is connected to the optical element, a supply voltage is applied to a second end of the first current path, a select signal is supplied to the second control terminal, a first end of the second current path is connected to the first end of the first current path, a second end of the second current path is connected to the second end of the first current path, and the capacitive element is provided between the first control terminal and the first end of the first current path;

a data line connected to the pixel drive circuit of the display pixel; and a display drive apparatus, the display drive apparatus comprising:

a select driver that supplies the select signal to the pixel drive circuit;

a power supply driver that supplies the supply voltage to the pixel drive circuit;

a detection voltage applying circuit that applies a predetermined detection voltage to the drive transistor of the pixel drive circuit of the display pixel via the data line;

a voltage detecting circuit that detects a voltage value corresponding to a device characteristic unique to the drive transistor via the data line after a predetermined time elapses after the application of the detection voltage to the drive transistor by the detection voltage applying circuit; and a gradation designating signal generating circuit that generates a gradation designating signal based on an absolute value of a voltage component according to a gradation value of display data and a value, acquired by multiplying an absolute value of the voltage value detected by the voltage detecting circuit, by a constant set to a value of at least 1.05 and at most 1.11, and applies the gradation designating signal to the pixel drive circuit via the data line so that charges corresponding to the gradation designating signal are stored in the capacitive element;

wherein:

the power supply driver (i) sets a potential of the supply voltage to a first potential, which sets the optical element in a non-operation state when the detection voltage applying circuit applies the detection voltage and the voltage detecting circuit detects the voltage value and when the gradation designating signal generating circuit applies the gradation designating signal to the pixel drive circuit, and (ii) sets the potential of the supply voltage to a second potential, which differs from the first potential and sets the optical element in an operable state, when the optical element is operated in accordance with the gradation designating signal;

the select driver (i) supplies to the pixel drive circuit the select signal with a potential of a selection level, which sets the diode connecting transistor in an on state, to set the drive transistor in a diode connected state when the detection voltage applying circuit applies the detection voltage and the voltage detecting circuit detects the voltage value and when the gradation designating signal generating circuit applies the gradation designating signal to the pixel drive circuit, and (ii) supplies to the pixel drive circuit the select signal with a potential of a non-selection level, which sets the diode connecting transistor in an off state and differs from the selection level, to release the diode connected state of the drive transistor when the optical element is operated in accordance with the gradation designating signal; and in the gradation designating signal generating circuit, the constant is set to a value that compensates for a change in the charges stored in the capacitive element, which change occurs due to the potential of the supply voltage changing from the first potential to the second potential and the potential of the select signal changing from the selection level to the non-selection level when the optical element is operated in accordance with the gradation designating signal.

9. The display apparatus according to claim 8, wherein the display drive apparatus further includes a memory circuit that stores voltage value data corresponding to the voltage value detected by the voltage detecting circuit, and the gradation designating signal generating circuit reads the voltage value data stored in the memory circuit, and generates the gradation designating signal based on the absolute value of the voltage component according to the gradation value of the display data and a value, acquired by multiplying an absolute value of the voltage value data read from the memory circuit, by the constant.

10. The display apparatus according to claim 8, wherein after the detection voltage is applied to the pixel drive circuit via the data line by the detection voltage applying circuit and charges corresponding to the detection voltage are stored in the capacitive element, the detection voltage applying circuit in the display drive apparatus is disconnected from the pixel drive circuit, the charges are partially discharged in the predetermined time, and the voltage detecting circuit detects a voltage corresponding to residual charges in the capacitive element via the data line after elapse of the predetermined time as a voltage value corresponding to the device characteristic.

11. The display apparatus according to claim 10, wherein a device characteristic unique to the pixel drive circuit is a threshold voltage of the drive transistor.

12. The display apparatus according to claim 10, further comprising a display panel having a plurality of select lines aligned in a row direction and a plurality of data lines aligned in a column direction, and having a plurality of display pixels connected to the data lines and the select lines near intersections of the data lines and the select lines;

wherein the select driver sequentially applies the select signal to the individual select lines.

13. The display apparatus according to claim 12, wherein the pixel drive circuit in each display pixel further includes a select transistor that is connected between the drive transistor and the data line and has a third control terminal and a third current path;

wherein the third control terminal is connected to the select line, a first end of the third current path is connected to the data line, a second end of the third current path is connected to the first end of the first current path of the drive transistor, and the second control terminal of the diode connecting transistor is connected to the select line.

14. The display apparatus according to claim 13, wherein a device size of the select transistor and a voltage value of the select signal are set according to the gradation designating signal to values such that, based on a voltage component to be written and held between the first control terminal of the drive transistor and one terminal thereof in the first current path, an amount of a change in a current value of a drive current flowing to an emission device via the first current path of the drive transistor, which is caused by a change in the threshold voltage of the drive transistor, lies within 2% of a maximum current value in an initial state where the threshold voltage of the drive transistor has not changed at every luminance gradation to permit the emission device to emit light.

15. The display apparatus according to claim 8, wherein the optical element comprises a current controlled type emission device.

16. The display apparatus according to claim 8, wherein the detection voltage has a polarity to permit a current to flow toward a detection voltage applying circuit side from a display pixel side via the data line and has a constant voltage value whose absolute value is greater than an absolute value of the voltage value corresponding to the device characteristic.

17. The display apparatus according to claim 16, wherein the detection voltage applying circuit in the display drive apparatus has a detection voltage source that outputs the detection voltage having the constant voltage value.

18. The display apparatus according to claim 8, wherein the gradation designating signal generating circuit in the display drive apparatus includes:

a gradation voltage generating unit that generates a gradation effective voltage having a voltage value to cause the optical element to emit light at a luminance gradation according to the gradation value of the display data;

a compensation voltage generating unit that generates a compensation voltage having a voltage value which is an absolute value of the voltage value detected by the voltage detecting circuit multiplied by the constant; and an operation circuit unit that generates the gradation designating signal based on a sum of an absolute value of the gradation effective voltage and an absolute value of the compensation voltage, and applies the gradation designating signal to the data line.

19. A drive method for a display drive apparatus for driving a display apparatus for displaying image information, the method comprising:

applying a predetermined detection voltage, via a data line connected to a pixel drive circuit of a display pixel, to a drive transistor of the pixel drive circuit in the display pixel, the display pixel having an optical element and the pixel drive circuit having the drive transistor, the drive transistor including a first control terminal and a first current path, a diode connecting transistor including a second control terminal and a second current path, and a capacitive element, wherein a first end of the first current path is connected to the optical element, a first end of the second current path is connected to the first end of the first current path, a second end of the second current path is connected to the second end of the first current path, the capacitive element is provided between the first control terminal and the first end of the first current path, while a supply voltage set to a first potential, which sets the optical element in a non-operation state, is supplied to the second end of the first current path and a select signal with a potential of a selection level, which sets the diode connecting transistor in an on state, is supplied to the second control terminal to set the drive transistor in a diode connected state;

detecting with a voltage detecting circuit a voltage value corresponding to a device characteristic unique to the drive transistor via the data line after a predetermined time elapses after the application of the detection voltage to the drive transistor, while the supply voltage set to the first potential is supplied to the second end of the first current path of the drive transistor and the select signal with the potential of the selection level is supplied to the second control terminal;

generating a gradation designating signal based on an absolute value of a voltage component according to a gradation value of display data and a value, acquired by multiplying an absolute value of the voltage value detected by the voltage detecting circuit, by a constant set to a value of at least 1.05 and at most 1.11;

applying the gradation designating signal to the pixel drive circuit via the data line such that charges corresponding to the gradation designating signal are stored in the capacitive element, while the supply voltage set to the first potential is supplied to the second end of the first current path of the drive transistor and the select signal with the potential of the selection level is supplied to the second control terminal;

supplying the supply voltage set to a second potential, which differs from the first potential and sets the optical element in an operable state to the second end of the first current path of the drive transistor, and supplying the select signal with a potential of a non-selection level which sets the diode connecting transistor in an off state and differs from the selection level to the second control terminal to release the diode connected state of the drive transistor, thereby operating the optical element in accordance with the gradation designating signal; and at a time of generating the gradation designating signal, setting the constant to a value that compensates for a change in the charges stored in the capacitive element, which change occurs due to the potential of the supply voltage changing from the first potential to the second potential and the potential of the select signal changing from the selection level to the non-selection level.

20. The drive method according to claim 19, wherein the display drive apparatus further includes a memory circuit that stores voltage value data corresponding to the voltage value detected by the voltage detecting circuit;

the detected voltage value is stored in the memory circuit at a time of detecting the voltage value corresponding to the device characteristic; and the voltage value data is stored in the memory circuit at a time of generating the gradation designating signal.

21. The drive method according to claim 19, wherein:

charges corresponding to the detection voltage are stored in the capacitive element at a time of applying the detection voltage;

at a time of detecting a detection voltage corresponding to the device characteristic, the detection voltage applying circuit is disconnected from the pixel drive circuit after the charges corresponding to the detection voltage are stored in the capacitive element by the application of the detection voltage; and with the charges being partially discharged in the predetermined time, a voltage corresponding to residual charges in the capacitive element is detected via the data line after elapse of the predetermined time as a voltage value corresponding to the device characteristic.

22. The drive method according to claim 19, wherein, at a time of generating the gradation designating signal:

a gradation effective voltage having a voltage value to cause the optical element to emit light at a luminance gradation according to the gradation value of the display data is generated;

a compensation voltage having a voltage value which is an absolute value of the detected voltage value multiplied by the constant is generated; and the gradation designating signal is generated based on a sum of an absolute value of the gradation effective voltage and an absolute value of the compensation voltage.

* * * * *